US012789948B2

(12) United States Patent
Farrell

(10) Patent No.: US 12,789,948 B2
(45) Date of Patent: Nov. 10, 2026

(54) BOAT DOCKING ASSIST ASSEMBLY

(71) Applicant: Richard Gregory Farrell, Laguna Beach, CA (US)

(72) Inventor: Richard Gregory Farrell, Laguna Beach, CA (US)

( * ) Notice: Subject to any disclaimer, the term of this patent is extended or adjusted under 35 U.S.C. 154(b) by 30 days.

(21) Appl. No.: 18/771,943

(22) Filed: Jul. 12, 2024

(65) Prior Publication Data

US 2025/0019044 A1 Jan. 16, 2025

Related U.S. Application Data

(63) Continuation-in-part of application No. PCT/US2022/081855, filed on Dec. 16, 2022.

(60) Provisional application No. 63/558,868, filed on Feb. 28, 2024, provisional application No. 63/513,171, filed on Jul. 12, 2023, provisional application No. 63/377,320, filed on Sep. 27, 2022, provisional application No. 63/299,328, filed on Jan. 13, 2022.

(51) Int. Cl.
*B63B 21/00* (2006.01)
*E02B 3/26* (2006.01)

(52) U.S. Cl.
CPC ..... *B63B 21/00* (2013.01); *E02B 3/26* (2013.01); *B63B 2021/003* (2013.01)

(58) Field of Classification Search
CPC ... B63B 21/00; B63B 21/54; B63B 2021/001; B63B 2021/004; E02B 3/26
See application file for complete search history.

(56) References Cited

U.S. PATENT DOCUMENTS 3,019,759 A 2/1962 Woods
3,139,852 A * 7/1964 Morris ..... E02B 3/24 114/230.18
3,157,150 A * 11/1964 Faber, Jr. ..... E02B 3/24 114/230.18
3,177,839 A * 4/1965 Nolf ..... E02B 3/24 114/230.18
3,828,716 A * 8/1974 Bernardi ..... B63B 21/54 114/221 R
3,861,346 A 1/1975 Pina
5,499,591 A * 3/1996 Chippas ..... B63B 21/00 114/230.15

(Continued)

FOREIGN PATENT DOCUMENTS

CA 2083010 5/1994
CA 2255429 6/2000

(Continued)

*Primary Examiner* — Amber R Anderson
(74) *Attorney, Agent, or Firm* — Knobbe, Martens, Olson & Bear, LLP

(57) ABSTRACT

A docking system for assisted boat docking. The docking system may include a front assembly and/or a rear assembly. The front assembly can be configured to engage a bow of a boat and at least partially absorb a docking impact force of the boat. The front assembly can include a first mounting portion, a first arm, and a bow retaining portion. The first mounting portion can be configured to be supported by an upper surface of a dock. The first arm can be supported by the first mounting portion and can extend transverse to the first mounting portion. The bow retaining portion can be supported by the first arm. The rear assembly can be configured to engage and/or secure a rear of the boat to the dock.

20 Claims, 32 Drawing Sheets

(56) References Cited

U.S. PATENT DOCUMENTS

| | | | | |
|---|---|---|---|---|
| 5,520,134 | A | 5/1996 | Walker | |
| 6,205,944 | B1 * | 3/2001 | Dierksen | B63B 21/00 114/230.1 |
| 6,477,968 | B2 | 11/2002 | Powell | |
| 6,851,380 | B1 | 2/2005 | Khoury et al. | |
| 6,962,122 | B1 * | 11/2005 | Bouldin, Jr. | B63B 21/00 114/230.17 |
| 7,066,102 | B1 | 6/2006 | Tossavainen | |
| 7,827,924 | B1 * | 11/2010 | Perez | B63B 21/00 114/230.15 |
| 8,091,499 | B1 * | 1/2012 | Perez | B63B 21/00 114/230.15 |
| 8,342,116 | B1 * | 1/2013 | Cardarelli | B63B 21/54 114/221 R |
| 9,027,496 | B2 * | 5/2015 | Zucco | E02B 3/20 114/230.15 |
| 9,567,044 | B2 | 2/2017 | Vandenworm | |
| 11,834,803 | B2 * | 12/2023 | Farrell | E02B 3/26 |
| 2005/0066869 | A1 | 3/2005 | Alan | |
| 2016/0052609 | A1 | 2/2016 | Mulhern | |
| 2016/0107727 | A1 * | 4/2016 | Nachem | B63B 21/04 114/230.1 |
| 2017/0370061 | A1 | 12/2017 | James | |
| 2020/0116458 | A1 | 4/2020 | Knezek et al. | |
| 2023/0220642 | A1 | 7/2023 | Farrell | |

FOREIGN PATENT DOCUMENTS

| | | | |
|---|---|---|---|
| EP | 3 014 025 | 4/2020 | |
| FR | 2469500 | 5/1981 | |
| GB | 2369607 A * | 6/2002 | B63B 21/00 |
| NZ | 549531 | 7/2009 | |
| WO | WO 1981/001431 | 5/1981 | |
| WO | WO 2009/037440 | 3/2009 | |
| WO | WO 2015/143491 | 10/2015 | |
| WO | WO 2020/058734 | 3/2020 | |

* cited by examiner

BOAT DOCKING ASSIST ASSEMBLY

INCORPORATION BY REFERENCE TO ANY PRIORITY APPLICATIONS

The present application is a continuation-in-part of, and claims priority benefit to, PCT/US2022/081855, entitled "BOAT DOCKING ASSIST ASSEMBLY," which has an international filing data of Dec. 16, 2022, which was published in English on Jul. 20, 2023 under International Publication Number WO 2023/136959, which is hereby incorporated by reference in its entirety. PCT/US2022/081855 claims priority benefit to U.S. Provisional Application No. 63/377,320, filed Sep. 27, 2022, and U.S. Provisional Application No. 63/299,328, filed Jan. 13, 2022, each of which are hereby incorporated by reference in their entirety. The present application also claims priority benefit to U.S. Provisional Application No. 63/558,868, filed Feb. 28, 2024, and U.S. Provisional Patent Application No. 63/513,171, filed Jul. 12, 2023, each of which is hereby incorporated by reference herein in their entirety. Any and all applications for which a foreign or domestic priority claim is identified in the Application Data Sheet as filed with the present application are hereby incorporated by reference under 37 CFR 1.57.

BACKGROUND

Field

The present disclosure is generally related to the field of boats, boat docks, and methods of parking a boat alongside a dock.

General Discussion

Methods of assisted boat docking currently exist with limitations. A new system would be desirable.

SUMMARY

Various systems, methods, and devices are disclosed for the assisted docking of a boat. The systems, methods, and devices of the disclosure each have several innovative aspects, no single one of which is solely responsible for the desirable attributes disclosed herein.

In one aspect, a docking assist assembly is disclosed. The docking assist assembly may include a mounting portion configured to be supported by an upper surface of a dock; an arm portion extending transverse to the mounting portion; and a bow retaining portion including a first side and a second side, the first side defining a first surface facing at least partially toward the second side and a second side defining a second surface at least partially facing toward the first side, said first side and said second side configured to receive a bow of a boat at least partially between the first side and the second side; wherein at least one of the arm portion and the bow retaining portion is movable relative to the mounting portion so as to at least partially absorb a docking impact force of a boat.

In one aspect, the mounting portion desirably comprises a first side and a second side, the second side defining an interface plane configured to be supported by an upper surface of a dock. In one aspect, the first side and the second side of the bow retaining portion are no longer than 8 feet long. In one aspect, the first side and the second side of the bow retaining portion are no longer than 6 feet long. In one aspect, said first side and said second side of the bow retaining portion are resilient and are movable at least one inch in response to an impact force of 100 pounds. In one aspect, said first side and said second side of the bow retaining portion are movable with respect to one another to facilitate receiving different shape bows there between. In one aspect, neither the arm portion, nor the bow retaining portion projects more than ten feet beyond a side of mounting portion configured to be supported by an upper surface of a dock. In one aspect, the docking assist assembly weighs no more than 500 pounds. In one aspect, the arm portion comprises a first arm portion and a second arm portion, wherein the second arm portion is rotatable relative to the first arm portion and a maximum amount of rotation of the second arm portion from a relaxed position is 45 degrees in a first direction. In one aspect, the second arm portion is rotatable relative to the first arm portion and the maximum amount of rotation of the second arm portion from a relaxed position is 90 degrees in a second direction. In one aspect, the first side of the bow retaining portion and the second side of the bow retaining portion are comprised of a single integral piece. In one aspect, the docking assist assembly further comprising one or more of: lights coupled to the bow retaining portion, a slip resistant platform configured to couple with the upper surface of the dock, and a resilient dock bumper portion configured to couple to a water facing side of the dock.

In one aspect, a docking assist assembly mountable to a dock having a support area and an elongate edge along which a length of a boat is to be docked is disclosed. The docking assist assembly may include, a mounting portion defining a support base; an arm portion configured to extend transverse to the edge of a dock along which a length of a boat is intended to dock, at least a portion of the arm portion movable with respect to the support base; and a bow retaining portion including a first side and a second side, the first side defining a first surface facing at least partially toward the second side and a second side defining a second surface at least partially facing toward the first side, said first side and said second side configured to receive a bow of a boat at least partially between the first side and the second side; wherein movement of the arm portion relative the support base at least partially absorbs a force of a boat docking; wherein when the support base is facing downward both the arm portion and the bow retaining portion either (1) do not extend below the support base or (2) extend less than two feet below the support base; wherein said first side and said second side at least partially include resilient areas configured to cushion the bow of a boat impacting the resilient areas.

In one aspect, a docking assist assembly is disclosed. The docking assist assembly may include a mounting portion configured to be supported by an upper surface of a dock; an arm portion extending transverse to the mounting portion; a bow retaining portion defining an opening for receiving at least a portion of a bow of a boat; wherein at least one of the arm portion and the bow retaining portion is movable relative to the mounting portion so as to at least partially absorb a docking impact force of a boat.

In one aspect, the bow retaining portion is rotatable with respect to the arm portion. In one aspect, the bow retaining portion is resilient and is movable at least one inch in response to an impact force of 100 pounds. In one aspect, the bow retaining portion comprises a first side and a second side, wherein said first side and said second side are movable with respect to one another to facilitate receiving different shape bows there between. In one aspect, the docking assist assembly weighs no more than 500 pounds. In one aspect, the arm portion comprises a first arm portion and a second arm portion, wherein the second arm portion is rotatable relative to the mounting portion and a maximum amount of rotation of the second arm portion from a relaxed position is 45 degrees. In one aspect, the second arm portion is rotatable relative to the first arm portion and the maximum amount of rotation of the second arm portion from a relaxed position is 90 degrees in a second direction. In one aspect, the bow retaining portion is comprised of a single integral piece.

In one aspect, a rear docking assist assembly is disclosed. The disclosed embodiments of a rear docking assist assembly can be used to secure a rear portion of a boat to a dock. In some embodiments, the rear docking assist assembly can be used in combination with any of docking assist assemblies described herein (which may be referred to as "front docking assist assemblies"). When the rear docking assist assembly is used with a front docking assist assembly, the front docking assist assembly is configured to receive and retain the front portion of a boat. Once the front portion of the boat is received, it is desirable to have a system secure the rear portion of the boat to the dock, particularly when the boat operator is the sole occupant of the boat. The rear docking assist assemblies described herein can be used to facilitate the rear attachment of the boat to the dock. Embodiments of the rear docking assist assemblies can include an arm that suspends a line over the water beside the dock to secure the rear portion of the boat to the dock. The boat can include an engagement portion near the rear of the boat to attach the line to. The arm can be pivotable relative to the dock such that the arm can move the line between a position where the line is suspended over the water for securing the boat and a position where the line is suspended over the dock while not in use. Once the line is engaged with the engagement portion of the boat, the line can be tightened using tightening mechanism, such as a line brake, to remove the slack from the line and prevent the rear portion of the boat from drifting away from the dock. When the boat operator undocks the boat, the line brake can be used to add slack to the line and the line can be removed from the engagement portion of the boat. The arm and the line can then be pivoted back over the dock such that the boat is disengaged from the rear docking assist assembly and the boat can be undocked.

In one aspect, a rear docking assist assembly is disclosed. The rear docking assist assembly may include: a mounting portion configured to be supported by an upper surface of a dock; a line comprising a first line end and a second line end, the first line end coupled to the mounting portion; and an arm comprising a first arm end and a second arm end, the first arm end rotationally coupled to the mounting portion, the second arm end configured to support the line; wherein the arm is configured to move between a retracted configuration where the second arm end is positioned over the mounting portion and an extended configuration where the second arm end and a portion of the line are positioned over water adjacent to the dock.

In one aspect, the rear docking assist assembly comprises a line brake coupled to at least one of the mounting portion or the dock, the line brake moveable between an engaged configuration and a disengaged configuration, wherein the second line end passes through the line brake, wherein the line is fixed to the line brake when in the engaged configuration and movable relative to the line brake when in the disengaged configuration. In one aspect, the line brake comprises a foot release, wherein engagement of the foot release moves the line brake from the engaged configuration to the disengaged configuration. In one aspect, the rear docking assist assembly comprises a pivot assembly, the pivot assembly coupled to the mounting portion and the first arm end, the pivot assembly configured to allow the arm to rotate relative to the mounting portion. In one aspect, the rear docking assist assembly is configured to engage with an engagement portion coupled to a boat, wherein the line can extend around the engagement portion to secure the boat to the dock. In one aspect, the engagement portion extends at an angle relative to the mounting portion. In one aspect, the pivot assembly includes a motor, the motor configured to move the arm between the retracted configuration and the extended configuration. In one aspect, the rear docking assist assembly comprises a sensor system, the sensor system configured to move the arm from the retracted configuration to the extended configuration when the boat is in close proximity to the rear docking assist assembly. In one aspect, the second arm end comprises a line clip, the line clip configured to engage the line between the first line end and the second line end, the line moveable relative to the line clip.

In one aspect, a docking system is disclosed. The docking system may include a rear docking assist assembly and a front docking assist assembly. The front docking assist assembly may include a second mounting portion configured to be supported by the upper surface of the dock; an arm portion extending transverse to the second mounting portion; a bow retaining portion including a first side and a second side, the first side defining a first surface facing at least partially toward the second side and a second side defining a second surface at least partially facing toward the first side, said first side and said second side configured to releasably engage and receive a bow of the boat at least partially between the first side and the second side during docking; a shock absorption assembly comprising a shock absorber or a spring; and a second pivot assembly connecting the mounting portion and the arm portion; wherein at least one of the arm portion and the bow retaining portion is movable relative to the second mounting portion about the second pivot assembly, the front docking assist assembly having a relaxed position, the shock absorption assembly resisting movement of the at least one of the arm portion and the bow retaining portion relative to the second mounting portion about the second pivot assembly so as to at least partially absorb a docking impact force of the boat and applying force to move the at least one of the arm portion and the bow retaining portion towards the relaxed position about the second pivot assembly after at least partially absorbing the docking impact force of the boat. In one aspect, the first side and the second side of the bow retaining portion are resilient and moveable at least one inch in response to an impact force of 100 pounds.

In one aspect, a rear docking assist assembly is disclosed. The rear docking assist assembly may include: a mounting portion configured to be supported by an upper surface of a dock; a line comprising a first line end and a second line end, the first line end coupled to the mounting portion; and an arm comprising a first arm end and a second arm end, the first arm end rotationally coupled to the mounting portion, the second arm end configured to support the line; wherein the arm configured to move between a retracted configuration where the second arm end is positioned over the mounting portion and an extended configuration where the second arm end and a portion of the line are positioned over water adjacent to the dock.

In one aspect, the rear docking assist assembly may further include: a pivot assembly, the pivot assembly coupled to the second mounting portion and the first arm end, the pivot assembly configured to allow the arm to rotate relative to the second mounting portion. In one aspect, the hook is configured to engage the post to secure a rear end of the boat to the dock. In one aspect, the pivot assembly includes a motor, the motor configured to move the arm between the retracted configuration and the extended configuration. In one aspect, the boat portion further comprising a sensor system, the sensor system configured to move the arm from the retracted configuration to the extended configuration when the boat is in close proximity to the dock portion.

In one aspect, a docking system is disclosed. The docking system may include a rear docking assist assembly and a front docking assist assembly. The front docking assist assembly may include: a third mounting portion configured to be supported by the upper surface of the dock; an arm portion extending transverse to the second mounting portion; a bow retaining portion including a first side and a second side, the first side defining a first surface facing at least partially toward the second side and a second side defining a second surface at least partially facing toward the first side, said first side and said second side configured to releasably engage and receive a bow of the boat at least partially between the first side and the second side during docking; a shock absorption assembly comprising a shock absorber or a spring; and a second pivot assembly connecting the third mounting portion and the arm portion; wherein at least one of the arm portion and the bow retaining portion is movable relative to the second mounting portion about the second pivot assembly, the front docking assist assembly having a relaxed position, the shock absorption assembly resisting movement of the at least one of the arm portion and the bow retaining portion relative to the second mounting portion about the second pivot assembly so as to at least partially absorb a docking impact force of the boat and applying force to move the at least one of the arm portion and the bow retaining portion towards the relaxed position about the second pivot assembly after at least partially absorbing the docking impact force of the boat.

In one aspect, the first side and the second side of the bow retaining portion are resilient and moveable at least one inch in response to an impact force of 100 pounds. In one aspect, the front docking assist assembly can further include a connection system, the connection system extending from the bow retaining portion between the first side and the second side, the connection system comprising one or more connectors, each of the one or more connectors configured to releasably couple to boat anchor brackets of the boat. In one aspect, the one or more connectors comprise clips configured to move between an open configuration and a closed configuration, wherein the boat is secured to the front docking assist assembly when the boat anchor brackets are engaged with the one or more connectors in the closed configuration. In one aspect, the docking system may further include a control system, the control system configured to move the one or more connectors between the open and closed configurations. In one aspect, the front docking assist assembly further comprises a sensor system, the sensor system configured to move the one or more connectors from the open configuration to the closed configuration when the boat anchor brackets engage the one or more connectors.

In one aspect, a docking system is disclosed. The docking system may include a front assembly and a rear assembly. The front assembly can be configured to engage a bow of a boat and at least partially absorb a docking impact force of the boat, the front assembly can include: a first mounting portion configured to be supported by an upper surface of a dock; a first arm supported by the first mounting portion, the first arm extending transverse to the first mounting portion; and a bow retaining portion supported by the first arm; and a rear assembly configured to engage the boat. The rear assembly can include: a second mounting portion configured to be supported by the upper surface of the dock; a line coupled to the second mounting portion; and a second arm configured to position the line over the boat such that the line engages a portion of the boat.

In one aspect, the bow retaining portion includes a first side and a second side, the first side defining a first surface facing at least partially toward the second side and the second side defining a second surface at least partially facing toward the first side, the bow retaining portion configured to releasably engage and receive the bow of the boat at least partially between the first side and the second side during docking. In one aspect, the front assembly further includes a pivot assembly connecting the first mounting portion and the first arm, the first arm moveable relative to the first mounting portion above the pivot assembly. In one aspect, the front assembly further includes a shock absorption assembly, the shock absorption assembly resisting movement of the first arm relative to the first mounting portion about the pivot assembly so as to at least partially absorb the docking impact force of the boat. In one aspect, the front assembly further includes a connection system, the connection system extending from the bow retaining portion between the first side and the second side, the connection system including one or more connectors, each of the one or more connectors configured to releasably couple to boat anchor brackets of the boat. In one aspect, the one or more connectors include clips configured to move between an open configuration and a closed configuration, wherein the boat is secured to the front assembly when the boat anchor brackets are engaged with the one or more connectors in the closed configuration. In one aspect, the docking system further includes a control system, the control system configured to move the one or more connectors between the open configuration and the closed configuration. In one aspect, the docking system further includes a sensor system, the sensor system configured to move the one or more connectors from the open configuration to the closed configuration when the boat anchor brackets engage the one or more connectors. In one aspect, the second arm is rotationally coupled to the second mounting portion via a first end, the second arm configured to move between a retracted configuration and an extended configuration, wherein in the extended configuration, a second end of the second arm is positioned over the second mounting portion, and in the retracted configuration, the second end of the second arm is positioned over water adjacent to the dock. In one aspect, the rear assembly further includes a line brake coupled to at least one of the second mounting portion or the dock, the line brake moveable between an engaged configuration and a disengaged configuration, wherein the line passes through the line brake, wherein the line is fixed to the line brake when in the engaged configuration and movable relative to the line brake when in the disengaged configuration. In one aspect, the line brake includes a release, wherein engagement of the release moves the line brake from the engaged configuration to the disengaged configuration. In one aspect, the rear assembly further includes a second pivot assembly, the second pivot assembly coupled to the second mounting portion and the second arm, the second pivot assembly configured to allow the second arm to rotate relative to the second mounting portion. In one aspect, the rear assembly is configured to engage with an engagement portion coupled to the boat, wherein the line can extend around the engagement portion to secure the boat to the dock. In one aspect, the engagement portion extends at an angle relative to the second mounting portion. In one aspect, the second pivot assembly includes a motor, the motor configured to move the second arm between the retracted configuration and the extended configuration. In one aspect, the docking system further includes a sensor system, the sensor system configured to move the second arm from the retracted configuration to the extended configuration when the boat is in close proximity to the docking system. In one aspect, the line comprises a rope, a cord, or a cable.

In one aspect, a docking system is disclosed. The docking system may include a front assembly and a post. The front assembly may be configured to engage a bow of a boat and at least partially absorb a docking impact force of the boat. The front assembly can include a first mounting portion configured to be supported by an upper surface of a dock; a first arm supported by the first mounting portion, the first arm extending transverse to the first mounting portion; and a bow retaining portion supported by the first arm. The post can be coupled to at least one of the first mounting portion, a second mounting portion, or the dock, the post extending away from the upper surface of the dock.

In one aspect, the bow retaining portion includes a first side and a second side, the first side defining a first surface facing at least partially toward the second side and the second side defining a second surface at least partially facing toward the first side, the bow retaining portion configured to releasably engage and receive the bow of the boat at least partially between the first side and the second side during docking. In one aspect, the front assembly further includes a pivot assembly connecting the first mounting portion and the first arm, the first arm moveable relative to the first mounting portion above the pivot assembly. In one aspect, the front assembly further includes a shock absorption assembly, the shock absorption assembly resisting movement of the first arm relative to the first mounting portion about the pivot assembly so as to at least partially absorb the docking impact force of the boat. In one aspect, the front assembly further includes a connection system, the connection system extending from the bow retaining portion between the first side and the second side, the connection system including one or more connectors, each of the one or more connectors configured to releasably couple to boat anchor brackets of the boat. In one aspect, the one or more connectors include clips configured to move between an open configuration and a closed configuration, wherein the boat is secured to the front assembly when the boat anchor brackets are engaged with the one or more connectors in the closed configuration. In one aspect, the docking system further includes a control system, the control system configured to move the one or more connectors between the open configuration and the closed configuration. In one aspect, the docking system further includes a sensor system, the sensor system configured to move the one or more connectors from the open configuration to the closed configuration when the boat anchor brackets engage the one or more connectors. In one aspect, docking system further includes a boat assembly. The boat assembly can include a third mounting portion configured to be supported by an upper surface of the boat; and a second arm rotationally coupled to the third mounting portion via a first end, the second arm including a hook at a second end of the second arm, the second arm configured to move between a retracted configuration where the hook is positioned over the third mounting portion and an extended configuration where the hook extends substantially perpendicularly to the third mounting portion. In one aspect, the boat assembly further includes a second pivot assembly, the second pivot assembly coupled to the third mounting portion and the second arm, the second pivot assembly configured to allow the second arm to rotate relative to the third mounting portion. In one aspect, the second pivot assembly includes a motor, the motor configured to move the second arm between the retracted configuration and the extended configuration. In one aspect, the hook is configured to engage the post to secure a rear end of the boat to the dock. In one aspect, docking system further includes a sensor system, the sensor system configured to move the second arm from the retracted configuration to the extended configuration when the boat is in close proximity or engages the front assembly.

BRIEF DESCRIPTION OF THE DRAWINGS

The foregoing aspects and many of the attendant advantages of this disclosure will become more readily appreciated as the same become better understood by reference to the following detailed description, when taken in conjunction with the accompanying drawings. The accompanying drawings, which are incorporated in, and constitute a part of, this specification, illustrate embodiments of the disclosure.

Throughout the drawings, reference numbers are re-used to indicate correspondence between referenced elements. The drawings are provided to illustrate embodiments of the subject matter described herein and not to limit the scope thereof. Specific embodiments will be described with reference to the following drawings.

DETAILED DESCRIPTION

Figure 1A:
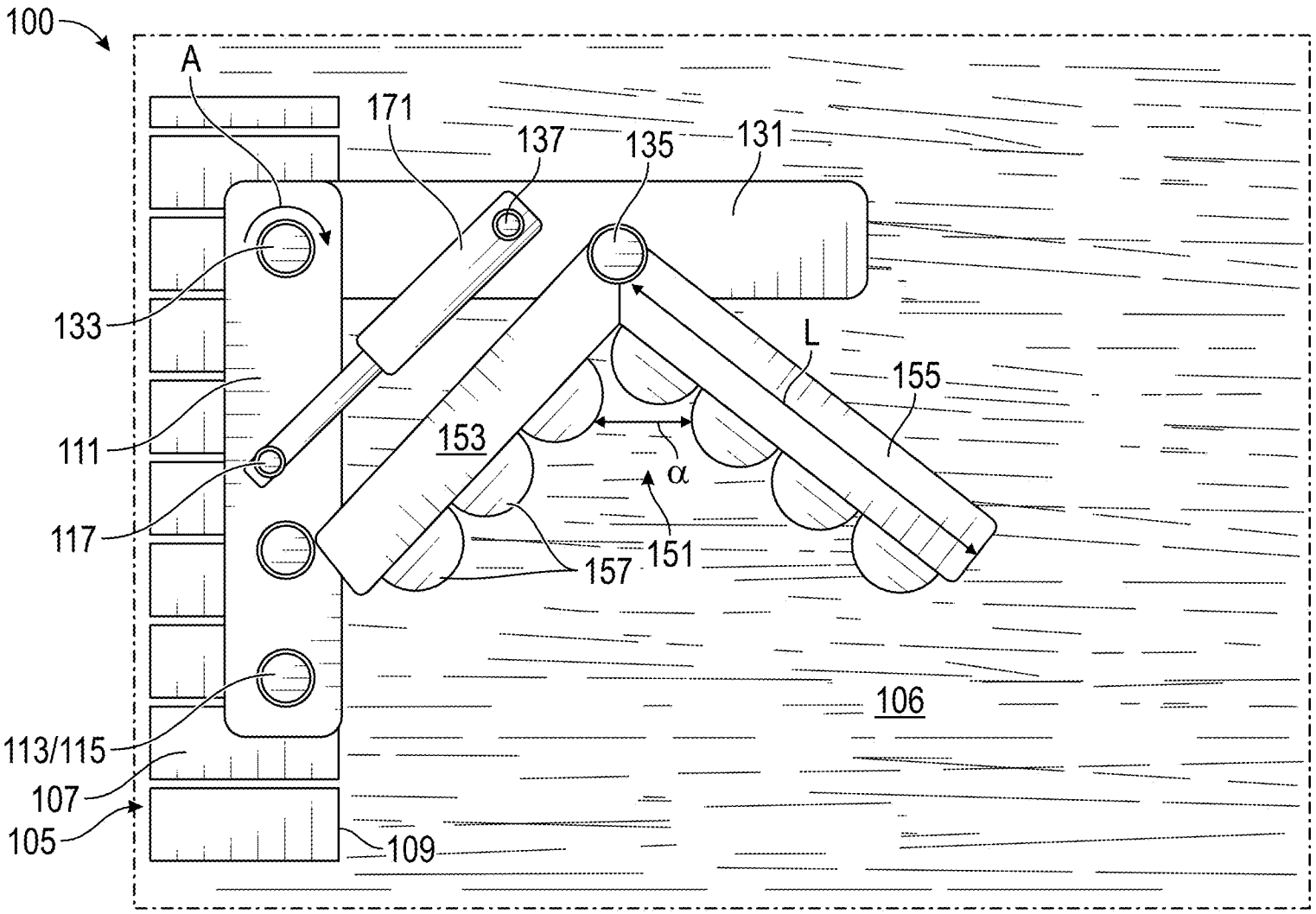
FIG. 1A is a diagram illustrating an embodiment of a L-shaped docking assist assembly.

Embodiments of the disclosure will now be described with reference to the accompanying figures. The terminology used in the description presented herein is not intended to be interpreted in any limited or restrictive manner, simply because it is being utilized in conjunction with a detailed description of embodiments of the disclosure. Furthermore, embodiments of the disclosure may include several novel features, no single one of which is solely responsible for its desirable attributes, or which is essential to practicing the embodiments of the disclosure herein described. For purposes of this disclosure, certain aspects, advantages, and novel features of various embodiments are described herein. It is to be understood that not necessarily all such advantages may be achieved in accordance with any particular embodiment. Thus, for example, those skilled in the art will recognize that one embodiment may be carried out in a manner that achieves one advantage or group of advantages as taught herein without necessarily achieving other advantages as may be taught or suggested herein.

Parking a boat at a dock is a difficult and often dangerous endeavor. A boat operator must approach the dock at the correct angle and speed, as well as maintain the boat's position alongside the dock until the boat can be properly secured. There are also further challenges in rough weather conditions such as high wind speeds. Because of the instability of the boat in the water, there is also a risk of injury to anyone who comes between or puts a limb between the dock and the boat. Parking a boat is made even more difficult when the boat operator is the sole occupant in the boat. To park the boat as the sole occupant, the boat operator must cruise alongside the dock, maintain the position of the boat, and manage to secure the boat to the dock without hitting the dock and causing damage to the boat. This is often difficult to achieve and results in some damage to the boat, dock, or both. Often a person may choose not to go out on the boat as the sole occupant solely because of the difficulty in parking the boat on the return to the dock.

In some embodiments, a docking assist assembly can enable a boat operator to park a boat alongside a dock without causing damage to the boat, the dock, or the boat operator. The docking assist assembly is fixed to a dock and includes an arm portion and bow retaining portion that may be suspended above the water. As a boat operator approaches the docking assist assembly, the operator maneuvers the bow of the boat into the bow retaining portion. The bow retaining portion cushions the impact of the boat on the docking assist assembly and slows and stops the forward motion of the boat without causing damage to the boat. The boat operator can then tie off the stern of the boat and complete the docking process.

It should be noted that the disclosed embodiments of a docking assist assembly may be combined with any embodiments disclosed herein, and individual features of the docking assist assembly may be combined with individual features of any other embodiment. Any other embodiments may also be combined with the disclosed docking assist assembly, and individual features of any embodiment may be combined with individual features of the disclosed docking assist assembly.

Dock, as the term is used herein, is a broad term that can include, but is not limited to, floating dock, fixed dock, float, jetty, landing, levee, pier, quay, wharf, and/or the like. Boat, as the term is used herein, is a broad term that can include, but is not limited to, fishing boat, dinghy boat, deck boat, bowrider boat, cuddy cabin boat, center console boat, houseboat, trawler boat, surf boat, wake boat, speedboat, airboat, inflatable boat, water scooter, and personal watercraft.

Figure 12:
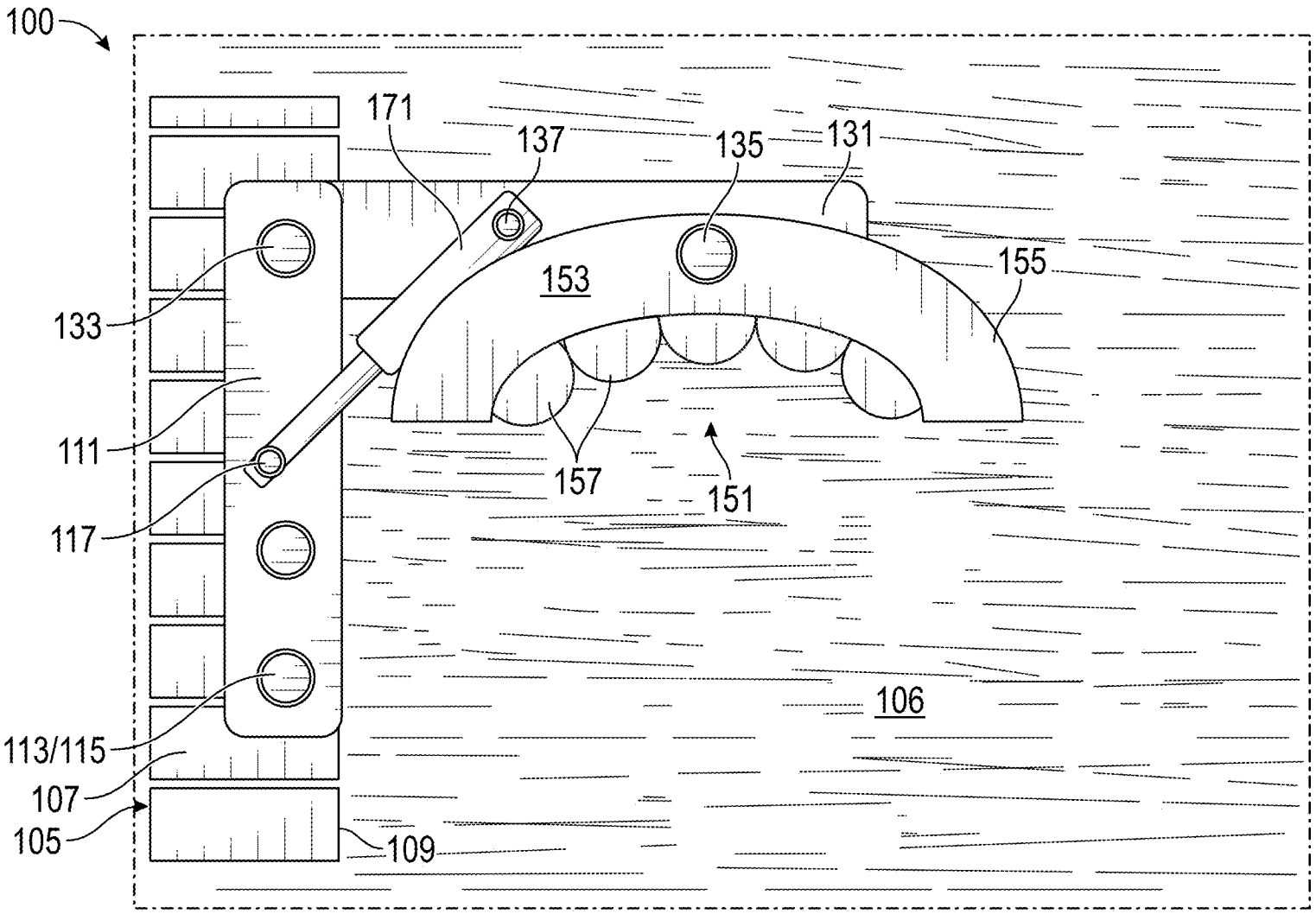
FIG. 12 is a diagram illustrating an embodiment of a docking assist assembly with a single arm bow retaining portion.

FIG. 1A illustrates an embodiment of a docking assist assembly 100 (also referred to herein as a "front docking assist assembly") mounted on a dock 105. The docking assist assembly 100 includes a dock mounting portion 111, an arm portion 131, a bow retaining portion 151, and a shock absorption assembly 171. As discussed below, in some embodiments, there is no separate shock absorption assembly, but rather one or a combination of elements of the docking assist assembly permit the bow retaining portion 151 and/or the arm portion 131 to move relative the mounting portion 111. The dock mounting portion 111 may comprise an elongate rectangular plate defining a plane with an upper side 112 and a bottom side 114 (e.g., see FIG. 9), such as a planar surface which is positioned against the upper surface 107 of the dock 105. The dock mounting portion 111 may include mount holes 113 extending through the dock mounting portion 111 and a plurality of dock fasteners 115 extending through the dock mounting portion 111 and into the dock 105 to secure the dock mounting portion 111 in place. The absorber dock mount 117 is located on the dock mounting portion 111 and is used to secure one end of the shock absorption assembly 171 to the dock mounting portion 111. The arm portion 131 may include an arm mount 133 located at one end of the arm portion 131 to attach the arm portion 131 to the dock mounting portion 111, a bow arm portion mount 135 located near the middle of the arm portion 131 to attach the bow retaining portion 151 to the arm portion 131, and an absorber arm mount 137, located on the arm portion 131 to secure one end of the shock absorption assembly 171 to the arm portion 131. It will be appreciated that the bow arm portion mount 135 could be integrally formed with the bow arm portion 131 and/or the bow retaining portion 151. The bow retaining portion 151 may include a first bow arm section 153 and a second bow arm section 155. Either or both of the first bow arm section 153 and the second bow arm section 155 may include a resilient inner portion, such as a bumper portion 157. In one aspect, the first bow arm section 153 and the second bow arm section 155 may comprise a single integral piece, as illustrated in FIG. 12.

In docking assist assembly 100, the dock mounting portion 111 may be fixed to a dock 105 at mount holes 113 by dock fasteners 115 such that one side of the dock mounting portion 111 lies roughly flat on the upper surface of a dock. In the aspect illustrated, the arm portion 131 is mechanically coupled at one end to the dock mounting portion 111 at arm mount 133 such that the arm portion 131 is rotationally moveable relative to the dock mounting portion 111. In one aspect, including the illustrated embodiment, the arm portion 131 may be rotationally movable relative to the dock mounting portion 111 about axis of rotation A. In this position, the arm portion 131 and the dock mounting portion 111 make a L-shape. In one aspect, the arm mount 133 may comprise a pivot assembly, such as shaft and a bearing assembly, to allow the arm portion 131 to rotate about axis of rotation A but limit the movement of the arm portion 131 in a direction extending vertically from the dock 105. The shock absorption assembly 171 is fixed at one end to the dock mounting portion 111 at dock absorber mount 117 and fixed at another opposite end to the arm portion 131 at absorber arm mount 137. In one aspect, absorber dock mount 117 and/or absorber arm mount 137 may be a pivot assembly, such as a shaft and bearing assembly, which may allow the shock absorption assembly 171 to rotate about its fixed points. In another aspect, the dock absorber mount 117 and/or absorber arm mount 137 may comprise a bolt which extends through an opening at one end of the shock absorption assembly 171 and into an opening in the dock mounting portion 111 and through an opening at the opposite end of the shock absorption assembly 171 and into an opening in the arm portion 131, which permits the shock absorption assembly 171 to be secured to the dock mounting portion 111 and/or the arm portion 131. In another aspect, the bolt may extend through the dock mounting portion 111 and into the dock 105. The first bow arm section 153 and the second bow arm section 155 may be fixed at one end to the arm portion 131 at bow portion mount 135. In the aspect illustrated, first bow arm section 153 and second bow arm section 155 are fixed to the same bow portion mount 135. In another aspect, there may be more than one bow portion mounts 135, such that the first bow arm section 153 and the second bow arm portion 155 are fixed adjacent to each other on arm portion 131. In the aspect illustrated, the first bow arm section 153 and the second bow arm section 155 are mechanically coupled at one end to the arm portion 131 at bow portion mount 135 such that the bow retaining portion 151 is rotationally moveable relative to the arm portion 131. In one aspect, including the illustrated embodiment, the bow retaining portion 151 may be rotationally movable relative to the arm portion 131 about axis of rotation B (e.g., see FIG. 1C). In one aspect, the bow portion mount 135 may comprise a pivot assembly, such as a shaft and a bearing assembly, to allow the bow retaining portion 151 to rotate about axis of rotation B but limit the movement of the bow retaining portion 151 in a direction extending vertically from the dock 105. In another aspect, the bow portion mount 135 may comprise a bolt which extends through the bow arm sections 153 and 155 and into the arm portion 131 to secure the bow arm sections 153 and 155 to the arm portion 131. In another aspect, the arm portion 131 may further comprise a bow arm lock, such that rotation of first bow arm section 153 and second bow arm section 155 may be selectively prevented by engaging the bow arm lock. For example, when the bow arm lock is engaged, the first bow arm section 153 and second bow arm section 155 cannot move relative to their point of fixture on the arm portion 131. In another aspect, the first bow arm section 153 and the second bow arm section 155 are fixed with respect to one another. In another aspect, the first bow arm section 153 and the second bow arm section 155 define a V-shape with an angle $\alpha$ between them which faces away from the arm portion 131. Desirably the angle $\alpha$ is between 30 and 120 degrees, between 35 and 105 degrees and/or between 45 and 95 degrees. The bumper portion 157 may desirably be fixed to first bow arm section 153 and second bow arm section 155 on the inward facing side of each bow arm such that in operation, the bumper portion 157 on one arm face the bumper portion 157 on the other arm. In some embodiments, the resilient inner portion, such as a bumper portion 157, may be integrally formed with the bow arm sections 153 and 155. The length "L" of the bow arm sections 153 and 155 is measured from the center-point of the bow portion mount 135 to the tip of a bow arm section as shown on FIG. 1A. In one aspect, the first bow arm section 153 and the second bow arm section 155 are between 2 and 10 feet long, between 3 and 8 feet long or between 3 and 6 feet long. In one aspect, the first bow arm section 153 and the second bow arm section 155 are at least 2 feet long, at least 3 feet long, or at least 5 feet long. In one aspect, the first bow arm section 153 and the second bow arm section 155 are no more than 8 feet long, no more than 6 feet long, no more than 5 feet long or no more than 4 feet long. For purposes of this application, where the first bow arm section 153 and the second bow arm section 155 are a single integral piece, the length of the arm sections shall be considered from the center-point 135 of the contact between the arm portion 131 and the bow retaining portion 151.

Figure 1B:
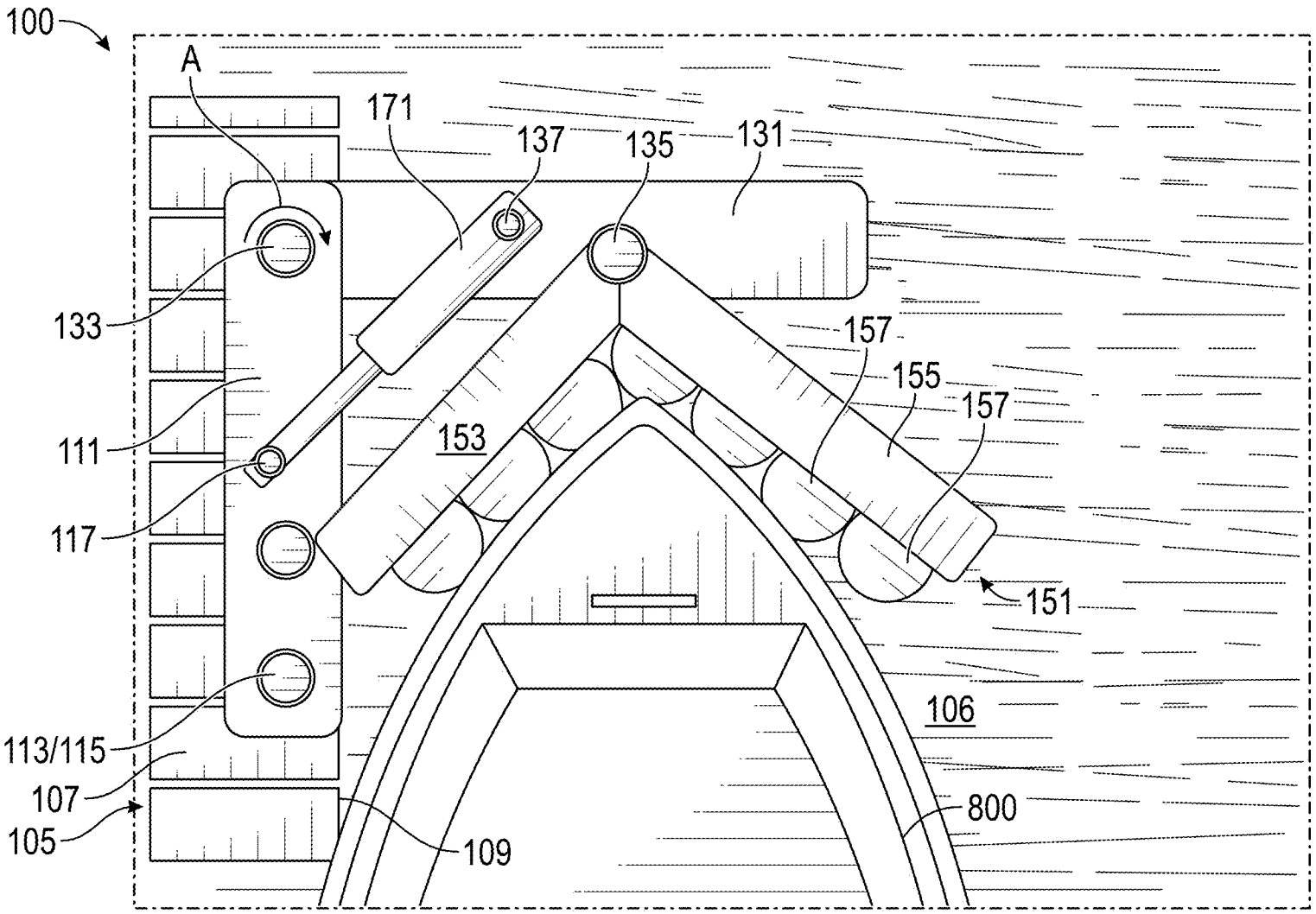
FIG. 1B is a diagram illustrating a boat's bow engaged with an embodiment of a docking assist assembly.
Figure 1C:
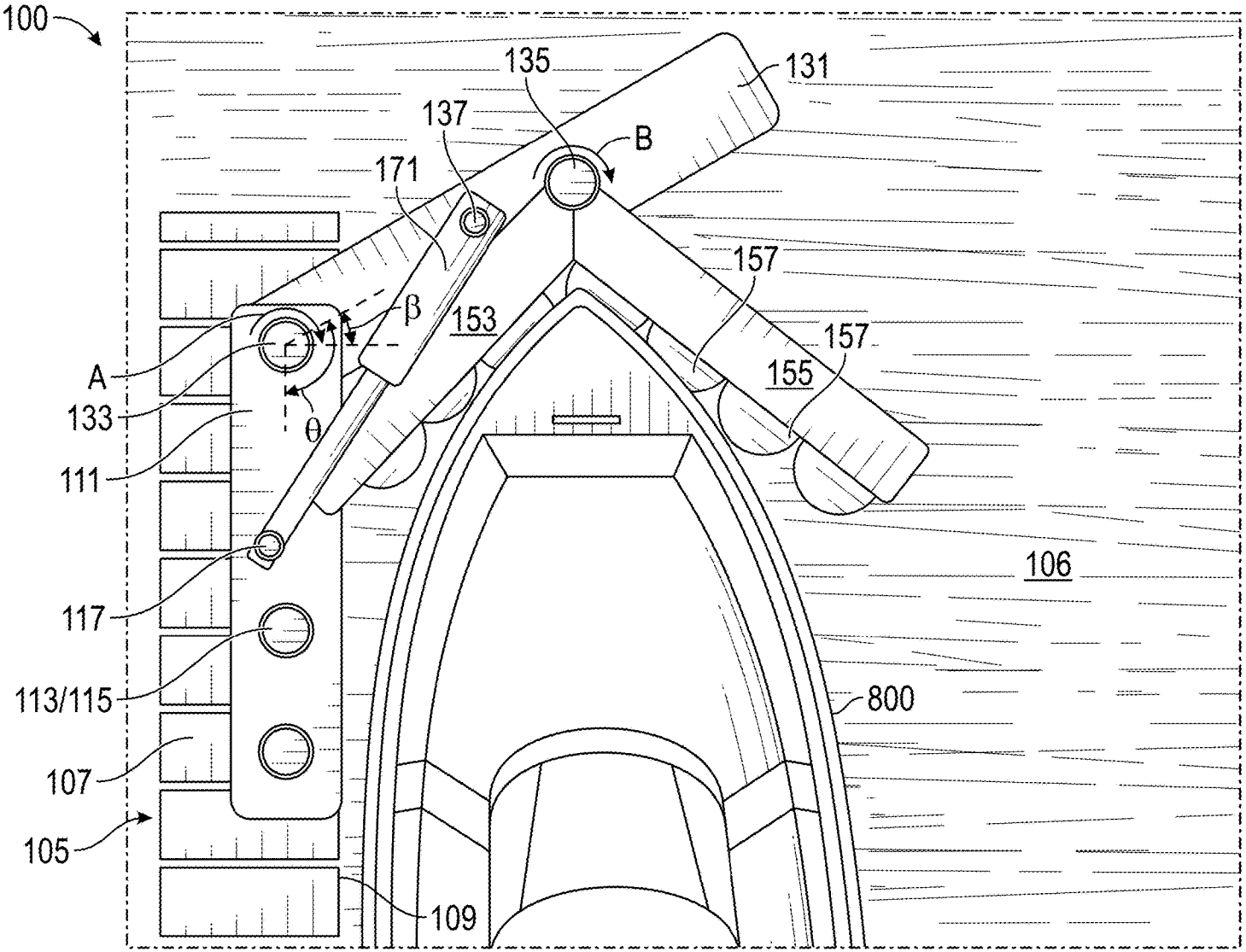
FIG. 1C is a diagram illustrating an embodiment of a docking assist assembly at maximum deflection.

Referring to FIG. 1A, in use, the dock mounting portion 111 of the docking assist assembly 100 may be fixed to a dock 105 which is positioned over and/or adjacent to a body of water 106 such that the docking portion 111 is near an elongate dock edge 109 that is adjacent to a pre-determined boat parking area of the body of water. The dock mounting portion 111 may run parallel to the edge 109 of the dock 105. In one aspect, the arm portion 131 may extend roughly perpendicular to the dock mounting portion 111 such that the arm portion 131 and the bow retaining portion 151 are suspended above the water. Suspension of arm portion 131 and bow retaining portion 151 above the water, may provide advantages such as allowing people to swim near the dock 105 without interference. An additional advantage may be that the docking assist assembly 100 can be used on either straight or L-shaped docks because only the mounting portion 111 needs to be fixed to the dock. First bow arm section 153 and second bow arm section 155 create a triangular shape or a V-shape that corresponds to the bow shape of a particular boat. The width of the bow retaining portion 151 measured by the tip of first bow arm section 153 from the tip of second bow arm section 155 is desirably somewhat larger than the front portion of a boat's bow, which may enable a boat to be guided into the docking assist assembly 100 by first bow arm section 153 and second bow arm section 155. In one aspect, when the first bow arm section 153 and second bow arm section 155 are moveable relative to each other, such that the docking assist assembly 100 may be used for many different types of watercraft with many different shaped bows. In this orientation, the bumper portion 157 on the first bow arm section 153 face the bumper portion 157 on second bow arm section 155. When a boat operator approaches the dock 105 to park the boat, the boat operator may drive the boat at a low speed or coast into the bow retaining portion 151 such that the bow of the boat engages the bumper portion 157 of the first bow arm section 153 on one side of the boat's bow (such as the port side of the bow) and the bow of the boat engages the bumper portion 157 of the second bow arm section 155 on the other side of the boat's bow (such as the starboard side of the bow), as shown in FIG. 1B. The bumper portion 157 absorb some of the incoming force of the boat and provide a soft impact area so as to not damage the bow of the boat. As the boat engages the bow retaining portion 151, a force is transmitted to the arm portion 131 causing rotation of the arm portion 131 about axis of rotation A. As the arm portion 131 rotates about axis of rotation A, the bow retaining portion 151 may rotate about axis of rotation B such that the boat 800 remains roughly perpendicular to the dock edge 109 as the arm portion 131 continues to rotate. Further rotation of arm portion 131 engages the shock absorption assembly 171 which limits further rotation of the arm portion 131 and absorbs the force of the incoming boat, stopping the boat. FIG. 1C illustrates an embodiment of the docking assist assembly 100 where the arm portion 131 is at a maximum rotational state after engaging the bow of a boat 800. It is recognized that the angle illustrated in FIG. 1C is for illustrative purposes only, and the maximum rotational state may vary depending on the embodiment implemented. The original or relaxed position of the arm portion 131 and the maximum position of rotation of the arm portion 131, define an angle β therebetween which faces the bow retaining portion 151. The dock edge 109 and the arm portion 131 define an angle θ which faces the bow retaining portion 151. In the illustrated embodiment, the angle θ is 90 degrees greater than the angle β. In some embodiments, the shock absorption assembly 171 prevents rotation of the arm portion 131 relative to its relaxed position by an angle β greater than 45 degrees, greater than 30 degrees, greater than 25 degrees, greater than 20 degrees, greater than 15 degrees or greater than 10 degrees. In some embodiments, the shock absorption assembly 171 prevents rotation of the arm portion relative to the mounting portion by an angle θ greater than 135 degrees, greater than 120 degrees, greater than 115 degrees, greater than 110 degrees, greater than 105 degrees or greater than 100 degrees. In some embodiments, the shock absorption assembly 171 permits rotation of the arm portion 131 relative to its relaxed position by an angle β of at least 10 degrees, at least 15 degrees, at least 20 degrees, at least 25 degrees, at least 30 degrees or at least 45 degrees. In some embodiments, the shock absorption assembly 171 permits rotation of the arm portion 131 relative to the mounting portion 111 to an angle θ of at least 100 degrees, at least 105 degrees, at least 110 degrees, at least 115 degrees, at least 120 degrees or at least 135 degrees. In some embodiments, the shock absorption assembly 171 permits rotation of the arm portion 131 relative to its relaxed position by angle β between 10 and 45 degrees, between 10 and 30 degrees, between 10 and 25 degrees, between 10 and 20 degrees, between 10 and 15 degrees. In some embodiments, the shock absorption assembly 171 permits rotation of the arm portion 131 relative to the mounting portion 111 to an angle θ between 100 and 135 degrees, between 100 and 120 degrees, between 100 and 115 degrees, between 100 and 110 degrees, between 100 and 105 degrees. In some embodiments, the shock absorption assembly 171 permits rotation of the arm portion 131 relative to its relaxed position by angle β between 15 and 45 degrees, between 15 and 30 degrees, between 15 and 25 degrees or between 15 and 20 degrees. In some embodiments, the shock absorption assembly 171 permits rotation of the arm portion 131 relative to the mounting portion 111 to an angle θ between 105 and 135 degrees, between 105 and 120 degrees, between 105 and 115 degrees or between 105 and 110 degrees. With a portion of the bow of the boat engaged within the bow retaining portion 151, the boat operator may then tie off the boat, such as tying the stern of the boat to the dock 105 by using a stern line.

In one aspect, the docking assist assembly 100 may be removable from the dock 105 once fixed, which may have the advantage of allowing the docking assist assembly 100 to be stored when not in use, such as, during the winter months in colder climates. To facilitate such removal, the docking assist assembly may desirably weigh less than 500 pounds, 400 pounds, 300 pounds, 200 pounds, 150 pounds, 125 pounds, 100 pounds, 75 pounds or 50 pounds.

Figure 2:
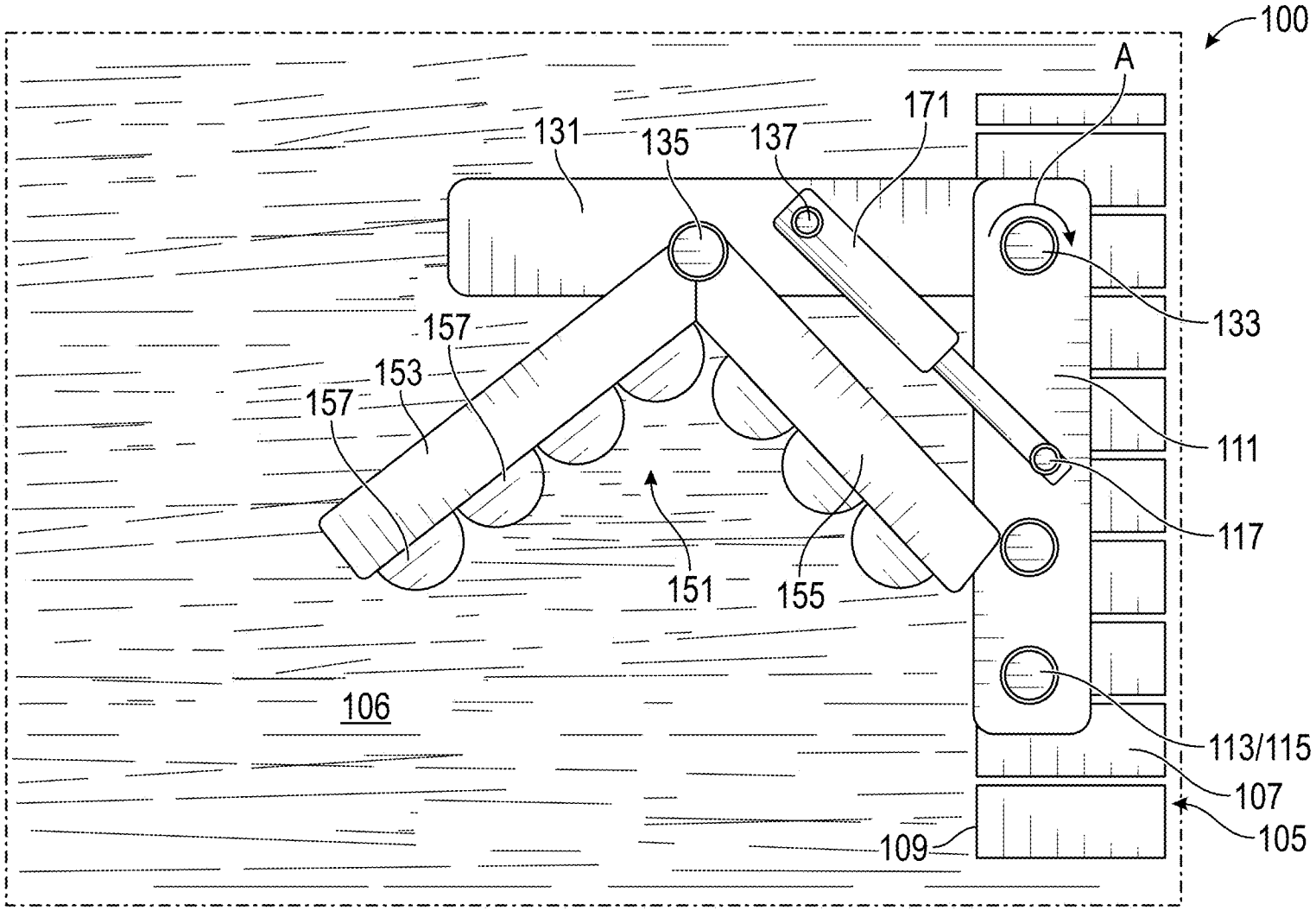
FIG. 2 is a diagram illustrating an embodiment of a docking assist assembly in a reversed orientation.

In one aspect, the docking assist assembly 100 may be reversible, as shown in FIG. 2, such that it may be used on either side of the dock 105. For example, when the docking assist assembly 100 is installed on one side of the dock 105, the right or starboard side of a boat would be closest to the dock 105, and when the docking assist assembly 100 is installed on the other side of the dock 105, as in FIG. 1A, the port side of a boat would be closets to the dock 105. The docking assist assembly 100 may be reversible by, for example, the mounting portion 111 being reversible such that the mounting portion 111 may be fixed to the dock 105 with either side facing the upper side 107 of the dock 105. In another aspect, the docking assist assembly 100 may be reversible by, for example, the bow retaining portion 151 being able to be fixed to the arm portion 131 with the bow retaining portion 151 facing either direction. Being reversible may have the advantage of allowing the docking assist assembly 100 to be used on any dock no matter which side of the dock is adjacent to the water 106. An additional advantage may be that two docking assist assemblies 100 could be used on the same dock to allow one or more boats to be parked on each side of the dock 105.

In one aspect, the mounting portion 111 may be a metal plate. In some aspects, the mounting portion 111 may be made of a galvanized, anodized, and/or the like material to prevent water damage. In some aspects, the dock fasteners 115 may be, for example, screws, bolts, and/or the like such that the docking assist assembly 100 may be removed and reinstalled to the dock 105 repeatedly.

In one aspect, the shock absorption assembly 171 may be a shock absorber, such as an air spring with a damper. Use of a shock absorber may provide the advantage of damping the return rotational force of the arm portion 131 after a boat has engaged the bow retaining portion 151. In some aspects, the shock absorption assembly 171 may be a pneumatic or hydraulic shock absorber.

In one aspect, the bumper portion 157 may be designed to partially deform under pressure, which may provide the advantage of cushioning the force applied to the bow of the boat. In some aspects, bumper portion 157 may comprise plastic foams made of polyethylene, polypropylene, polyurethane, and/or the like. In another aspect, bumper portion 157 may be made of rubber or any other material that can partially deform under the force of an incoming boat and prevent damage to the boat. In one aspect, docking assist assembly 100 may be waterproof or water resistant to prevent damage or decay of any components.

Figure 3:
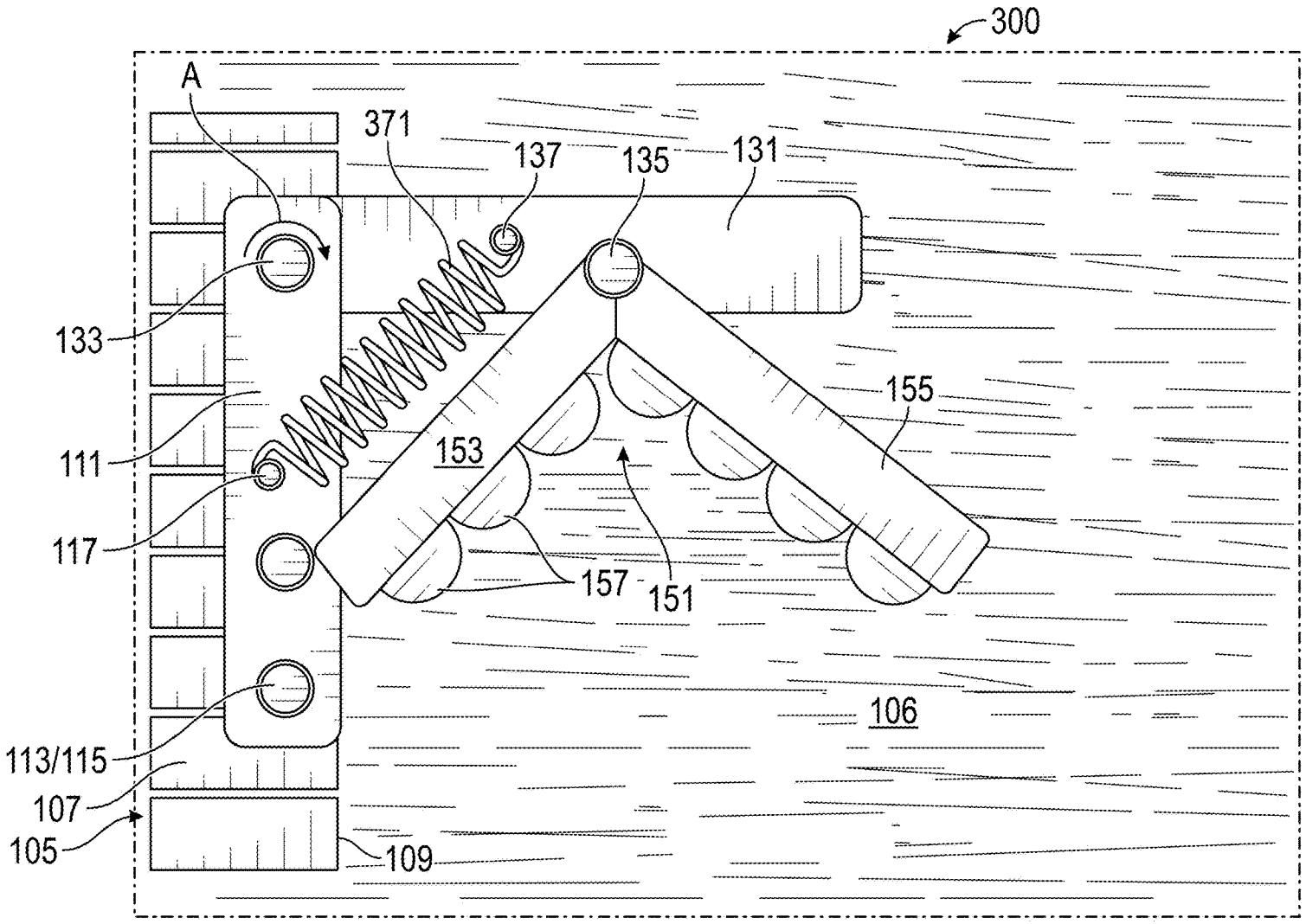
FIG. 3 is a diagram illustrating an embodiment of a docking assist assembly with a spring shock absorption assembly.

FIG. 3 illustrates another embodiment of a docking assist assembly 300 mounted on a dock 105. The docking assist assembly 300 includes a dock mounting portion 111, an arm portion 131, a bow retaining portion 151, and a shock absorption assembly 371. The docking assist assembly 300 contains the same elements and functions similarly to docking assist assembly 100, with the exception that the shock absorption assembly 371 comprises a spring.

Figure 4:
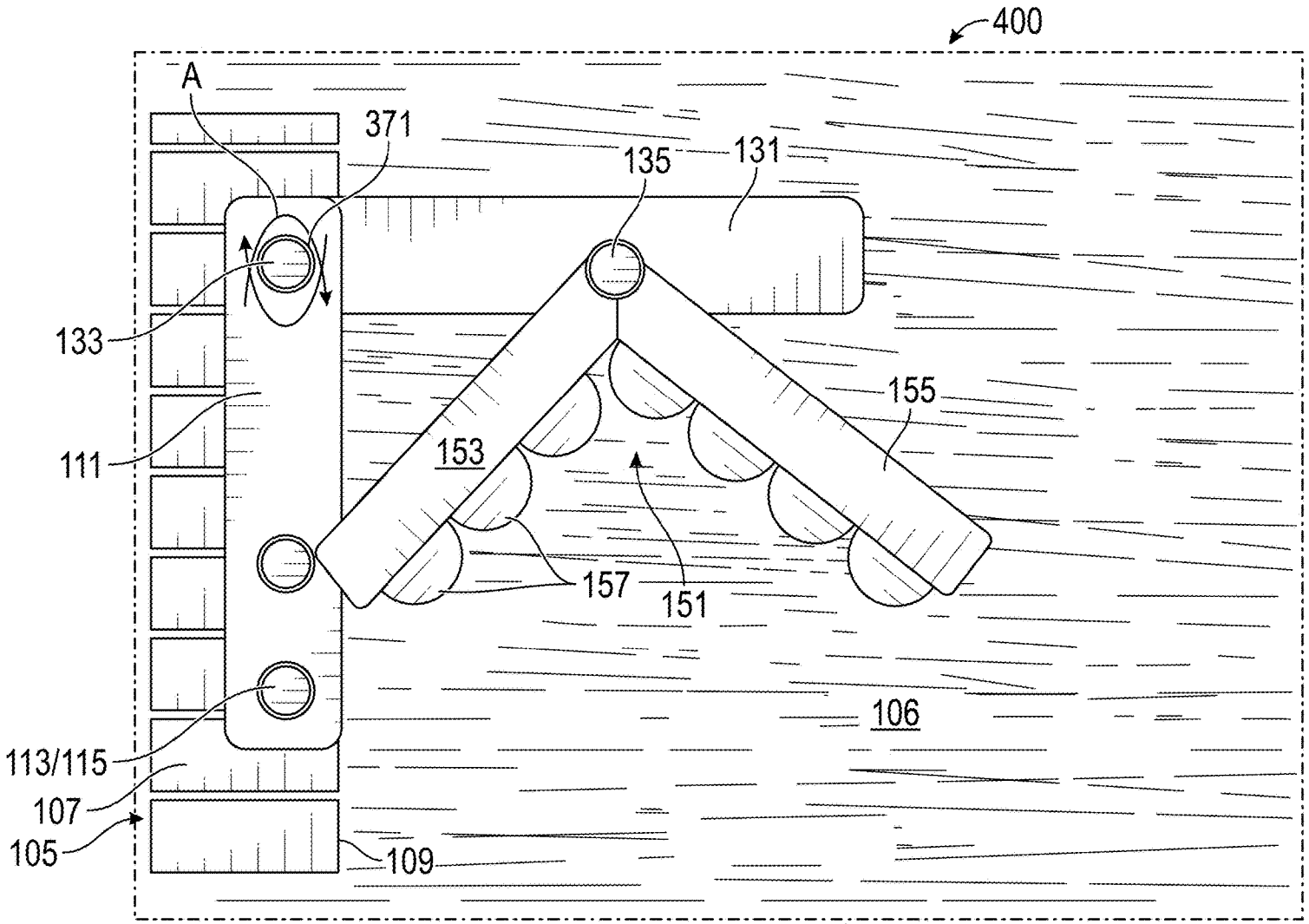
FIG. 4 is a diagram illustrating an embodiment of a docking assist assembly with a built-in vertical spring shock absorption assembly.

FIG. 4 illustrates another embodiment of a docking assist assembly 400 mounted on a dock 105. The docking assist assembly 400 includes a dock mounting portion 111, an arm portion 131, a bow retaining portion 151, and a shock absorption assembly 471. The docking assist assembly 400 contains most of the elements of and functions similarly to docking assist assembly 100, with the exception that the shock absorption assembly 471 comprises a spring assembly and/or damper assembly that may be built into the dock mounting portion 111 and coupled to arm portion 131 at one end such that rotation of the arm portion 131 about an axis of rotation A desirably causes the shock absorption assembly 471 to exert an opposing force movement from the relaxed position (e.g., as illustrated in FIG. 4) and a return force causing movement towards the relaxed position.

Referring to FIG. 4, in use, as the boat engages the bow retaining portion 151, a force is transmitted to the arm portion 131 causing rotation of the arm portion 131 about axis of rotation A. Rotation of arm portion 131 engages the shock absorption assembly 471 which limits further rotation of the arm portion 131 and absorbs the force of the incoming boat, stopping the boat.

Figure 5:
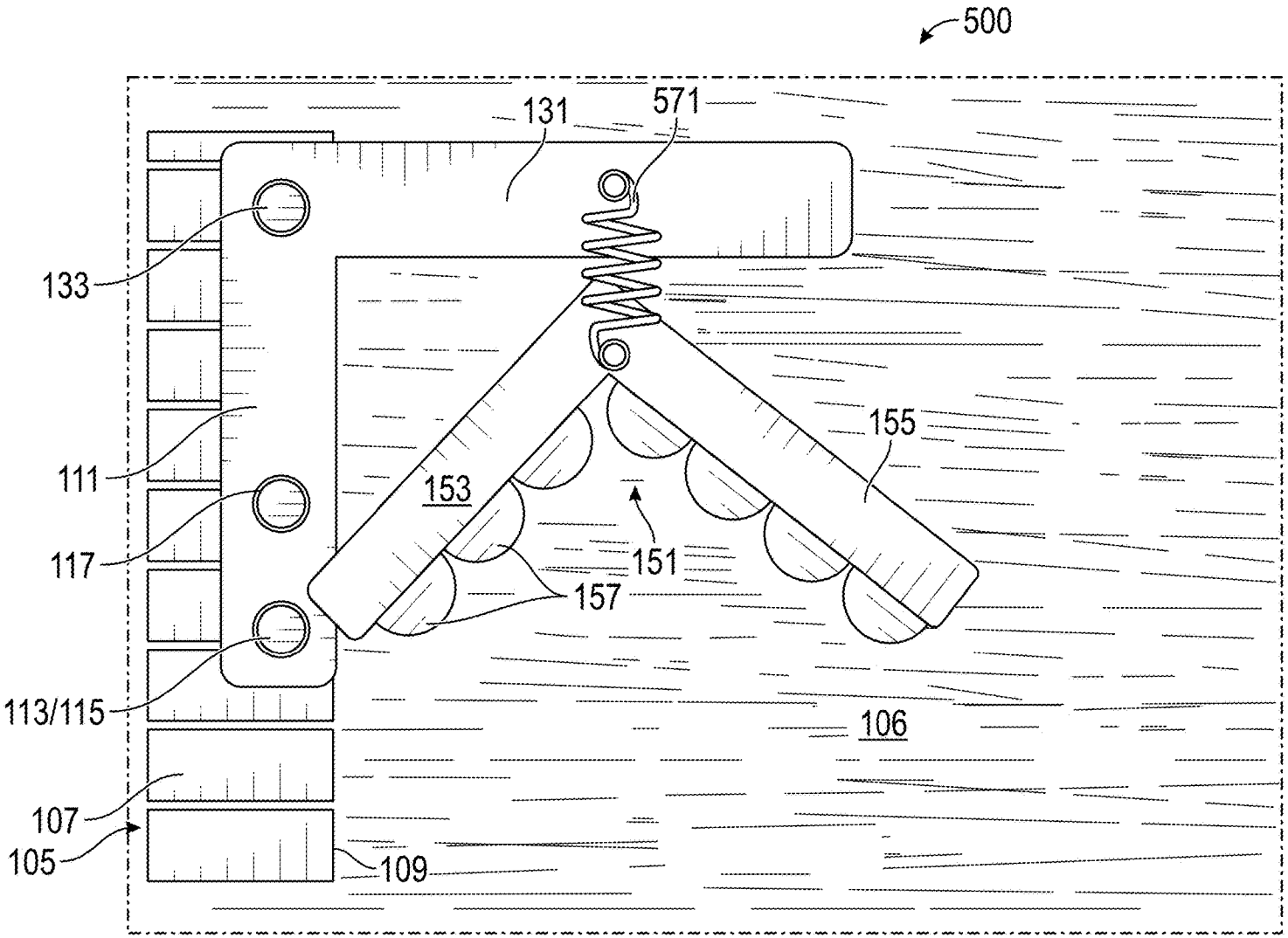
FIG. 5 is a diagram illustrating an embodiment of a docking assist assembly with a horizontal spring shock absorption assembly.

FIG. 5 illustrates an embodiment of a docking assist assembly 500 mounted on a dock 105. The docking assist assembly 500 includes a dock mounting portion 111, an arm portion 131, a bow retaining portion 151, and a shock absorption assembly 571. In one aspect, the arm portion 131 may include an arm mount 133 located at one end of the arm portion 131 to attach the arm portion 131 to the dock mounting portion 111 such that the arm portion 131 cannot rotate or rotates minimally relative to the arm mount 133. In this position, the arm portion 131 and the dock mounting portion 111 make a L-shape. In one aspect, the arm mount 133 may comprise a bolt extending through the arm portion 131 and into the dock mounting portion 111. In another aspect, the bolt may extend through the dock mounting portion 111 and into the dock 105. The bow retaining portion 151 may include a first bow arm section 153 and a second bow arm section 155. Either or both of the first bow arm section 153 and the second bow arm section 155 may include a resilient inner portion, such as a bumper portion 157. In one aspect, the first bow arm section 153 and the second bow arm section 155 may comprise a single integral piece. The shock absorption assembly 571 may comprise a spring and/or a damper. In one aspect, the shock absorption assembly 571 may include a damping assembly. The shock absorption assembly 571 is fixed at one end to the bow retaining portion 151 and fixed on another opposite end to the arm portion 131. In one aspect, the shock absorption assembly 571 may be fixed to the arm portion 131 and/or the bow retaining portion 151 by a bolt extending through the shock absorption assembly 571 and into the arm portion 131 and/or the bow retaining portion 151 at each end respectively. In another aspect, the shock absorption assembly 571 may be fixed to the arm portion 131 and/or the bow retaining portion 151 by welding. In one aspect, the first bow arm section 153 and the second bow arm section 155 may comprise a single integral piece. In another aspect, the shock absorption assembly 571 may be fixed to each the first bow arm section 153 the second bow arm section 155, such that both bow arm sections can rotate relative to the point of fixture, such as by a pivot assembly which, for example, comprises a shaft and a bearing. In another aspect, the shock absorption assembly 571 may further comprise a bow arm lock, such that rotation of first bow arm section 153 and second bow arm section 155 may be selectively prevented by engaging the bow arm lock. In another aspect, the first bow arm section 153 and the second bow arm section 155 are fixed with respect to one another. In another aspect, the first bow arm section 153 and the second bow arm section 155 define a V-shape with an angle $\alpha$ between them. Desirably the angle $\alpha$ is between 30 and 120 degrees, between 35 and 105 degrees and/or between 45 and 95 degrees. The bumper portion 157 may desirably be fixed to first bow arm section 153 and second bow arm section 155 on the inward facing side of each bow arm such that in operation, the bumper portion 157 on one arm face the bumper portion 157 on the other arm.

Referring to FIG. 5, in use, when a boat operator approaches the dock 105 to park the boat, the boat operator may drive the boat at a low speed or coast into the bow retaining portion 151 such that the bow of the boat engages the bumper portion 157 of the first bow arm section 153 on one side of the boat's bow (such as the port side of the bow) and the bow of the boat engages the bumper portion 157 of the second bow arm section 155 on the other side of the boat's bow (such as the starboard side of the bow). The bumper portion 157 absorb some of the incoming force of the boat and provide a soft impact area so as to not damage the bow of the boat. As the boat engages the bow retaining portion 151, the bow retaining portion 151 moves towards the arm portion 131 and a force is transmitted to the shock absorption assembly 571, such that the spring is compressed as the boat continues to move the bow retaining portion 151. As the spring in the shock absorption assembly 571 is further compressed, the force of the incoming boat is translated to the shock absorption assembly 571, stopping the boat. With a portion of the bow of the boat engaged within the bow retaining portion 151, the boat operator may then tie off the boat, such as tying the stern of the boat to the dock 105 by using a stern line.

Figure 6:
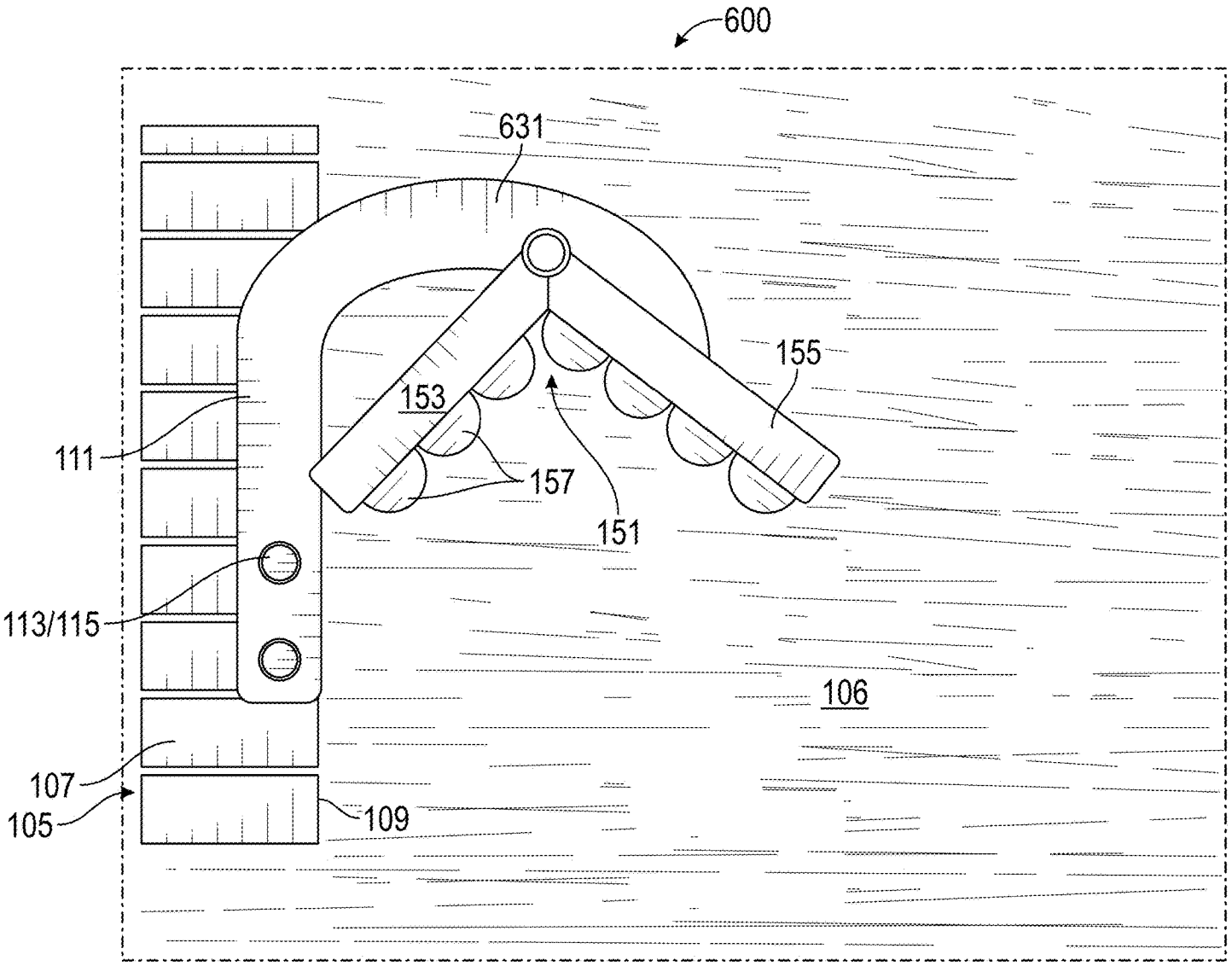
FIG. 6 is a diagram illustrating an embodiment of a docking assist assembly with a flexible arm portion.

FIG. 6 illustrates an embodiment of a docking assist assembly 600 mounted on a dock 105. The docking assist assembly 100 includes a dock mounting portion 111, an arm portion 631, and a bow retaining portion 151. The arm portion 631 is made of a resilient material such that the shape deforms in a non-plastic manner under an application of force. The arm portion 631 is connected to the dock mounting portion 111 at one end of the dock mounting portion 111. As illustrated, the arm portion 631 and the dock mounting portion 111 cooperate to make a J-shape. In one aspect, the arm portion 631 and the dock mounting portion 111 comprise two pieces, wherein the arm portion 631 may be removably fixed to the dock mounting portion 111 such as by a bolt extending through one end of the arm portion 631 and into the dock mounting portion 111. In another aspect the bolt extends into the dock 105. In another aspect, the arm portion 631 may be permanently fixed to the dock mounting portion 111, such as by welding. In another aspect, the dock mounting portion 111 and the arm portion 631 may form one integral piece. The first bow arm section 153 may be fixed at one end to the arm portion 631 and the second bow arm section 155 may be fixed at one end to the arm portion 631 such that both points of fixture are adjacent to each other on arm portion 631. In one aspect, the first bow arm section 153 and the second bow arm portion 155 may be fixed to the arm portion 631 by a bolt which extends through the bow arm portions 153 and 155 and into the arm portion 631 to secure the bow arm portions 153 and 155 to the arm portion 631. In another aspect, the first bow arm section 153 and the second bow arm section 155 are rotationally moveable relative to their points of fixtures on the arm portion 631 such as by a pivot assembly which, for example, comprises a shaft and a bearing. In another aspect, the arm portion 631 may further comprise a bow arm lock, such that rotation of first bow arm section 153 and second bow arm section 155 may be selectively prevented by engaging the bow arm lock. For example, when the bow arm lock is engaged, the first bow arm section 153 and second bow arm section 155 cannot move relative to their point of fixture on the arm portion 631. In another aspect, the first bow arm section 153 and the second bow arm section 155 are fixed with respect to one another. In another aspect, the first bow arm section 153 and the second bow arm section 155 define a V-shape with an angle $\alpha$ between them. Desirably the angle $\alpha$ is between 30 and 120 degrees, between 35 and 105 degrees and/or between 45 and 95 degrees.

Referring to FIG. 6, in use, the dock mounting portion 111 of the docking assist assembly 100 may be fixed to a dock 105 which is positioned over and/or adjacent to a body of water 106 such that the docking portion 111 is near an elongate dock edge 109 that is adjacent to a pre-determined boat parking area of the body of water. The dock mounting portion 111 runs parallel to the edge 109 of the dock 105. In one aspect, the arm portion 631 may extend transverse, such as roughly perpendicular to the dock mounting portion 111 such that the arm portion 631 and the bow retaining portion 151 are suspended above the water. First bow arm section 153 and second bow arm section 155 create a triangular shape or a V-shape that corresponds to the bow shape of a particular boat. In this orientation, the bumper portion 157 on the first bow arm section 153 face the bumper portion 157 on second bow arm section 155. When a boat operator approaches the dock 105 to park the boat, the boat operator may drive the boat at a low speed or coast into the bow retaining portion 151 such that the bow of the boat engages the bumper portion 157 of the first bow arm section 153 on one side of the boat's bow (such as the port side of the bow) and the bow of the boat engages the bumper portion 157 of the second bow arm section 155 on the other side of the boat's bow (such as the starboard side of the bow). The bumper portion 157 absorb some of the incoming force of the boat and provide a soft impact area so as to not damage to the bow of the boat. As the boat engages the bow retaining portion 151, a force is transmitted to the arm portion 631, causing the arm portion 631 to flex, bend, deform, and/or the like. As the boat continues to apply a force to the arm portion 631, the force causes elastic deformation of the arm portion 631 which absorbs the force of the incoming boat, stopping the boat. With a portion of the bow of the boat engaged within the bow retaining portion 151, the boat operator may then tie off the boat, such as tying the stern of the boat to the dock 105 by using a stern line.

Figure 7:
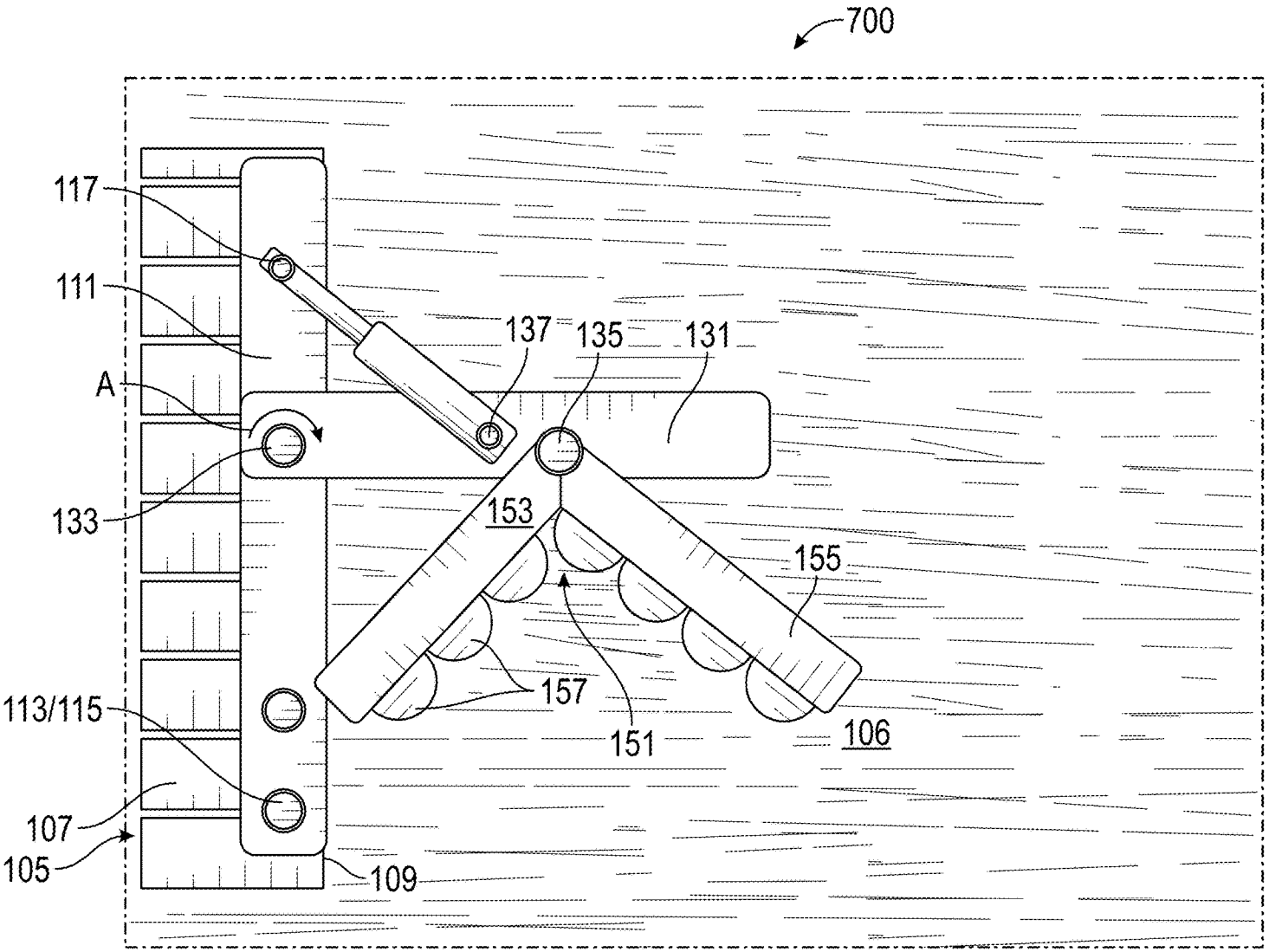
FIG. 7 is a diagram illustrating an embodiment of a T-shaped docking assist assembly.

FIG. 7 illustrates an embodiment of a docking assist assembly 700 mounted on a dock 105. In this embodiment, the docking assist assembly 700 is a T-shaped design. The docking assist assembly 700 includes a dock mounting portion 111, an arm portion 131, a bow retaining portion 151, and a shock absorption assembly 171. The docking assist assembly 700 contains the same elements and functions similarly to docking assist assembly 100, with the exceptions that the dock mounting portion 111 may extend further up the dock 105 such that a portion of the dock mounting portion 111 is above the arm portion 131. In one aspect, the dock mounting portion 111 may include additional mount holes 113 and dock fasteners 115. In one aspect, the absorber dock mount 117 is located further up the dock mounting portion 111. In this position, when a boat engages the dock bow retaining portion 151, the shock absorption assembly 171 compresses to absorb the force of the boat rather than extending in tension as in docking assist assembly 100.

Figure 8:
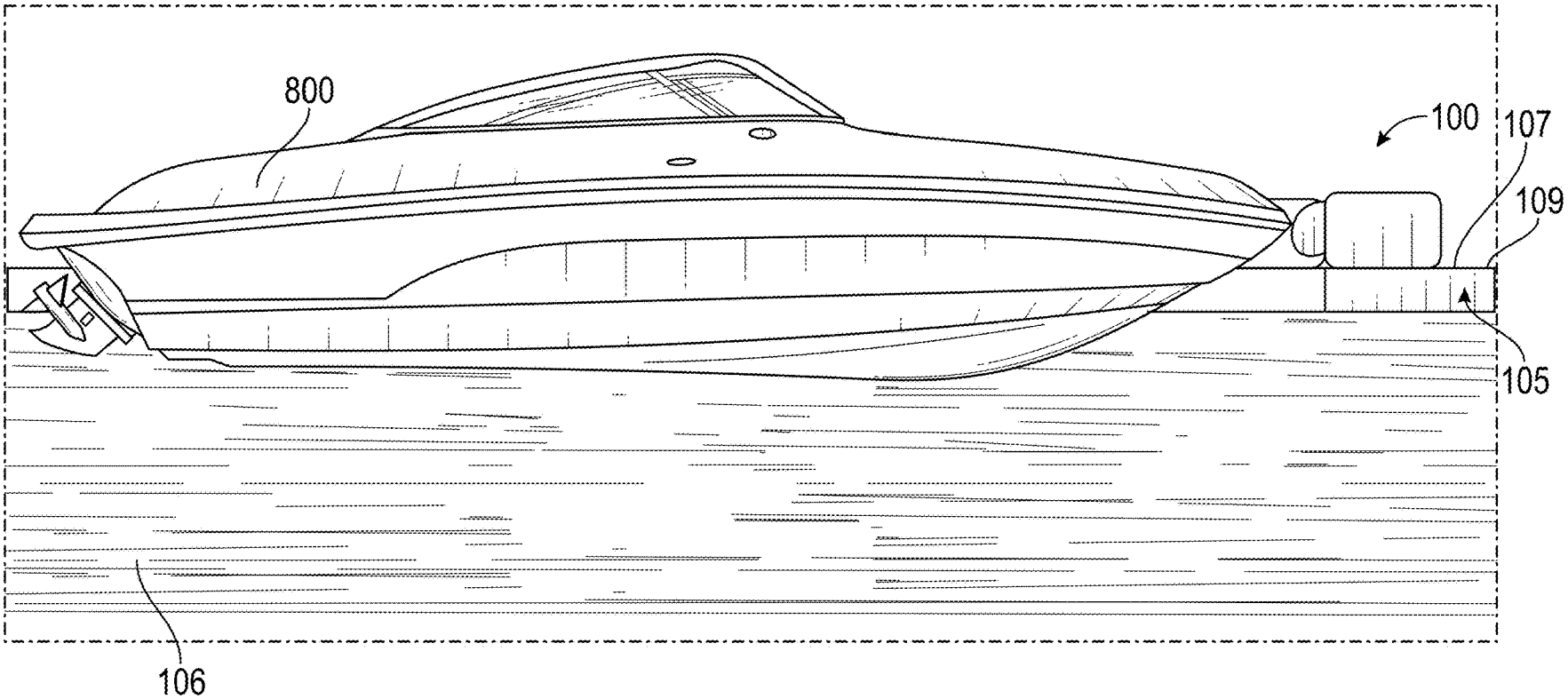
FIG. 8 is a diagram illustrating an embodiment of a docking assist assembly for a floating docking system.

FIG. 8 illustrates an embodiment of a boat 800 parked in a docking assist assembly 100 mounted to a dock 105. It is recognized that while the docking assist assembly 100 is illustrated in FIG. 8, any embodiment of a docking assist assembly described herein could be used. FIG. 8 shows an embodiment of a docking assist assembly 100 that can be used in a floating dock. In a floating dock, as the height of the water changes, the height of the dock 105 changes proportionally, such that the boat 800 can be parked in the docking assist assembly 100 at all water levels.

Figure 9:
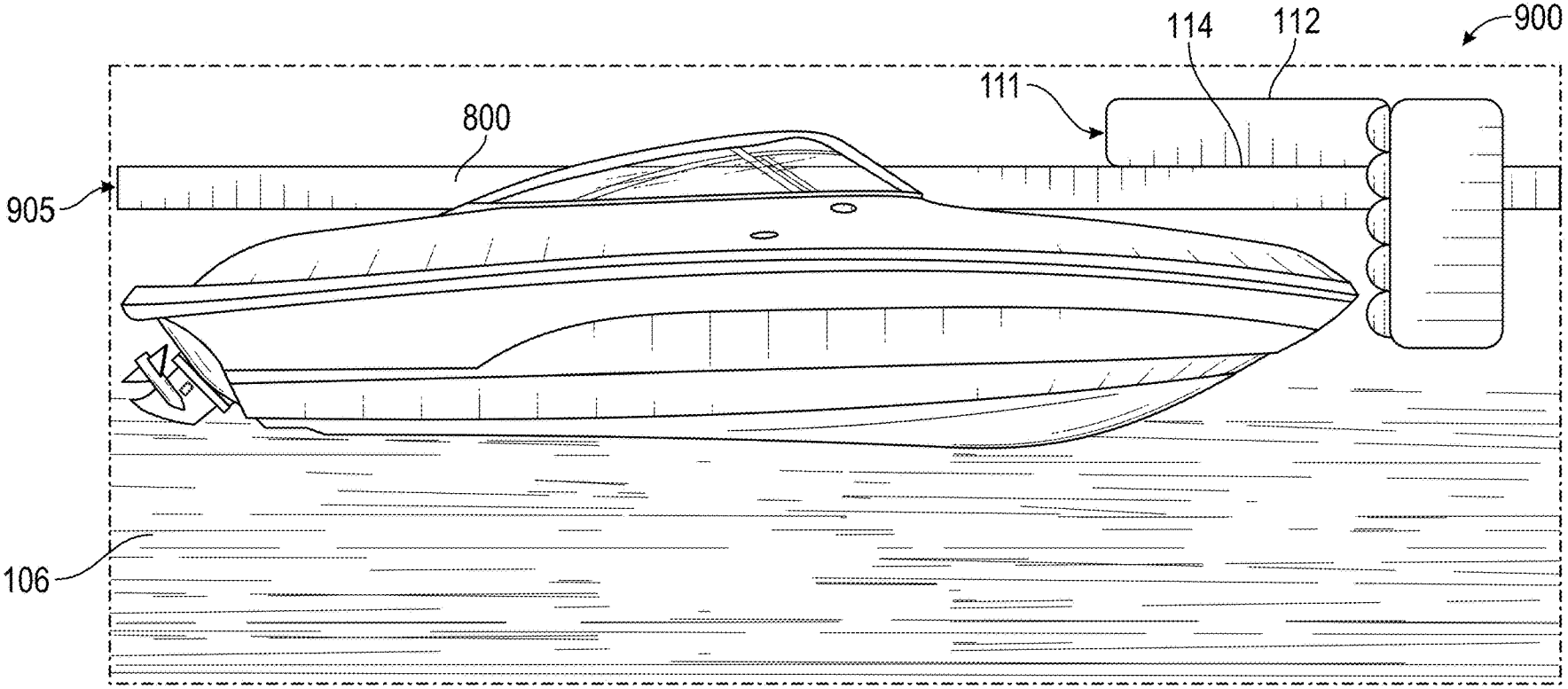
FIG. 9 is a diagram illustrating an embodiment of a docking assist assembly for a grounded docking system.

FIG. 9 illustrates an embodiment of docking assist assembly 900 which may be used for grounded or non-floating dock 905. When a dock is not floating, fluctuating water levels may impact the usability of the dock. As the water level drops, the height of a boat's bow relative to the dock decreases. Docking assist assembly 900 may be any embodiment of a docking assist assembly described herein, however, to accommodate for dropping water levels, the bow retaining portion 151 may extend further down towards the water. For example, the first bow arm section 153 and second bow arm section 155 may extend further down in a vertical direction towards the water. In one aspect, the bow retaining portion 151 may include more bumper portions 157 to cover the front of the first bow arm section 153 and the second bow arm section 155. In one aspect, the bow arms 153 and 155 of docking assist assembly 900 extend no more than two feet below the mounting portion in a direction towards the water.

In use, with a high water level, when a boat operator approaches the dock to park the boat 800, the boat operator may drive the boat 800 at a low speed or coast into the bow retaining portion 151 such that the bow of the boat 800 engages the bumper portion 157 near the top of the first bow arm section 153 on one side of the boat 800's bow (such as the port side of the bow) and the bow of the boat 800 engages the bumper portion 157 near the top of the second bow arm section 155 on the other side of the boat 800's bow (such as the starboard side of the bow). As the water level drops, when a boat operator parks the boat 800, the bow of the boat 800 will engage the bumper portions 157 on each bow arm section 153 and 155 at a lower height. The extended bow arm sections 153 and 155 may have the advantage of allowing boats to be parked at fluctuating water levels.

Figure 10:
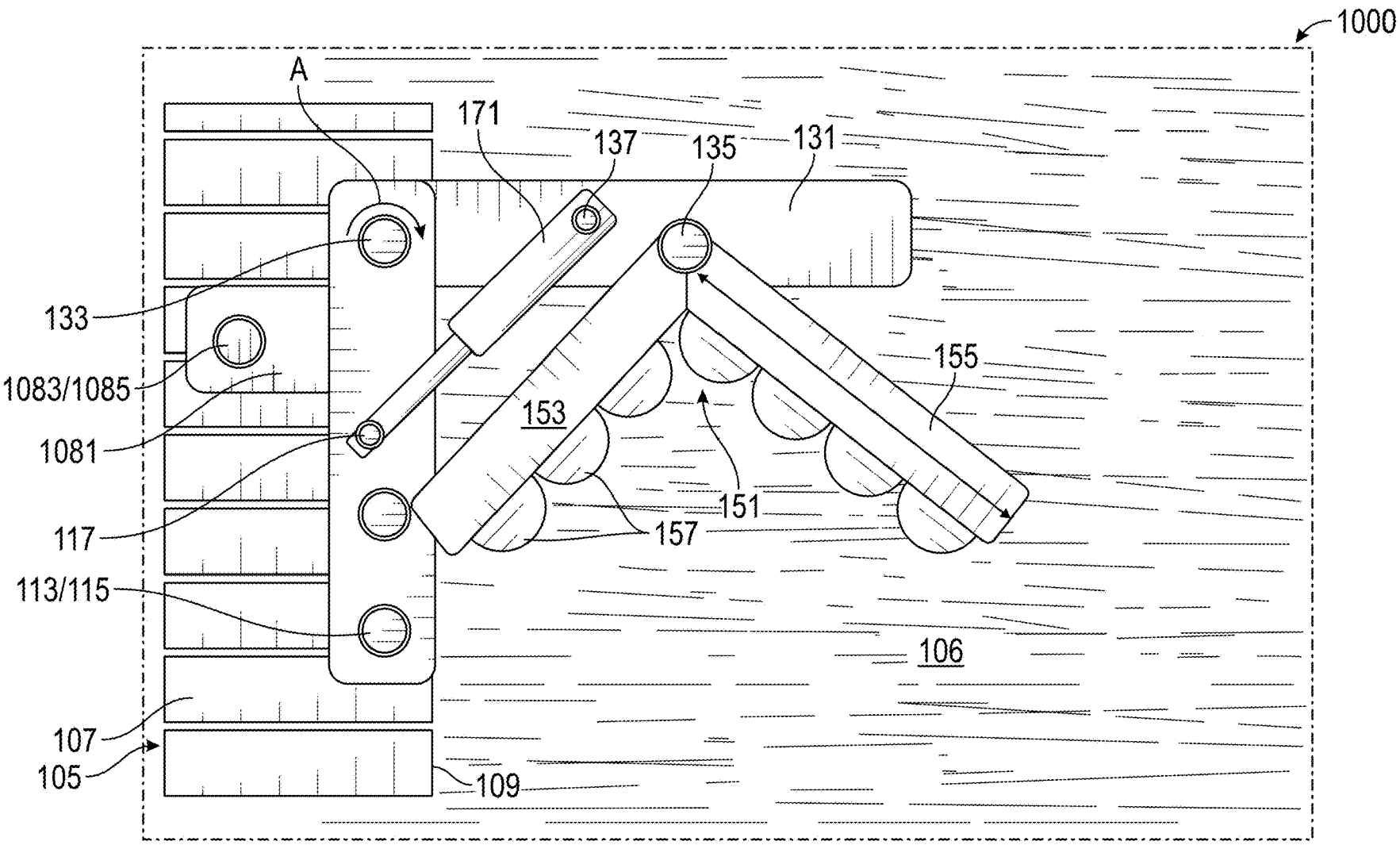
FIG. 10 is a diagram illustrating an embodiment of a docking assist assembly with a support plate.

FIG. 10 illustrates an embodiment of a docking assist assembly 1000 mounted on a dock 105. The docking assist assembly 100 includes a dock mounting portion 111, an arm portion 131, a bow retaining portion 151, a shock absorption assembly 171, and a fastener plate 1081. The fastener plate 1081 may comprise an elongate rectangular plate defining a planar surface which is positioned against the upper surface 107 of the dock 105. The fastener plate 1081 may include one or more mount holes 1083 extending through the fastener plate 1081 and one or more of dock fasteners 1085 extending through the fastener plate 1081 and into the dock 105 to secure the fastener plate 1081 in place. The fastener plate 1081 may be fixed to the dock mounting portion 111. In one aspect, the fastener plate 1081 may be fixed to the dock mounting portion 111 by one or more bolts which extend through opening(s) at one end of the fastener plate 1081 and into opening(s) in the dock mounting portion 111 which permits the fastener plate 1081 to be secured to the dock mounting portion 111. In another aspect, the bolt(s) may extend through the dock mounting portion 111 and into the dock 105. In another aspect the fastener plate 1081 may be welded to the dock mounting portion 111. In another aspect the fastener plate 1081 and the dock mounting portion 111 may form one integral part. The fastener plate 1081 may provide the advantage of offsetting some of the force on mounting portion 111, such as, for example, additional force provided from the increase in weight of bow arm sections 153 and 155 in the docking assist assembly 900 described in FIG. 9. It is recognized that while the docking assist assembly 1000 is illustrated in FIG. 10 to include fastener plate 1081, any embodiment of a docking assist assembly described herein can include fastener plate 1081.

Figure 11A:
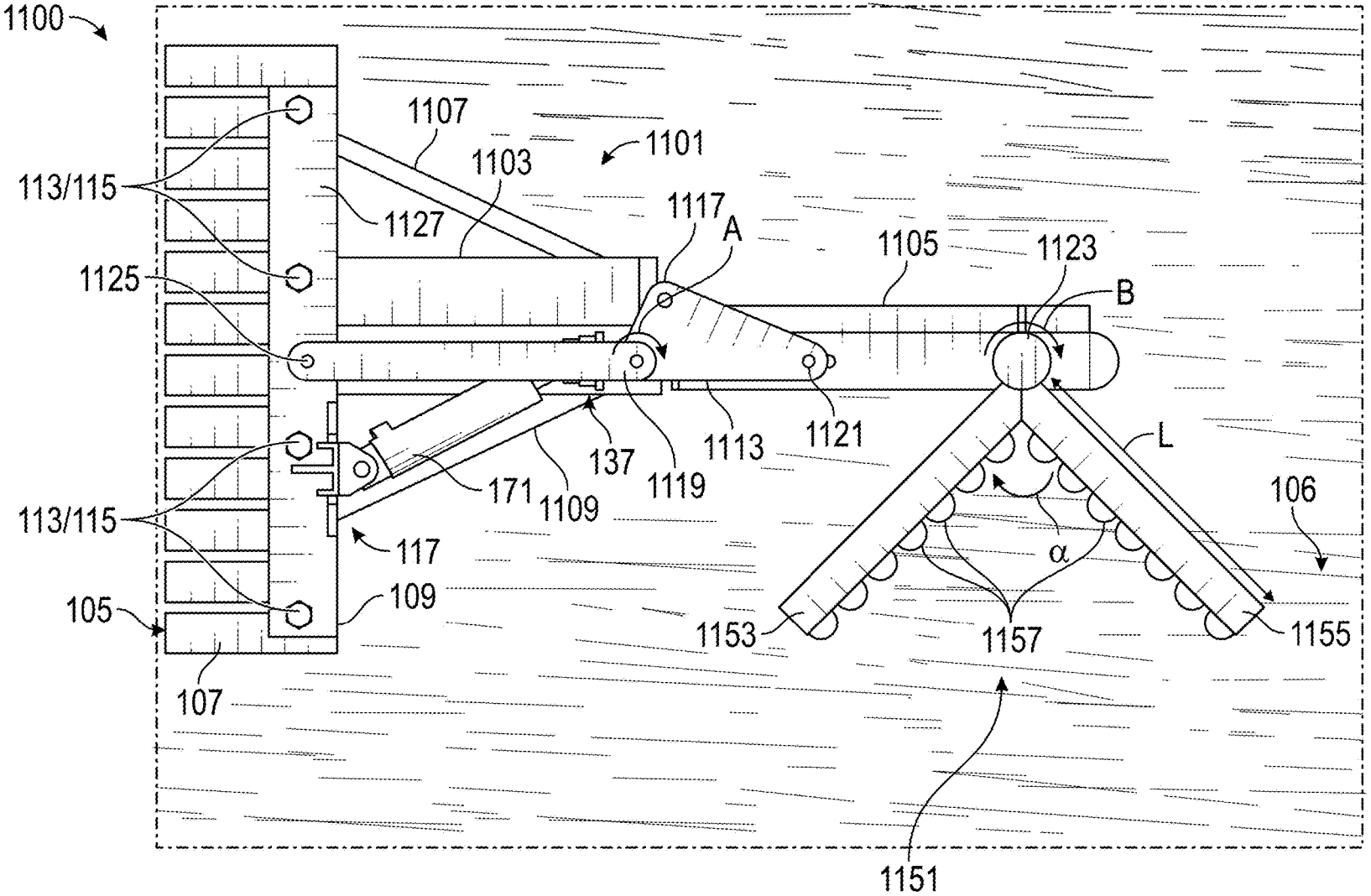
FIG. 11A is a diagram illustrating a top view of an embodiment of a docking assist assembly.
Figure 11B:
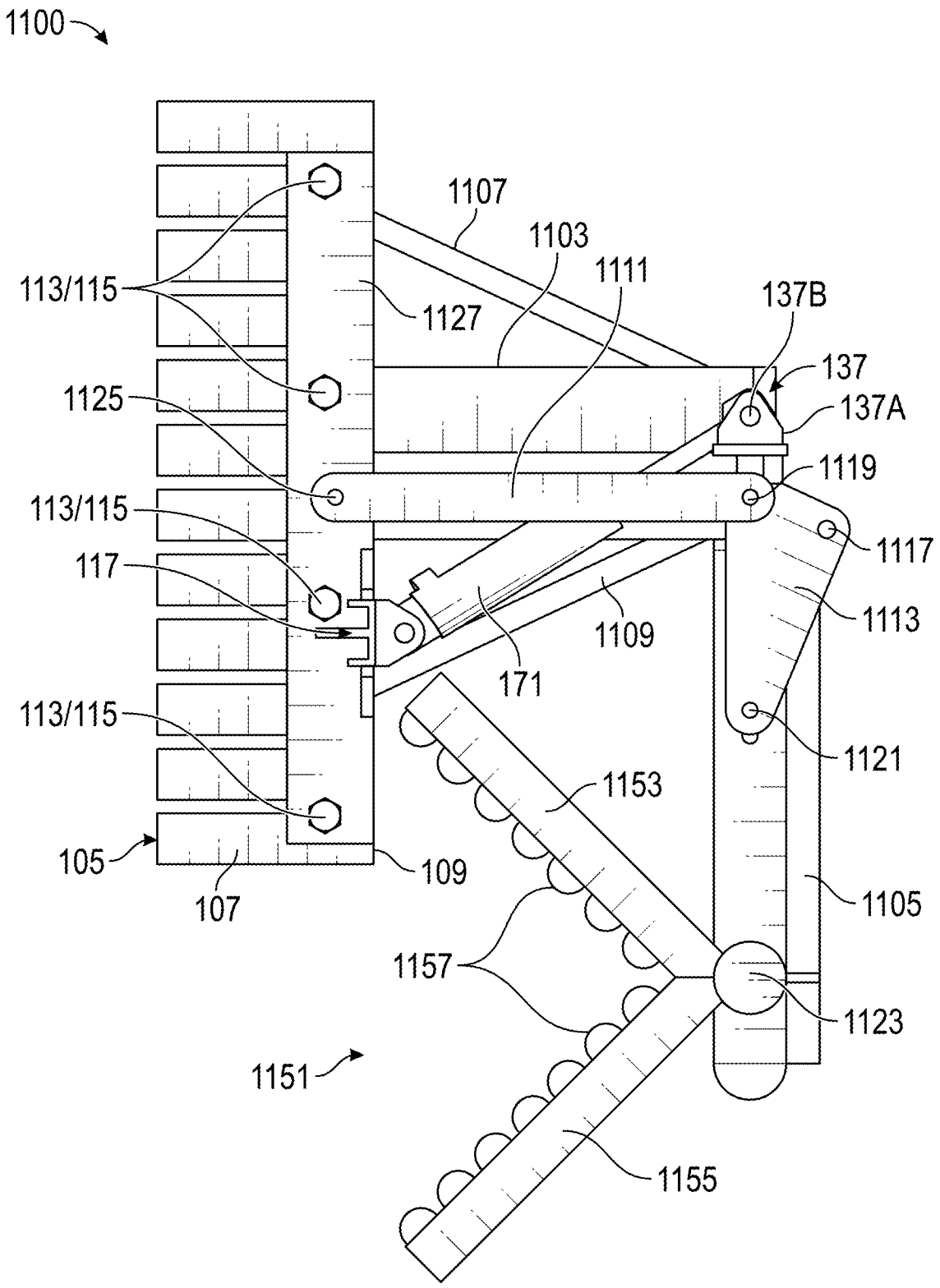
FIG. 11B is a diagram illustrating a top view of an embodiment of a rotated docking assist assembly.
Figure 11C:
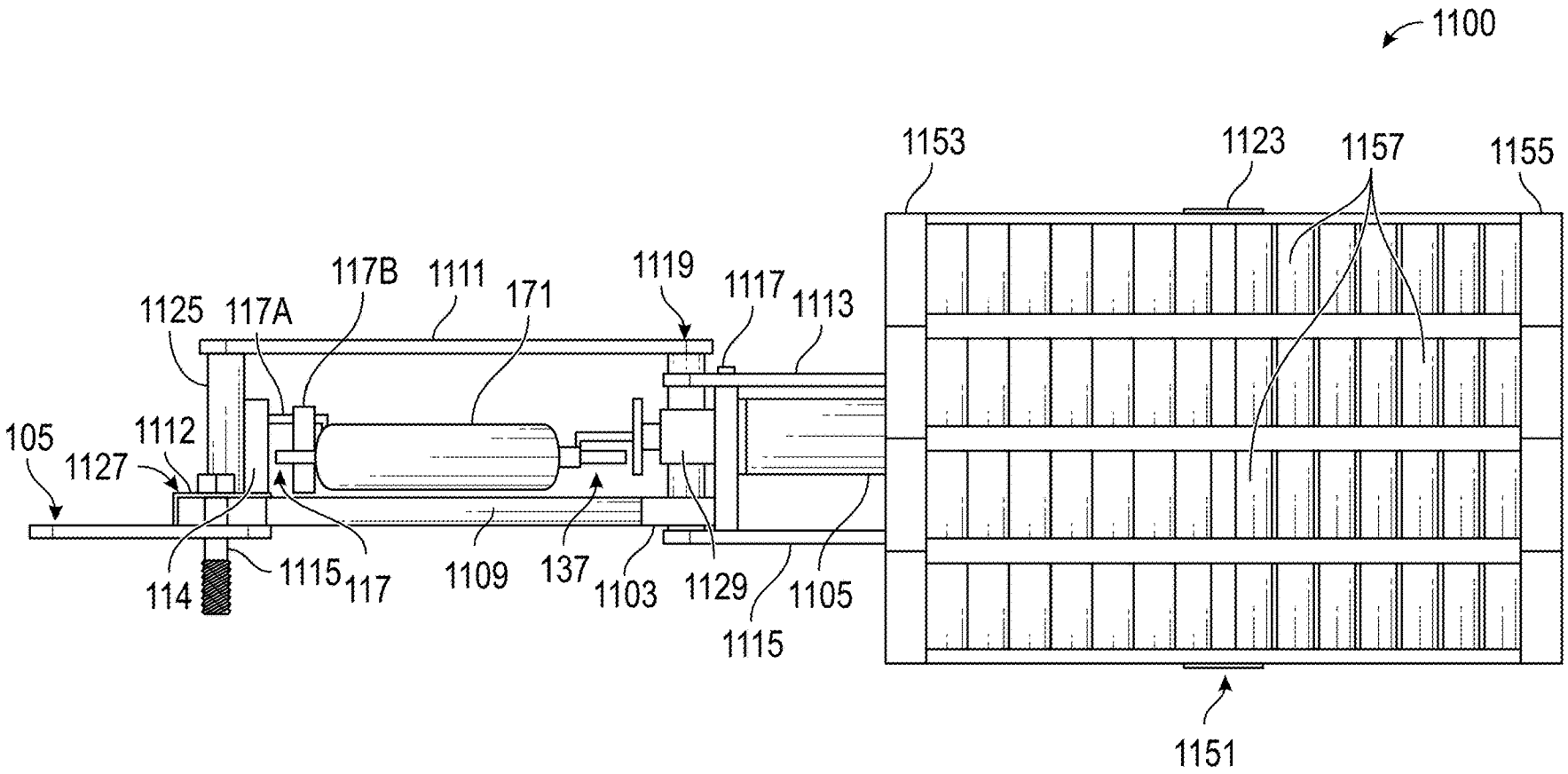
FIG. 11C is a diagram illustrating a front view of an embodiment of a docking assist assembly.
Figure 11D:
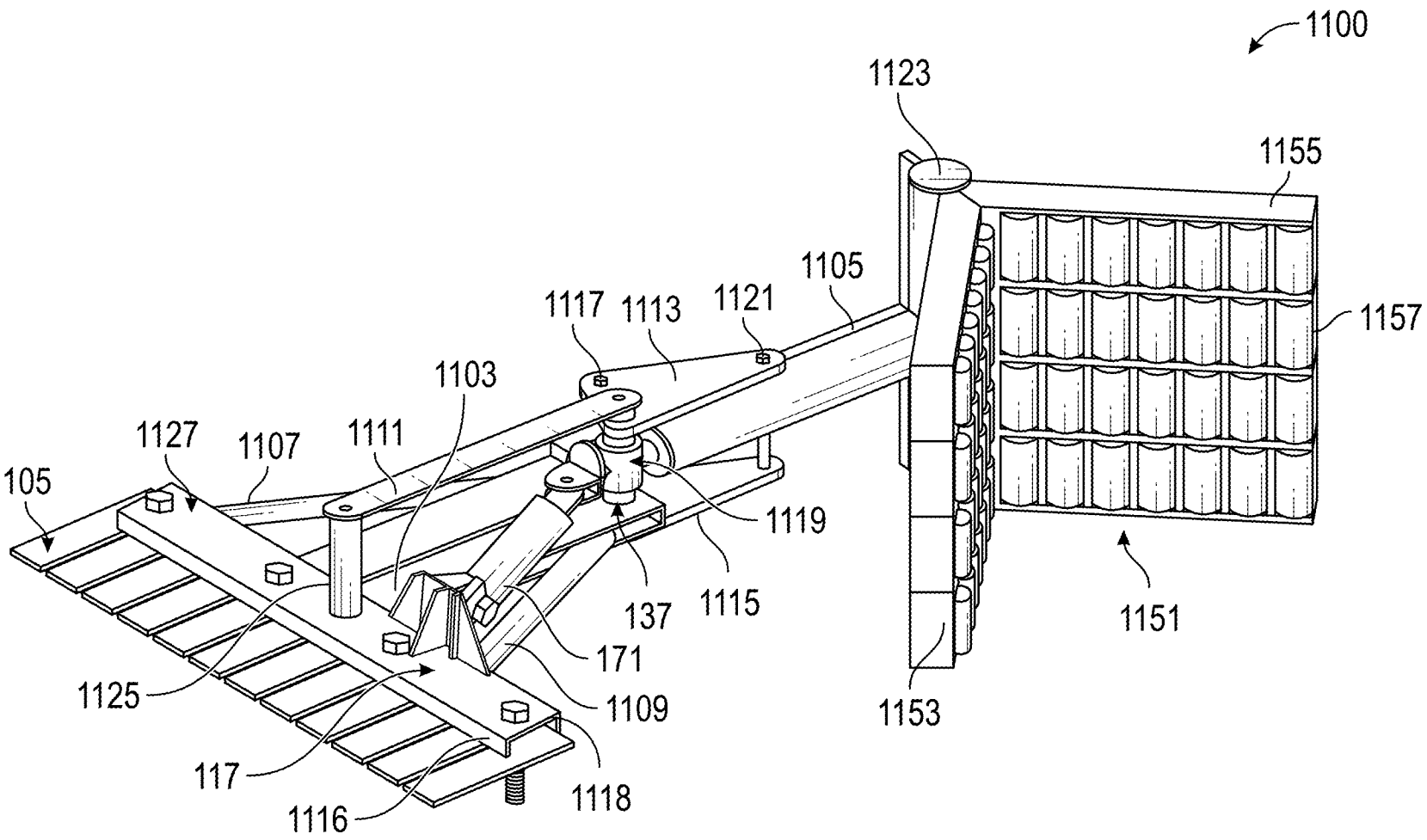
FIG. 11D is a diagram illustrating a first perspective view of an embodiment of a docking assist assembly.
Figure 11E:
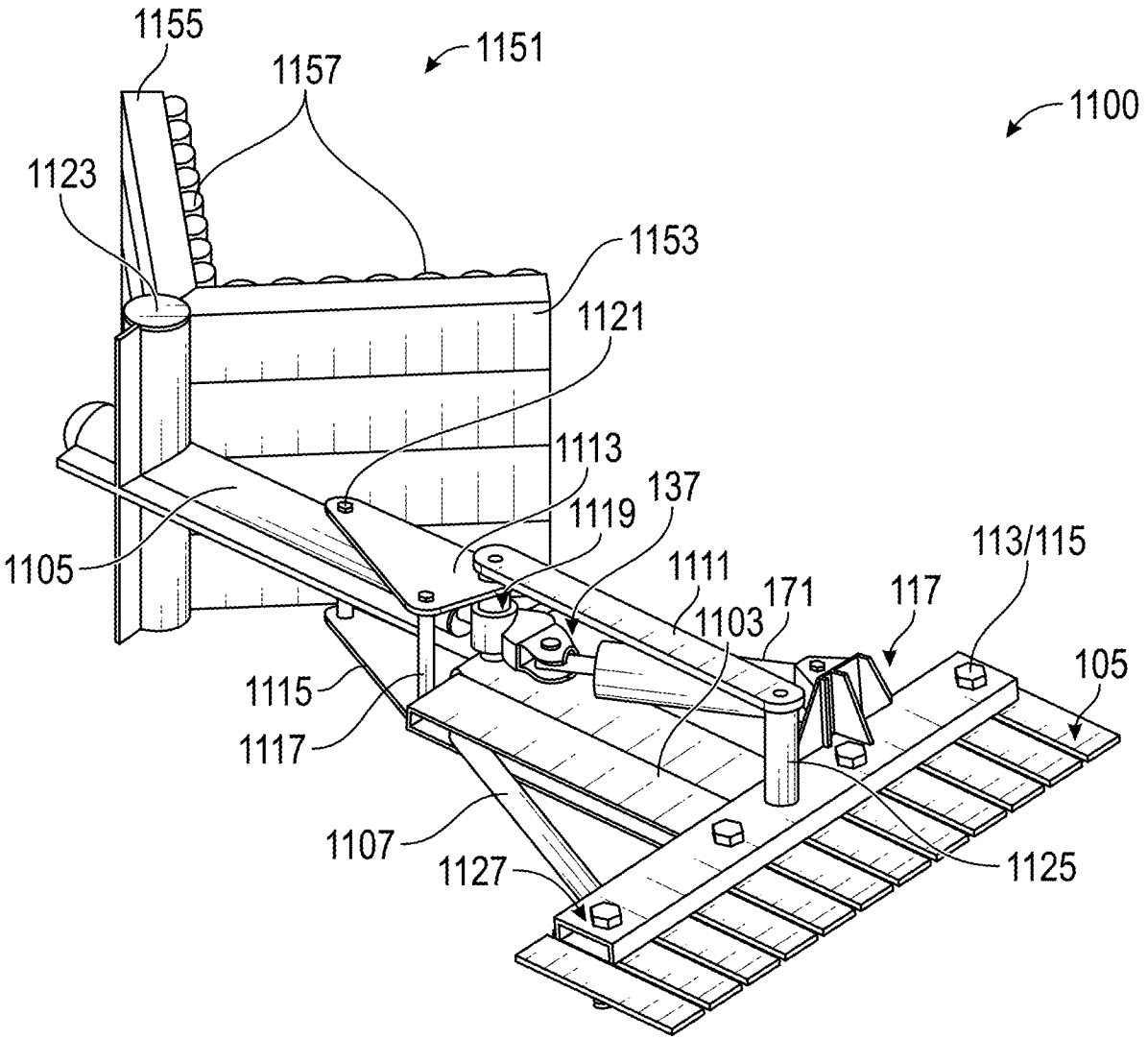
FIG. 11E is a diagram illustrating a second perspective view of an embodiment of a docking assist assembly.

FIGS. 11A-11E illustrate an embodiment of a docking assist assembly 1100 mounted on a dock 105. FIG. 11A illustrates a top view, FIG. 11B illustrates a top view in a rotated position, FIG. 11C illustrates a front view, and FIGS. 11D and 11E illustrate perspective views of the docking assist assembly 1100. The docking assist assembly 1100 includes a dock mounting portion 1127, an arm assembly 1101, a bow retaining portion 1151, and a shock absorption assembly 171. As discussed above, in some embodiments, there is no separate shock absorption assembly 171, but rather one or a combination of elements of the docking assist assembly 1100 permit the bow retaining portion 1151 and/or all or a portion of the arm assembly 1101 to move relative to the dock mounting portion 1127. The dock mounting portion 1127 may comprise an elongate rectangular plate defining a plane with an upper side 1112 and a bottom side 1114 (e.g., see FIG. 11C), and two approximately vertical sides 1116 and 1118 extending from the bottom side 1114 towards the dock 105, such that the two sides 1116 and 1118 contact the dock in an approximately perpendicular manner. The dock mounting portion 1127 is configured to be supported by the upper surface 107 of the dock 105. In one aspect, the dock mounting portion 1127 may comprise a bottom plate similar to the top rectangular plate such that the dock mounting portion 1127 comprises a hollow plank. The dock mounting portion 1127 may include mount holes 113 extending through the dock mounting portion 1127 and a plurality of dock fasteners 115 extending through the dock mounting portion 1127 and into the dock 105 to secure the dock mounting portion 1127 in place. The absorber dock mount 117 is located on the dock mounting portion 1127 and is used to secure one end of the shock absorption assembly 171 to the dock mounting portion 1127. The absorber dock mount 117 may comprise an assembly including a bracket 117A and a first absorber rod 117B (e.g., see FIG. 11C). The bracket 117A may be coupled to the dock mounting portion 1127 (e.g., by welding) and the first absorber rod 117B may extend through the bracket 117A and one end of the shock absorption assembly 171 to connect the shock absorption assembly 171 to the dock mounting portion 1127. The arrangement of the bracket 117A and first absorber rod 117B may allow the shock absorption assembly 171 to rotate about an axis defined by the first absorber rod 117B.

The arm assembly 1101 may include a first arm portion 1103 and a second arm portion 1105. The first arm portion 1103 may comprise a rectangular plate that is coupled to the dock mounting portion 1127 at one end and coupled to the second arm portion 1105 at the opposite end. For example, the first arm portion 1103 may be welded, bolted, screwed, and/or the like on one end to the dock mounting portion 1127. The first arm portion 1103 may be further supported by a first dock arm support 1107 on one side and a second dock arm support 1109 on the opposite side. The first dock arm support 1107 may be coupled at one end to dock mounting portion 1127 and coupled at the opposite end to the first arm portion 1103. Similarly, the second dock arm support 1109 may be coupled at one end to dock mounting portion 1127 and coupled at the opposite end to the first arm portion 1103, where the first dock arm support 1107 and the second dock arm support 1109 comprise an approximately triangular support structure for the arm assembly 1101. The second arm portion 1105 may comprise a cylindrical or tubular structure with a plate extending out of one side of the cylindrical portion. A first end of the second arm portion 1105 may comprise an arm connector 1129 that may be used to couple the second arm portion 1105 to a pivot assembly 1119. The arm connector 1129 may comprise a vertical hollow tube, configured to receive a rod. The second arm portion 1105 may be configured to rotate about an axis A defined by the pivot assembly 1119. Through the pivot assembly 1119, the second arm portion 1105 may be connected to the first arm portion 1103. The pivot assembly 1119 may comprise a vertical rod. The pivot assembly 1119 may be connected to the dock mounting portion 1127 by third dock arm support 1111. The third dock arm support 1111 may be coupled at one end to the top of the pivot assembly 1119 and coupled at the opposite end to first dock rod 1125. The top of the first dock rod 1125 may be coupled to the third dock arm support 1111 and the bottom of the first dock rod 1125 may be coupled to the dock mounting portion 1127. The first arm portion 1103 may be further coupled to the pivot assembly 1119 by a top arm plate 1113 and a bottom arm plate 1115. The top and bottom arm plates 1113 and 1115 may comprise triangular plates with rounded corners and may be coupled to various portions of the docking assist assembly 1100 at or near each corner. The top and bottom arm plates 1113 and 1115 may include a hole in a first corner that is configured to receive the pivot assembly 1119, such that the top and bottom arm plates 1113 and 1115 can rotate about an axis A defined by the pivot assembly 1119. The top arm plate 1113 may be coupled to the bottom arm plate 1115 by a first plate rod 1117 that may extend through the top arm plate 1113 and through the bottom arm plate 1115. The top and bottom arm plates 1113 and 1115 may be coupled to the second arm portion 1105 by a second plate rod 1121 that may extend through the top arm plate 1113, the second arm portion 1105, and the bottom arm plate 1115. In the aspect illustrated, the top arm plate 1113, the bottom arm plate 1115, and the second arm portion 1105 may be configured to rotate about an axis A defined by the pivot assembly 1119. The pivot assembly 1119 may be coupled to the shock absorption assembly 171 by absorber arm mount 137. The absorber arm mount 137 may comprise an assembly including a bracket 137A and a second absorber rod 137B (see FIG. 11B). The bracket 137A may be coupled to the arm connector 1129 (e.g., by welding) such that rotation of the second arm portion 1105 about the axis A causes equivalent rotation of the bracket 137A. The second absorber rod 137B may extend through the bracket 137A and one end of the shock absorption assembly 171 to connect the shock absorption assembly 171 to pivot assembly 1119 and the second arm portion 1105. The arrangement of the bracket 137A and second absorber rod 137B may allow the shock absorption assembly 171 to rotate about an axis defined by the second absorber rod 137B.

The second arm portion 1105 may be connected to the bow retaining portion 1151 by bow arm mount 1123. The bow arm mount 1123 may comprise a cylindrical or tubular structure with a plate extending out of one side of the cylindrical portion. The bow arm mount 1123 may extend through the second arm portion 1105 and may be approximately perpendicular to the second arm portion 1105. The bow retaining portion 1151 may include a first bow arm section 1153 and a second bow arm section 1155. Either or both of the first bow arm section 1153 and the second bow arm section 1155 may include a resilient inner portion, such as a bumper portion 1157. In one aspect, the first bow arm section 1153 and the second bow arm section 1155 may comprise a single integral piece. As illustrated in FIGS. 11C-11E, the bumper portion 1157 may comprise multiple rows and columns of smaller bumpers to optimize absorption and traction.

In docking assist assembly 1100, the dock mounting portion 1127 may be fixed to a dock 105 at mount holes 113 by dock fasteners 115 such that the sides of the dock mounting portion 1127 are approximately perpendicular to the upper surface of the dock. In the aspect illustrated, the second arm portion 1105 is mechanically coupled at one end to the first arm portion 1103 at pivot assembly 1119 such that the second arm portion 1105 is rotationally moveable relative to the first arm portion 1103. In one aspect, including the illustrated embodiment, the second arm portion 1105 may be rotationally movable relative to the first arm portion 1103 about axis of rotation A. In the position illustrated in FIG. 11A, the arm assembly 1101 and the dock mounting portion 1127 make a T-shape, which may be considered the relaxed position. In one aspect, the second arm portion 1105 may be configured to rotate in a first direction (e.g., counterclockwise in FIG. 11A) about the axis of rotation A relative to the first arm portion 1103. In some embodiments, the shock absorption assembly 171 prevents rotation of the second arm portion 1105 relative to the first arm portion 1103 in its relaxed position by an angle greater than 45 degrees, greater than 30 degrees, greater than 25 degrees, greater than 20 degrees, greater than 15 degrees or greater than 10 degrees in the first direction. In one aspect, the second arm portion 1105 may be rotationally movable relative to the first arm portion 1103 about axis of rotation A in a second direction, the second direction being opposite the first direction (e.g., clockwise in FIG. 11A). As shown in FIG. 11B, the second arm portion 1105 can rotate inwardly towards the dock 105 to minimize the amount of space the docking assist assembly 1100 occupies while not in use. In some embodiments, the docking assist assembly 1100 may prevent rotation of the second arm portion 1105 relative to the first arm portion 1103 in its relaxed position by an angle greater 90 degrees in the second direction. In one aspect, the pivot assembly 1119 may comprise any type of pivot assembly, such as shaft and a bearing assembly, to allow the second arm portion 1105 to rotate about axis of rotation A but limit the movement of the second arm portion 1105 in a direction extending vertically from the dock 105. As described above, the shock absorption assembly 171 is fixed at one end to the dock mounting portion 1127 at dock absorber mount 117 and fixed at another opposite end to the arm assembly 1101 at absorber arm mount 137. In one aspect, absorber dock mount 117 and/or absorber arm mount 137 may be a pivot assembly, such as a shaft (e.g., first absorber rod 117B and second absorber rod 137B) and bearing assembly, which may allow the shock absorption assembly 171 to rotate about its fixed points. The first bow arm section 1153 and the second bow arm section 1155 may be fixed at one end to the arm assembly 1101 at bow arm mount 1123. In the aspect illustrated, the first bow arm section 1153 and second bow arm section 1155 are fixed to the same bow arm mount 1123. In another aspect, there may be more than one bow arm mounts 1123, such that the first bow arm section 1153 and the second bow arm portion 1155 are fixed adjacent to each other on second arm portion 1105. In one aspect, the first bow arm section 1153 and the second bow arm section 1155 may be mechanically coupled at one end to the second arm portion 1105 at bow arm mount 1123 such that the bow retaining portion 1151 is rotationally moveable relative to the second arm portion 1105. In one aspect, the bow retaining portion 1151 may be rotationally movable relative to the second arm portion 1105 about axis of rotation B. In one aspect, the bow arm mount 1123 may comprise a pivot assembly, such as a shaft and a bearing assembly, to allow the bow retaining portion 1151 to rotate about axis of rotation B but limit the movement of the bow retaining portion 1151 in a direction extending vertically from the dock 105. In another aspect, the arm assembly 1101 may further comprise a bow arm lock, such that rotation of first bow arm section 1153 and second bow arm section 1155 may be selectively prevented by engaging the bow arm lock. For example, when the bow arm lock is engaged, the first bow arm section 1153 and second bow arm section 1155 cannot move relative to their point of fixture on the arm assembly 1101. In another aspect, the first bow arm section 1153 and the second bow arm section 1155 are fixed with respect to one another. In another aspect, the first bow arm section 1153 and the second bow arm section 1155 define a V-shape with an angle $\alpha$ between them which faces away from the second arm portion 1105. Desirably the angle $\alpha$ is between 30 and 120 degrees, between 35 and 105 degrees and/or between 45 and 95 degrees. The bumper portion 1157 may desirably be fixed to first bow arm section 1153 and second bow arm section 1155 on the inward facing side of each bow arm such that in operation, the bumper portion 1157 on one arm face the bumper portion 1157 on the other arm. In some embodiments, the resilient inner portion, such as a bumper portion 1157, may be integrally formed with the bow arm sections 1153 and 1155. The length "L" of the bow arm sections 1153 and 1155 is measured from the centerpoint of the bow arm mount 1123 to the tip of a bow arm section as shown on FIG. 11A. In one aspect, the first bow arm section 1153 and the second bow arm section 1155 are between 2 and 10 feet long, between 3 and 8 feet long or between 3 and 6 feet long. In one aspect, the first bow arm section 1153 and the second bow arm section 1155 are at least 2 feet long, at least 3 feet long, or at least 5 feet long. In one aspect, the first bow arm section 1153 and the second bow arm section 1155 are no more than 8 feet long, no more than 6 feet long, no more than 5 feet long or no more than 4 feet long. For purposes of this application, where the first arm section 1153 and the second arm section 1155 are a single integral piece, the length of the arm sections shall be considered the center-point 1123 of the contact between the bow arm section and the arm assembly 1101.

Referring to FIG. 11A, in use, the dock mounting portion 1127 of the docking assist assembly 1100 may be fixed to a dock 105 which is positioned over and/or adjacent to a body of water 106 such that the dock mounting portion 1127 is near an elongate dock edge 109 that is adjacent to a pre-determined boat parking area of the body of water. The dock mounting portion 1127 may run parallel to the edge 109 of the dock 105. In one aspect, the first arm portion 1103 may extend roughly perpendicular to the dock mounting portion 1127 such that the arm assembly 1101 and the bow retaining portion 1151 are suspended above the water. Suspension of arm assembly 1101 and bow retaining portion 1151 above the water, may provide advantages such as allowing people to swim near the dock 105 without interference. An additional advantage may be that the docking assist assembly 1100 can be used on either straight or L-shaped docks because only the dock mounting portion 1127 needs to be fixed to the dock. First bow arm section 1153 and second bow arm section 1155 create a triangular shape or a V-shape that corresponds to the bow shape of a particular boat. The width of the bow retaining portion 1151 measured by the tip of first bow arm section 1153 from the tip of second bow arm section 1155 is desirably somewhat larger than the front portion of a boat's bow, which may enable a boat to be guided into the docking assist assembly 1100 by first bow arm section 1153 and second bow arm section 1155. In one aspect, when the first bow arm section 1153 and second bow arm section 1155 are moveable relative to each other such that the docking assist assembly 1100 may be used for many different types of watercraft with many different shaped bows. In this orientation, the bumper portion 1157 on the first bow arm section 1153 face the bumper portion 1157 on second bow arm section 1155. When a boat operator approaches the dock 105 to park the boat, the boat operator may drive the boat at a low speed or coast into the bow retaining portion 1151 such that the bow of the boat engages the bumper portion 1157 of the first bow arm section 1153 on one side of the boat's bow (such as the port side of the bow) and the bow of the boat engages the bumper portion 1157 of the second bow arm section 1155 on the other side of the boat's bow (such as the starboard side of the bow), as shown in FIG. 1B. The bumper portion 1157 absorb some of the incoming force of the boat and provide a soft impact area so as to not damage the bow of the boat. As the boat engages the bow retaining portion 1151, a force is transmitted to the second arm portion 1105 causing rotation of the second arm portion 1105 about axis of rotation A. As the second arm portion 1105 rotates about axis of rotation A, the bow retaining portion 1151 may rotate about axis of rotation B such that the boat 800 remains roughly perpendicular to the dock edge 109 as the second arm portion 1105 continues to rotate. Further rotation of the second arm portion 1105 engages the shock absorption assembly 171 which limits further rotation of the second arm portion 1105 and absorbs the force of the incoming boat, stopping the boat. With a portion of the bow of the boat engaged within the bow retaining portion 1151, the boat operator may then tie off the boat, such as tying the stern of the boat to the dock 105 by using a stern line.

In one aspect, the docking assist assembly 1100 may be removable from the dock 105 once fixed, which may have the advantage of allowing the docking assist assembly 1100 to be stored when not in use, such as, during the winter months in colder climates. To facilitate such removal, the docking assist assembly may desirably weigh less than 500 pounds, 400 pounds, 300 pounds, 200 pounds, 150 pounds, 125 pounds, 100 pounds, 75 pounds or 50 pounds. In one aspect, the first bow arm section 1153 and the second bow arm section 1155 and/or the bumper portion 1157 are resilient and are movable at least one inch in response to an impact force of 100 pounds.

In one aspect, the distance the docking assist assembly 1100 extends away from the elongate dock edge 109 of the dock 105 may be limited to prevent interference without other people and objects in the water. For example, in some embodiments, the length of extension of the arm assembly 1101 and the bow retaining portion 1151 away from the elongate dock edge 109 may be less than 10 feet, less than 8 feet, less than 6 feet, less than 4 feet, less than 2 feet, and/or the like.

Figure 13:
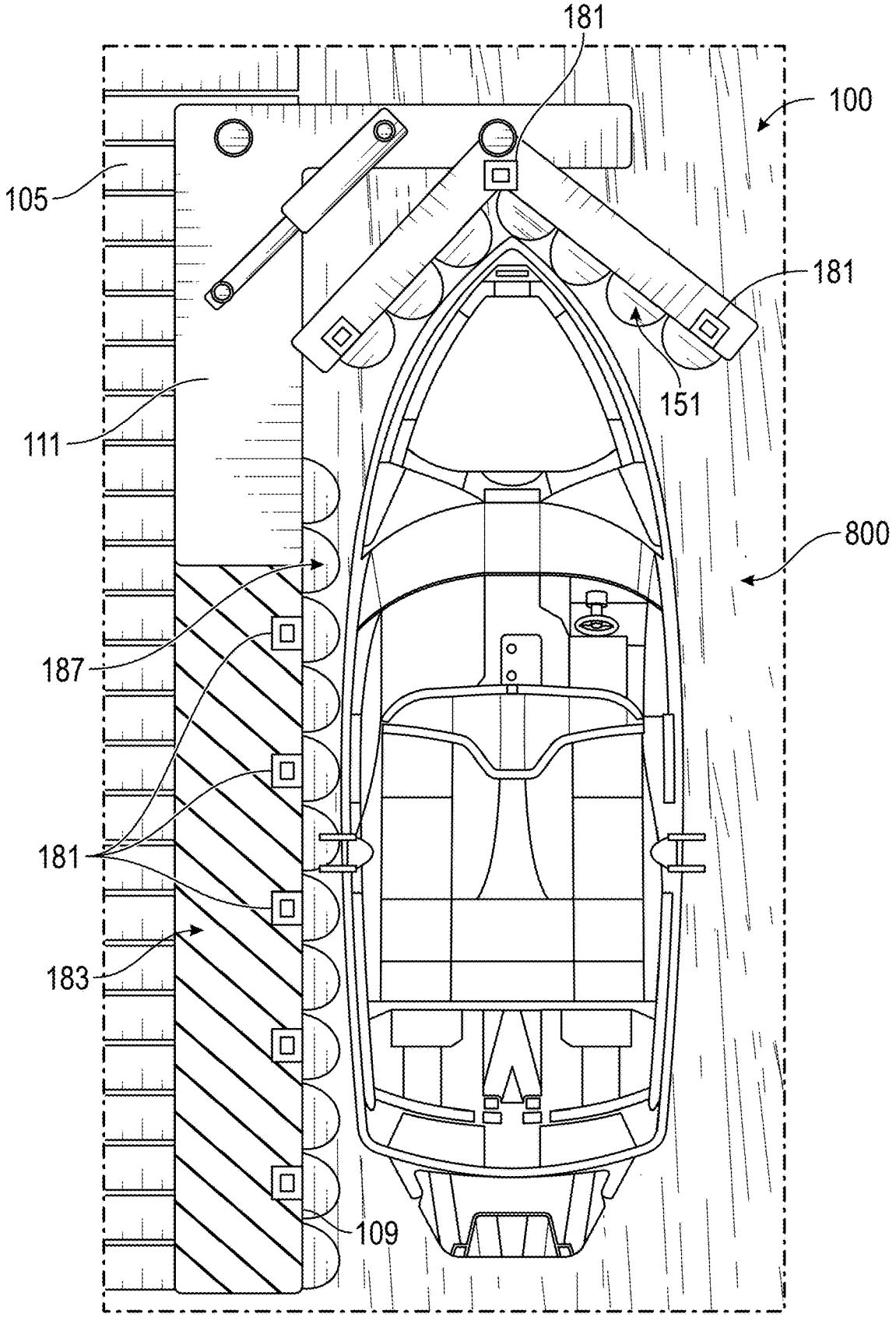
FIG. 13 is a diagram illustrating an embodiment of a docking assist assembly with additional safety components.

FIG. 13 illustrates an embodiment of a docking assist assembly 100 mounted on a dock 105 including additional safety components. While the docking assist assembly 100 is illustrated in FIG. 13, it is recognized that the safety components could be combined with any of the docking assist assemblies described herein (e.g., docking assist assembly 100, docking assist assembly 300, docking assist assembly 400, docking assist assembly 500, docking assist assembly 600, docking assist assembly 900, docking assist assembly 1000, docking assist assembly 1100, and/or the like).

In one aspect, the additional safety components may include lights 181, grip strip 183, and dock bumpers 187. The lights 181 may comprise any suitable light source, such as, for example, incandescent lights, fluorescent lamps, compact fluorescent lamps, halogen lamps, light emitting diodes, and/or the like. The number of lights 181 included in the system may vary depending on the strength of the lights and the size of the dock 105 and docking assist assembly 100. For example, the docking assist assembly 100 may include 1, 5, 10, 25, and/or the like lights 181. Generally, the lights 181 may be positioned anywhere on the docking assist assembly 100 and/or the dock 105. In one aspect, it may be preferable to include lights 181 on the bow retaining portion 151 (e.g., on a top, side, bottom, front, and/or the like surface of the bow retaining portion 151) to illuminate the docking area for the boat 800. For example, as shown in FIG. 13, lights 181 are positioned on a top surface of the bow retaining portion 151 to illuminate an area along the dock 105 where the boat is parked. When the lights 181 are arranged in this manner, the lights 181 may assist the boat operator in safely parking the boat 800. Lights 181 may also be positioned on the dock 105 and/or the grip strip 183. These lights 181 may be used to illuminate all or a portion of the dock 105 and/or further illuminate the boat parking area. Generally, the lights 181 may be configured to be waterproof to prevent damage while used with the docking assist assembly 100. In some embodiments, the lights 181 may be solar powered.

In one aspect, the grip strip 183 may be positioned on the dock 105 and may be adjacent to the docking assist assembly 100. For example, the grip strip 183 may be positioned along the elongate dock edge 109 of the dock 105. In one aspect, the grip strip 183 may be approximately the same height as the dock mounting portion 111 of the docking assist assembly 100. In some embodiments, the grip strip 183 may be configured to couple to the dock mounting portion 111. The grip strip 183 may comprise any suitable material for reducing the risk of a person on the dock 105 slipping. For example, the grip strip 183 may increase the traction between a person (e.g., a boat operator) and the dock 105. The grip strip 183 may be configured to removably or permanently couple to the dock 105. For example, the grip strip 183 may include an adhesive strip on one side that is configured to interface with an upper surface 107 of the dock 105. In one aspect, the grip strip 183 may comprise a material with sufficient roughness to reduce the chances of a person slipping. For example, the grip strip 183 may have minimum surface roughness (Rz) between 10 μm to 70 μm (e.g., between 10 μm to 70 μm, 20 μm to 60 μm, 30 μm to 50 μm, 35 μm to 45 μm, values between the foregoing, etc.). In some embodiments, it may be preferable for the grip strip 183 to have a minimum surface roughness of 20 μm or greater to reduce the risk of slipping when there is water on the grip strip 183. In some embodiments, the grip strip 183 may comprise a rubber material (e.g., vulcanized rubber), a plastic material (e.g., polyurethane), a vinyl material (e.g., polyvinyl chloride (PVC), and/or the like.

In one aspect, the docking assist assembly 100 may include dock bumpers 187. The dock bumpers 187 may extend along the elongate dock edge 109 of the dock 105. In one aspect, the dock bumpers 187 may be coupled to the docking assist assembly 100, such as, for example, to the dock mounting portion 111. The dock bumpers 187 may be similar or identical to the bumper portion 157 and are configured to allow the boat 800 to contact the dock bumpers 187 while reducing the risk of damage to the boat 800. For example, the dock bumpers 187 may be configured to resiliently deform upon contact from the boat 800. The dock bumpers 187 may extend from the side of the dock 105 in a direction towards the water. The heigh and length of the dock bumpers 187 may vary based on the size of the docking assist assembly 100 and the boat 800.

In some embodiments, some, or all of the components of the docking assist assembly 100 may be colored to match color of a user's boat 800. For example, a user may be able to customize the color of the docking assist assembly 100 to match the color of the boat 800.

Figure 14:
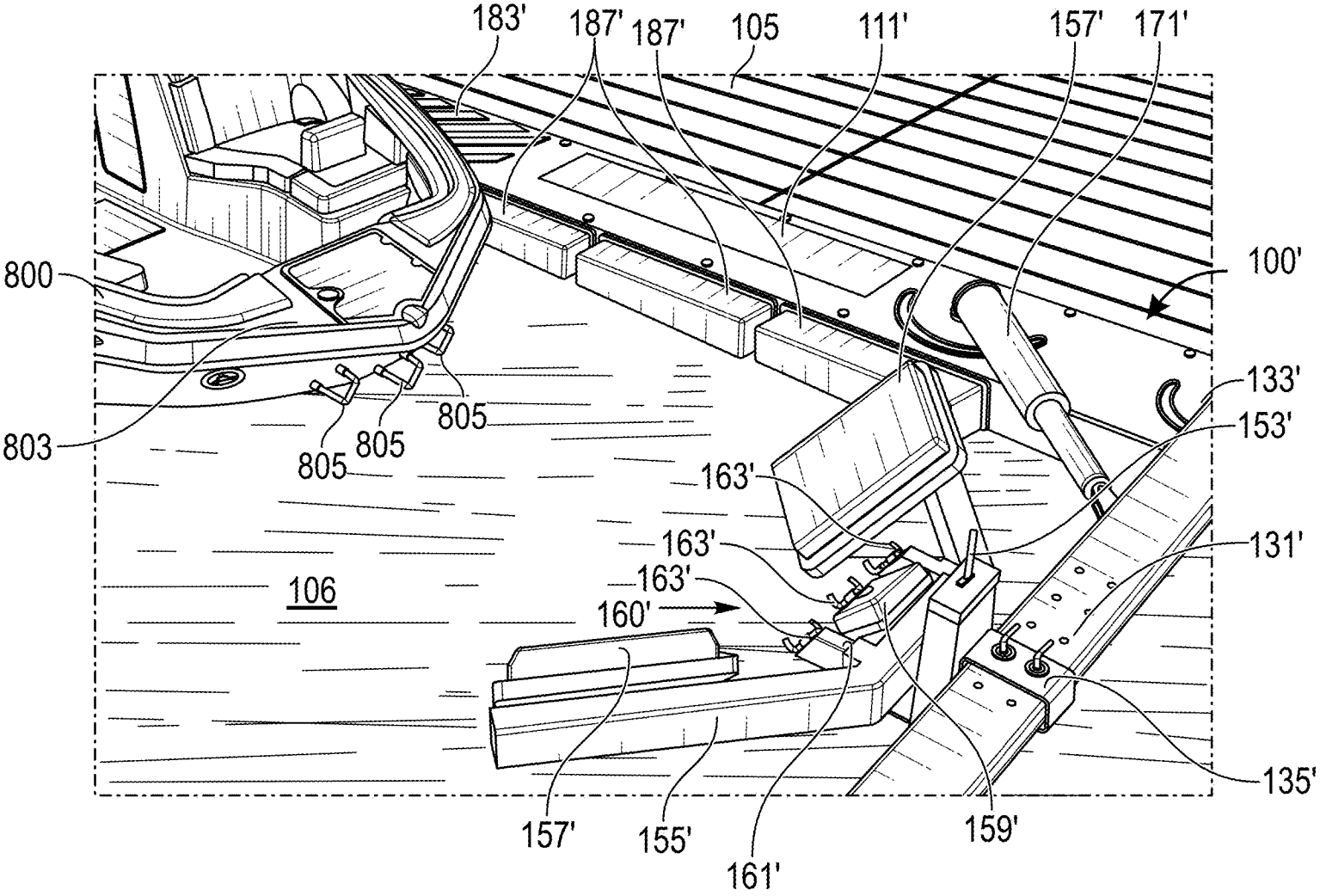
FIG. 14 is a diagram illustrating a perspective view of an embodiment of a docking assist assembly.
Figure 15:
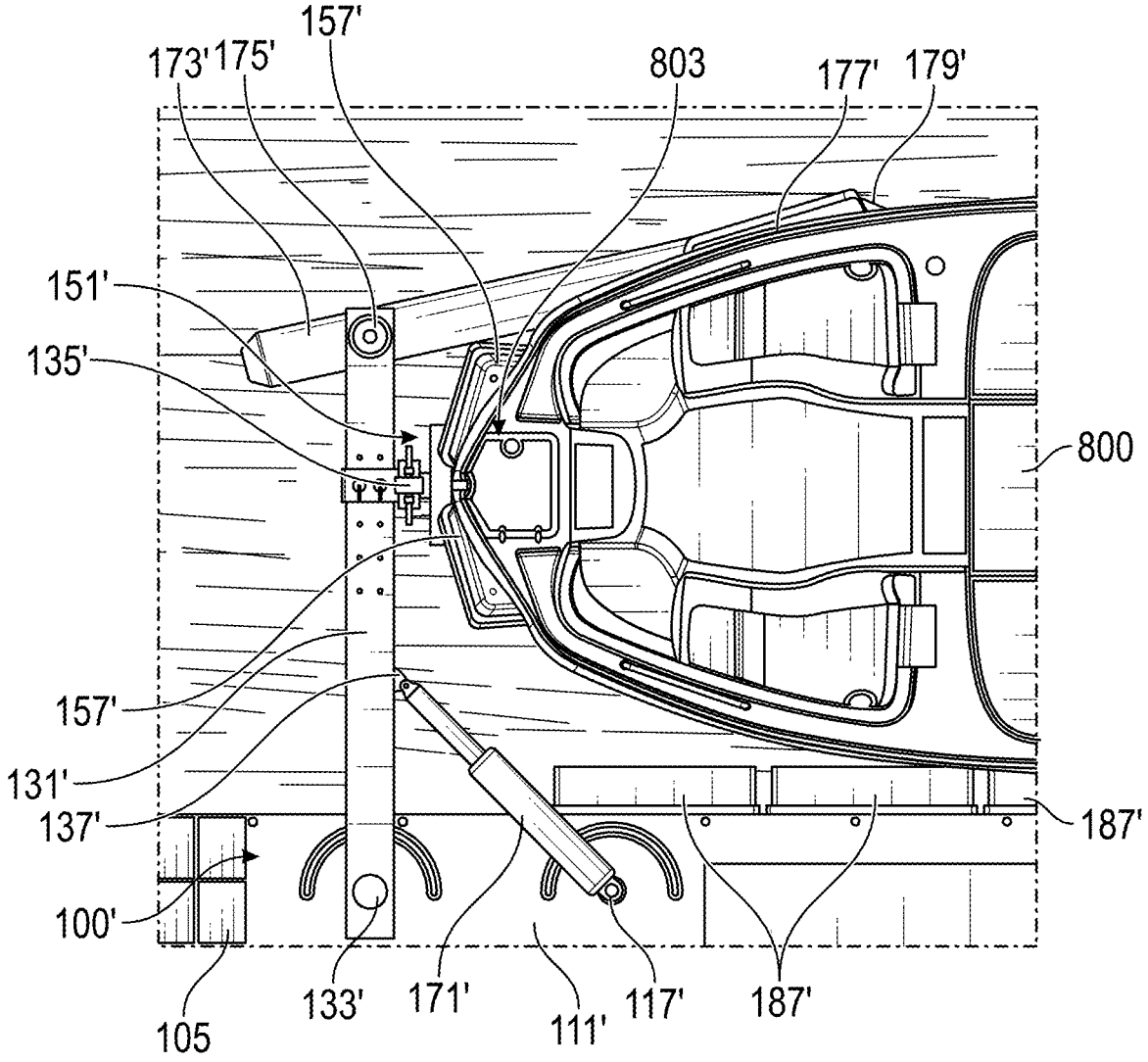
FIG. 15 is a diagram of a top view of the docking assist assembly of FIG. 14.

FIGS. 14 and 15 illustrate an embodiment of a docking assist assembly 100' mounted on a dock 105. The docking assist assembly 100' can include some or all of the structures and functionalities as the docking assist assembly 100 as shown and described in relation to at least FIGS. 1A-2 and 13, with the differences noted below. Thus, reference numerals used to designate various features or components of the docking assist assembly 100 are identical to those used for identifying the corresponding features of the components of the docking assist assembly 100' except that the numerical identifiers for the docking assist assembly 100' include a "prime".

Figure 16A:
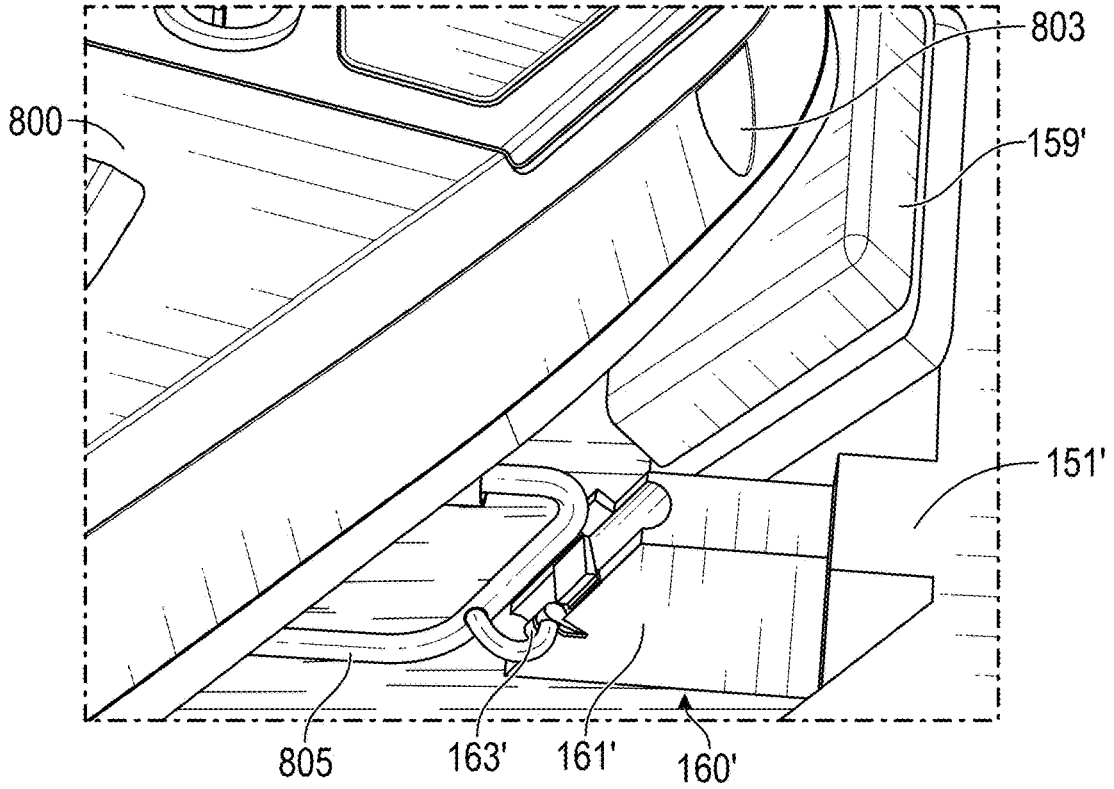
FIGS. 16A and 16B are diagrams illustrating a connector of an embodiment of a docking assist assembly in an open configuration and a closed configuration respectively.
Figure 16B:
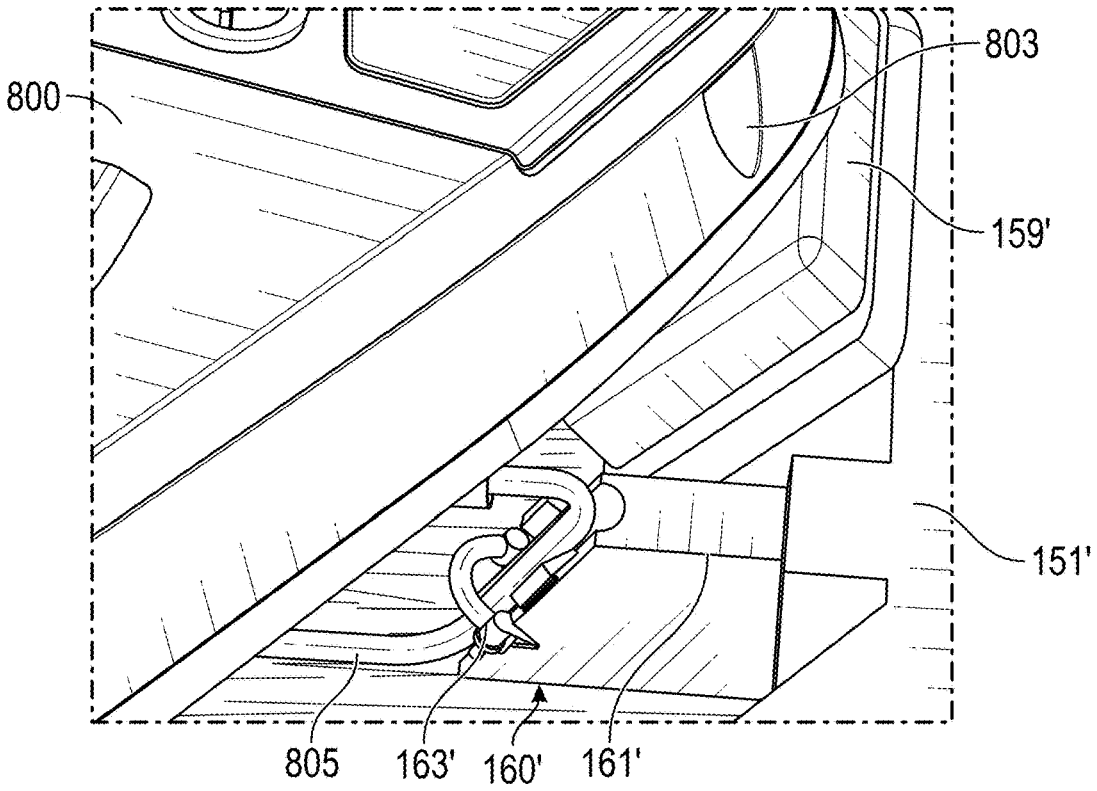

The docking assist assembly 100' differs from the docking assist assembly 100 in one aspect in that the docking assist assembly 100' includes a connection system 160', as described further with reference to at least FIGS. 16A and 16B. The docking assist assembly 100' may also differ structurally in one or more ways from the docking assist assembly 100. In one example, the bow arm sections 153', 155' of the bow retaining portion 151' can be at a non-perpendicular angle relative to the dock 105. For example, the bow arm sections 153', 155' can be angled to approximate the angle of a bow 803 of the boat 800. Including angled bow arm sections 153', 155' may enable greater contact (e.g., surface area) between the boat 800 and the docking assist assembly 100' while parked. In another example, the bumper portions 157' of each bow arm section 153', 155' may comprise a single bumper portion 157'. The docking assist assembly 100' may also include a central bumper portion 159'. The central bumper portion 159' may be aligned with the bow portion mount 135' and may be configured to engage and prevent damage to the keel of the bow 803. In yet another example, in some aspects, the docking assist assembly 100' can include a second arm portion 173' (see e.g., FIG. 15). The second arm portion 173' may be pivotably connected to the arm portion 131' via a second arm mount 175'. For example, the second arm portion 173' may be configured to rotate relative to the arm portion 131' via the second arm mount 175'. In some aspects, the second arm mount 175' may include a locking system to lock the angular position of the second arm portion 173' relative to the arm portion 131'. For example, the angular position may be changed to accommodate different sized boats 800. The second arm portion 173' can include a bumper portion 177'. The bumper portion 177' can extend at least partially along a length of the second arm portion 173' between the second arm mount 175' and a distal end 179' of the second arm portion 173'. The bumper portion 177' can be configured to engage an opposite side of the boat 800 than the side of the boat 800 closest to the dock 105. Other implementations of the docking assist assembly 100' may not include the second arm portion 173'.

Referring now to FIGS. 16A and 16B, the docking assist assembly 100' can include a connection system 160'. The connection system 160' can be configured to secure the boat 800 to the docking assist assembly 100' when the boat 800 is docked. The connection system 160' can include one or more connectors 163'. The connectors 163' can be positioned on extension members 161' that can extend outwardly from the bow retaining portion 151'. The extension members 161' may be positioned below the central bumper portion 159'. The one or more connectors 163' can be configured to engage one or more boat anchor brackets 805 of the boat 800 (see e.g., FIG. 14). The boat anchor brackets 805 can be secured to the bow 803 of the boat using any conventional means. The connectors 163' can be positioned on the extension members 161' such that an individual connector 163' aligns with an individual boat anchor bracket 805 when the bow 803 of the boat 800 engages the docking assist assembly 100'. When the boat 800 is not engaged with the docking assist assembly 100', the connectors 163' can be in an open configuration, shown in FIG. 16A. In the open configuration, the connectors 163' can receive the boat anchor brackets 805. When the boat 800 is engaged with the docking assist assembly 100', the connectors 163' can move from the open configuration to the closed configuration, shown in FIG. 16B, where the connectors 163' close around the boat anchor brackets 805 to secure the boat 800 to the docking assist assembly 100'.

In some aspects, the connectors 163' may be clips. In some aspects, the connectors 163' may be configured to open and close via remote control. In some aspects, the connection system 160' may include one or more sensors (not shown) configured to open and close the connectors 163'. In some aspects, the connectors 163' may be configured to close when engaged by the boat anchor brackets 805. For example, contact between the boat anchor brackets 805 and the connectors 163' may cause the connectors 163' to close around the boat anchor brackets 805. In this example, a boat operator may be required to manually open the connectors 163' to disengage the connectors 163' from the boat 800 prior to departure from the dock 105. In some aspects, the connectors 163' may include a locking system to prevent theft or any unauthorized users from disengaging the boat 800 from the docking assist assembly 100'. In some aspects, the boat anchor brackets 805 can be substantially vertical and the connectors 163' can be substantially horizontal, as shown in FIG. 14, or vice versa, as shown in FIGS. 16A and 16B.

While the docking assist assembly 100' is shown as including the connection system 160', it is recognized that any of the docking assist assemblies described herein (e.g., docking assist assembly 100, docking assist assembly 300, docking assist assembly 400, docking assist assembly 500, docking assist assembly 600, docking assist assembly 900, docking assist assembly 1000, docking assist assembly 1100, and/or the like) can include the connection system 160'.

Figure 17A:
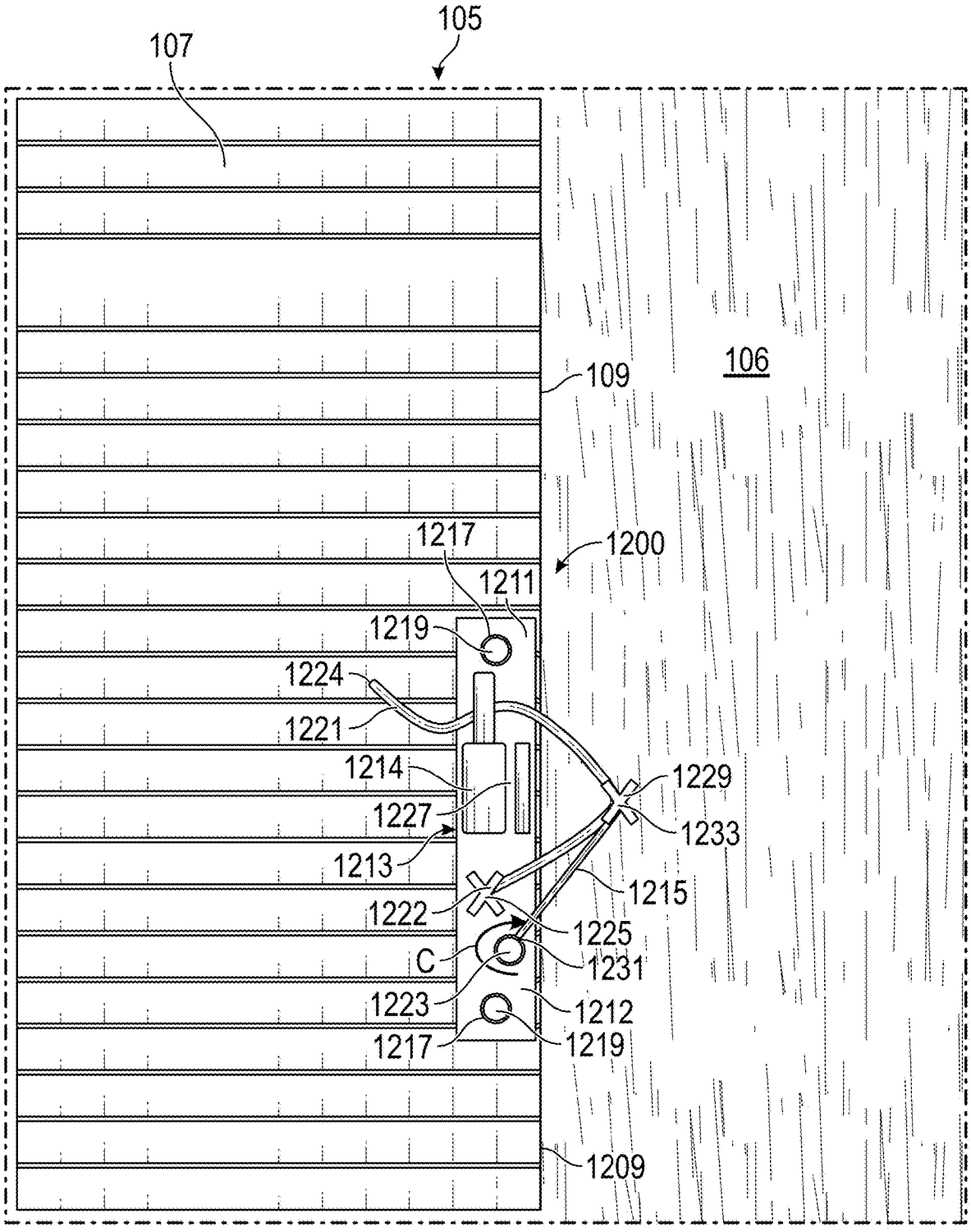
FIG. 17A is a diagram illustrating an embodiment of a rear docking assist assembly with an arm in an extended configuration.

FIG. 17A illustrates an embodiment of a rear docking assist assembly 1200 mounted on a dock 105. The rear docking assist assembly 1200 can be used to secure the rear portion of a boat to the dock. In some embodiments, the rear docking assist assembly 1200 can be used with any embodiment of a front docking assist assembly described with reference to FIGS. 1A-16B. In this case, the front docking assist assembly can be used to receive a front portion of the boat and the rear docking assist assembly 1200 can be used to secure the rear portion of the boat to the dock 105. In other embodiments, the rear docking assist assembly 1200 can be used independently of any front docking assist assembly.

The rear docking assist assembly 1200 can include a dock mounting portion 1211, a line brake 1213, an arm 1215, a line 1221, and an arm pivot assembly 1223. The dock mounting portion 1211 can be configured to secure the rear docking assist assembly 1200 to the dock 105. The dock mounting portion 1211 may be an elongate rectangular plate defining a plane with an upper side 1212 and a bottom side (not shown), such as a planar surface which is positioned against an upper surface 107 of the dock 105. The dock mounting portion 1211 may include mount holes 1217 extending through the dock mounting portion 1211 and a plurality of dock fasteners 1219 extending through the dock mounting portion 1211 and into the dock 105 to secure the dock mounting portion 1211 in place.

The line 1221 can be configured to secure the boat 800 to the dock 105. Line, as the term is used herein, is a broad term that can include, but is not limited to, a rope, a cord, a cable, a string, and a fiber. The line 1221 can include a first end 1222 and a second end 1224. The line 1221 can engage a rear portion of the boat 800 for securement to the dock 105 between the first and second ends 1222, 1224. The first end 1222 can be fixed to the dock mounting portion 1211 at the line mount 1225. The line mount 1225 is configured to secure the line 1221 to the dock mounting portion 1211. Any suitable connector can be used for the line mount 1225. In one aspect, the line mount 1225 may be a hook such that the line 1221 can be threaded through the hook and tied. In another aspect, the line mount 1225 can be a dock cleat. The second end 1224 of the line 1221 can be threaded through the line brake 1213. In one aspect, the second end 1224 may include a knot to prevent the line 1221 from being removed from the line brake 1213.

The line brake 1213 can be configured to selectively change the amount of slack in the line 1221. For example, more slack in the line 1221 is desirable when the boat 800 is being secured to the rear docking assist assembly 1200 and less slack is desirable once the boat 800 is secured to the rear docking assist assembly 1200 to prevent the boat 800 from drifting from the dock 105. One example of a line brake 1213 is a rope brake. The line brake 1213 can be fixed to the upper side 1212 of the dock mounting portion 1211. The line brake 1213 is configured to releasably secure the line 1221. The second end 1224 of the line 1221 can extend through the line brake 1213. The line brake 1213 can move between a first/engaged configuration and a second/disengaged configuration. In the engaged configuration, the line 1221 is secured to the line brake 1213 and is prevented from sliding through the line brake 1213. In the disengaged configuration, the line 1221 can travel through the line brake 1213 such that the amount of slack in the line 1221 can change. In one aspect, the line brake 1213 can include a foot release 1214. The foot release 1214 can be used to change the line 1221 from the engaged configuration to the disengaged configuration. For example, a user can apply pressure to the foot release 1214 (e.g., by stepping on the foot release 1214) such that the line brake 1213 moves to the disengaged configuration and the line 1221 can freely travel through the line brake 1213. Any suitable line or rope braking system can be used for the line brake 1213. For example, the Petzl PRO TRAXION Pulley Rope Clamp or the Harken Carbo Ratchamatic® Footblock can be used as the line brake 1213. Another example of a line brake 1213 that can be used with the rear docking assist assembly 1200 is described with reference to FIGS. 19A and 19B below.

Figure 17B:
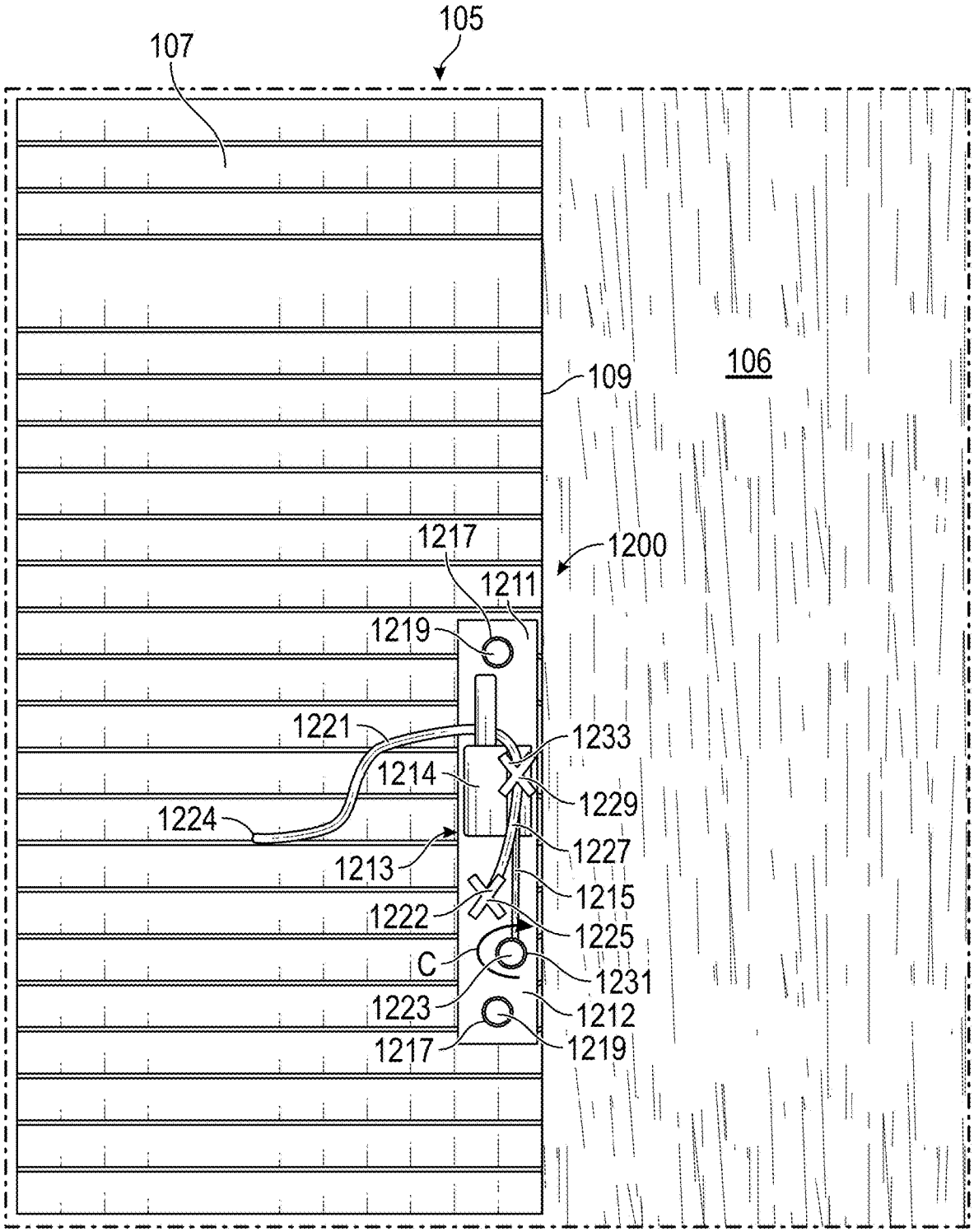
FIG. 17B is a diagram illustrating the rear docking assist assembly of FIG. 17A with the arm in the retract configuration.
Figure 17C:
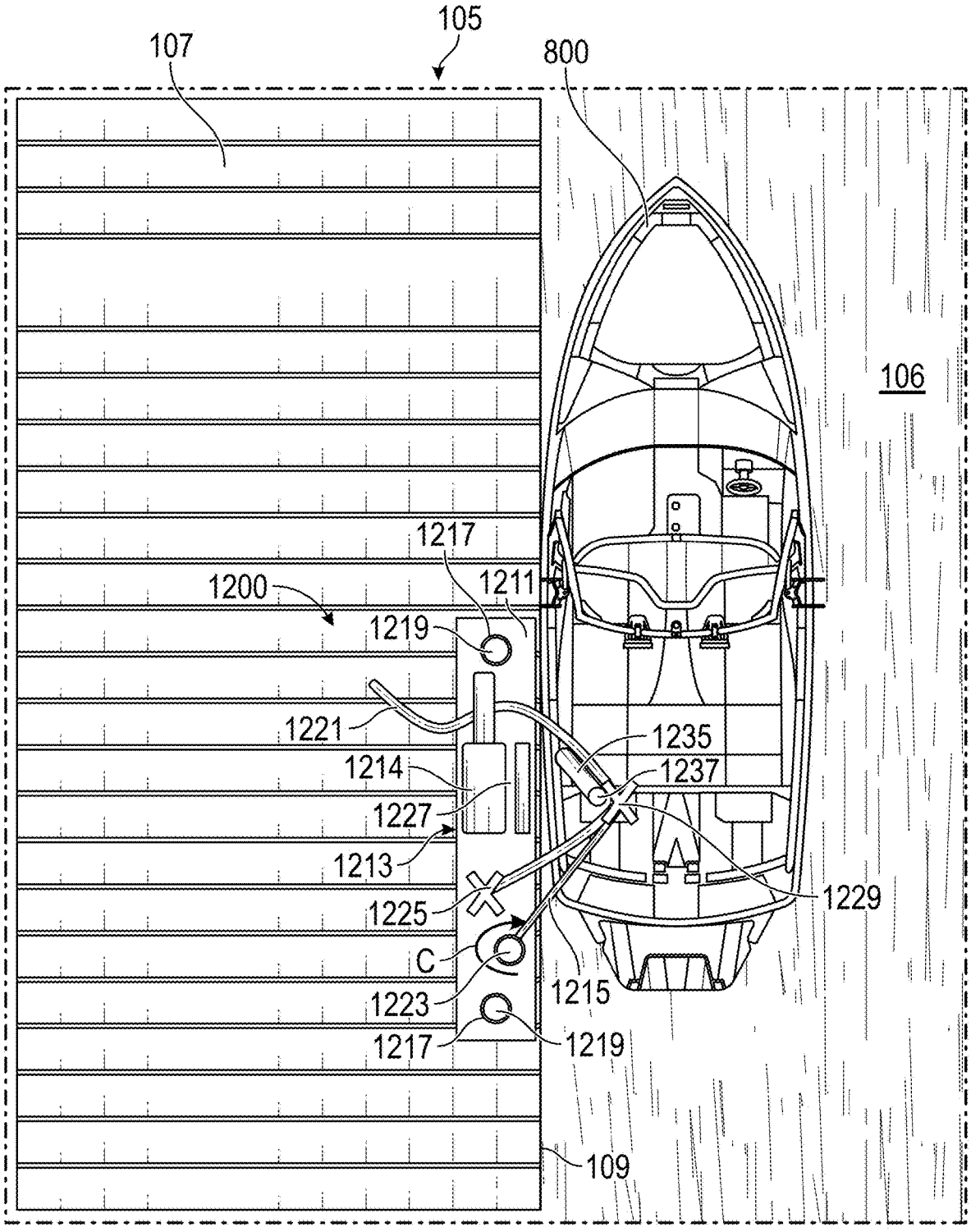
FIG. 17C is a diagram illustrating a boat engaged with the rear docking assist assembly of FIG. 17A.

The arm 1215 is configured to support the line 1221 and allow the line 1221 to extend over the water 106 to engage a portion of a boat 800 (see e.g., FIG. 17C). When the arm 1215 and the line 1221 are suspended over the water 106, the rear docking assist assembly 1200 can secure the rear portion of the boat 800 to the rear docking assist assembly 1200. The arm 1215 can include a first end 1231 and a second end 1233. The first end 1231 can be fixed to the arm pivot assembly 1223. In one aspect, the first end 1231 may be coupled to the arm pivot assembly 1223 via a mechanical joint (not shown). The joint may allow the arm 1215 to move relative to the arm pivot assembly 1223 in at least a first degree of motion. For example, the joint may allow the second end 1233 of the arm 1215 to pivot in the vertical direction (e.g., away from and towards the dock mounting portion 1211). The second end 1233 can include a line connector 1229. The line connector 1229 allows the arm 1215 to support and engage the line 1221 between the first end 1222 and the second end 1224. In one aspect, the line connector 1229 can be a clip that can engage and disengage with the line 1221. The line connector 1229 allows the line 1221 to move relative to the line connector 1229. For example, a user can pull the line 1221 through the line connector 1229. In one aspect, the arm 1215 may be a rod. In one aspect, the arm 1215 can be a plastic, a metal, a rubber, and/or the like. In some implementations, it may be preferable for the arm 1215 to be rigid and bendable. For example, the arm 1215 must be sufficiently rigid to support the line 1221 with minimal bending but can also be flexible enough that the arm 1215 can bend/deflect if the arm 1215 contacts the side of the boat 800. For example, it can be desirable for the arm 1215 to deflect when contacting the boat 800 to prevent damage to the boat 800.

The arm pivot assembly 1223 is configured to allow the arm 1215 and the line 1221 to move relative to the rear docking assist assembly 1200. The arm pivot assembly 1223 can be fixed to the dock mounting portion 1211. The arm pivot assembly 1223 is coupled to the first end 1231 of the arm 1215. The arm pivot assembly 1223 is rotationally moveable relative to the dock mounting portion 1211. For example, the arm pivot assembly 1223 can rotate about an axis of rotation C. In one aspect, the arm pivot assembly 1223 may be a pivot assembly including a shaft and a bearing assembly. Rotation of the arm pivot assembly 1223 can allow the arm 1215 to move between an extend configuration and a retracted configuration. The extended configuration is shown in FIG. 17A, where the second end 1233 of the arm 1215 and a portion of the line 1221 are extended over the water 106. In this configuration, the line 1221 can engage the boat 800. The retracted configuration is shown in FIG. 17B, where the arm 1215 and the line 1221 are positioned over the dock 105.

In one aspect, the arm 1215 may be coupled to the arm pivot assembly 1223 with the first end 1231 at a fixed height relative to the upper surface 107 of the dock 105. The height may be determined by the height of the stern of the boat 800. The height can be between 0 and 5 feet (e.g., less than 5 feet, less than 4 feet, less than 3 feet, less than 2 feet, and/or less than one foot).

With reference to FIG. 17B, which shows the arm 1215 in the retracted configuration, the rear docking assist assembly 1200 can include an arm holder 1227. The arm holder 1227 may be a portion of the line brake 1213, the dock mounting portion 1211, or a separate component fixed to the dock mounting portion 1211. The arm holder 1227 is configured to secure the arm 1215 in the retracted configuration. The arm holder 1227 can be a slot or groove in the rear docking assist assembly 1200. In one aspect, the arm holder 1227 can include a securing mechanism, such as a clip to engage and secure the arm 1215. Placing the arm 1215 in the arm holder 1227 may provide advantages such as allowing people to swim near the dock 105 without interference and/or preventing the arm 1215 from moving relative to the rear docking assist assembly 1200 when movement is not desired.

Referring now to FIG. 17C, in use, the dock mounting portion 1211 of the rear docking assist assembly 1200 may be fixed to the dock 105, which is positioned over and/or adjacent to a body of water 106 such that the docking portion 1211 is near an elongate dock edge 109 that is adjacent to a pre-determined boat parking area of the body of water. The dock mounting portion 1211 may run parallel to the edge 109 of the dock 105. The rear docking assist assembly 1200 is configured to engage with and secure a rear portion or the stern of a boat, such as the boat 800. The rear docking assist assembly 1200 can engage with an engagement portion 1235. The engagement portion 1235 can be mounted to the boat 800 near the stern. In some aspects, the engagement portion 1235 may be removably coupled to the boat 800. The engagement portion 1235 can be mounted on the side of the boat 800 closest to the dock 105 when the boat 800 is parked. In one aspect, the engagement portion 1235 can include an upper member 1237 that is configured to engage the line 1221. In one aspect, the upper member 1237 can include a ball portion, similar to the trailer ball of a trailer hitch. In one aspect, the engagement portion 1235 can extend at an angle relative to the boat 800. For example, the engagement portion 1235 can be angled moving from the bow to the stern of the boat 800. An angled engagement portion 1235 can provide advantages when the boat 800 engages the rear docking assist assembly 1200, as described below.

When a boat operator approaches the dock 105 to park the boat, the boat operator may drive the boat at a low speed or coast towards the dock 105. When the rear docking assist assembly 1200 is used with a front docking assist assembly (e.g., docking assist assembly 100), the boat operator may first engage the boat's bow with the bow retaining portion (e.g., bow retaining portion 151) to absorb some of the incoming force of the boat. However, the rear docking assist assembly 1200 can be used without any other docking assemblies. As the boat 800 coasts along the elongate dock edge 109 of the dock 105, the arm 1215 may be in the extended configuration with a portion of the line 1221 suspended above the water 106. The arm 1215 can pass over the bow and hull of the boat 800 before contacting the engagement portion 1235. The boat 800 can travel along the arm 1215 until the line connector 1229 passed over the engagement portion 1235. At this point, the line 1221 also passes over the upper member 1237 and the line 1221 is lassoed around the upper member 1237. To secure the boat 800 to the dock 105, the user can engage the line brake 1213 such that the line brake 1213 moves into the disengaged configuration (e.g., using the foot release 1214) and pull the line 1221 further through the foot release 1214, which tightens the line 1221 on the engagement portion 1235. When the line 1221 is at a desired tightness, for example, when the boat 800 is secured to the dock 105 with minimal slack in the line 1221, the user can release the line brake 1213 such that the line brake 1213 moves into the engaged configuration and the line 1221 is secured. With the stern of the boat 800 secured to the rear docking assist assembly 1200, the user can tie off the boat, such as tying the bow of the boat 800 to the dock 105. However, if the rear docking assist assembly 1200 was used with a front docking assist assembly, the bow of the boat 800 may already be secured to the dock 105.

In one aspect, the rear docking assist assembly 1200 may be removable from the dock 105 once fixed, which may have the advantage of allowing the rear docking assist assembly 1200 to be stored when not in use, such as, during the winter months in colder climates. To facilitate such removal, the rear docking assist assembly may desirably weigh less than 300 pounds, 200 pounds, 100 pounds, 150 pounds, 125 pounds, 100 pounds, 75 pounds or 50 pounds.

In one aspect, the rear docking assist assembly 1200 may be reversible, such that it may be used on either side of the dock 105. For example, when the rear docking assist assembly 1200 is installed on one side of the dock 105, the right or starboard side of the boat 800 would be closest to the dock 105, and when the rear docking assist assembly 1200 is installed on the other side of the dock 105, as in FIG. 17A, the left or port side of the boat 800 would be closest to the dock 105. The rear docking assist assembly 1200 may be reversible by, for example, the mounting portion 1211 being reversible such that the mounting portion 1211 may be fixed to the dock 105 with either side facing the upper side 107 of the dock 105. In another aspect, the rear docking assist assembly 1200 may be reversible by, for example, the arm 1215 being able to be pivot approximately 360 degrees via the arm pivot assembly 1223. Being reversible may have the advantage of allowing the rear docking assist assembly 1200 to be used on any dock, no matter which side of the dock is adjacent to the water 106. An additional advantage may be that two rear docking assist assemblies 100 could be used on the same dock to allow one or more boats to be parked on each side of the dock 105.

In one aspect, the first end 1231 of the arm 1215 may be coupled to the arm pivot assembly 1223 with a mechanical assembly that includes a damping mechanism. For example, when a user lifts the second end 1233 of the arm 1215 away from the dock, the damping mechanism can be configured to allow the second end 1233 to slowly descend towards the upper surface 107 of the dock 105. Having a damping mechanism may provide certain advantages of allowing the arm 1215 to be moved into the extended configuration with the second end 1233 positioned at a height above the upper surface of the boat 800 without contacting the boat 800. This may be beneficial when docking the boat 800 to protect the boat 800 from the arm 1215 and for undocking the boat 800 to allow the boat operator to lift the arm 1215 away from the boat 800 and undock the boat 800 without the arm 1215 falling and hitting the boat 800 again. In some aspects, the second end 1233 can be moved to a maximum height and may descend towards the dock 105 in less than 5 minutes, less than 4 minutes, less than 3 minutes, less than 2 minutes, less than 1 minute, and/or less than 30 seconds.

In one aspect, the mounting portion 1211 may be a metal plate. In some aspects, the mounting portion 1211 may be made of a galvanized, anodized, and/or the like material to prevent water damage. In some aspects, the dock fasteners 1219 may be, for example, screws, bolts, and/or the like such that the rear docking assist assembly 1200 may be removed and reinstalled to the dock 105 repeatedly. In one aspect, the rear docking assist assembly 1200 may include one or more resilient members configured to be positioned between the elongate dock edge 109 and the boat 800. The resilient members can be configured to protect the boat 800 from the elongate dock edge 109, similar to the dock bumpers 187 described with reference to at least FIG. 13.

Figure 20:
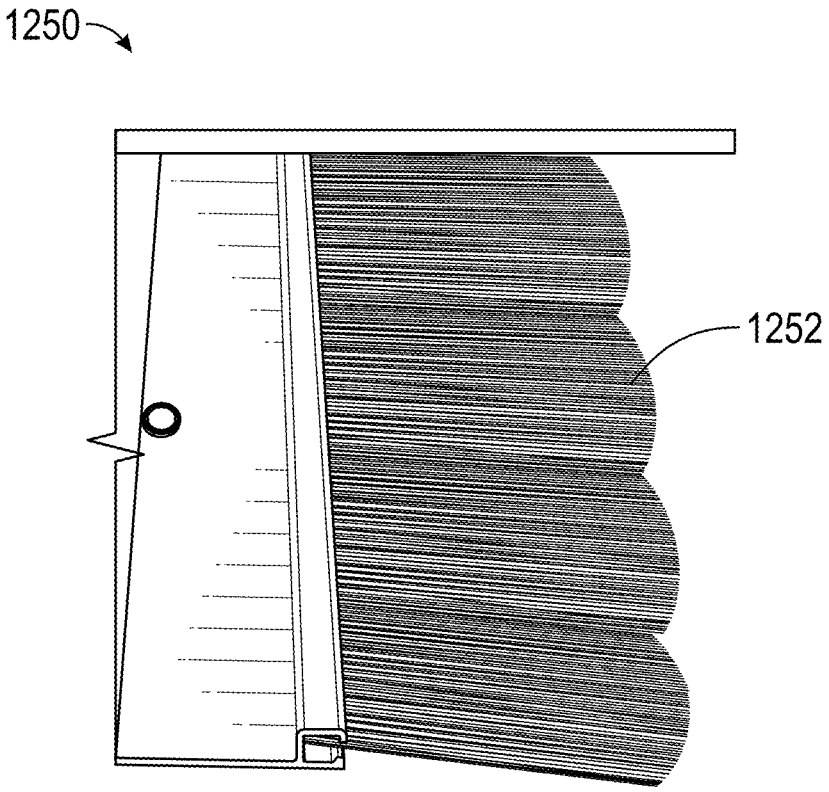
FIG. 20 is a diagram illustrating an embodiment of a sealing mechanism of the rear docking assist assembly of FIG. 17A.

In one aspect, the rear docking assist assembly 1200 may include one or more sealing systems to protect the internal components from debris. For example, the arm holder 1227 can include a scaling mechanism, such as the brush seal 1250 shown in FIG. 20. The brush seal 1250 can be positioned such that the bristles 1252 extend over the arm holder 1227. When a user positions the arm 1215 in the arm holder 1227, the arm 1215 may pass through the bristles 1252 and be covered in the arm holder 1227 beneath the bristles 1252.

In one aspect, the arm 1215 may be configured to contact the side and/or top portions of the boat 800 when docking. The arm 1215 can be sufficiently flexible such that the arm 1215 travels along the boat 800 without damaging or scratching the boat 800. For example, the arm 1215 may be configured to partially deform under pressure.

In one aspect, the rear docking assist assembly 1200 can be motorized, such that the arm 1215 can move between the retracted configuration and the extended configuration without the user physically moving the arm 1215. For example, the arm 1215 can be coupled to the arm pivot assembly 1223 via a motorized assembly such that the motorized arm pivot assembly 1223 can controllably move the second end 1233 away from and towards the upper surface 107 of the dock 105. Additionally or alternatively, the arm pivot assembly 1223 can be motorized to move the arm 1215 about the axis of rotation C. In some aspects, when the rear docking assist assembly 1200 includes a motorized arm pivot assembly 1223, the line brake 1213 may also be motorized and may be in electronic communication with the arm pivot assembly 1223. For example, when the arm pivot assembly 1223 moves the arm 1215 such that additional slack is required in the line 1221, the line brake 1213 can move into the disengaged configuration. Similarly, when the arm pivot assembly 1223 sets the position for the arm 1215, the line brake 1213 can return to the engaged configuration.

In some aspects, the rear docking assist assembly 1200 can include one or more sensors that are configured to detect when either the boat 800 or the engagement portion 1235 is in close proximity to the rear docking assist assembly 1200. The sensors can control the motorized arm pivot assembly 1223 such that the arm 1215 is moved into the extended configuration as the boat 800 approaches the dock 105. A motorized arm pivot assembly 1223 can provide a benefit of allowing the boat operator to park the boat 800 and used the rear docking assist assembly 1200 without the arm 1215 contacting the boat 800.

In one aspect, the height of the first end 1231 of the arm 1215 relative to the upper surface 107 of the dock 105 can be adjustable. For example, the user can set the desired height of the first end 1231 based on their boat's 800 height.

In one aspect, the position of the arm pivot assembly 1223 on the dock mounting portion 1211 can be adjustable. For example, a user can move the arm pivot assembly 1223 relative to the dock mounting portion 1211 (e.g., in a direction from top to bottom and bottom to top as shown in FIG. 17A) as required for their boat 800.

In one aspect, the arm pivot assembly 1223 can include a spring mechanism configured to move the arm 1215 into the extended configuration. For example, the spring mechanism may bias the arm 1215 towards the extended configuration when the arm 1215 is not secured within the arm holder 1227.

In one aspect, the engagement portion 1235 may be a boat cleat. For example, the boat cleat 1235 may form a portion of the boat 800. In some aspects, the engagement portion 1235 can be a component configured to be attached to the rear portion of the boat 800. In some aspects, the engagement portion 1235 can be a rod. The rod 1235 can extend at an angle vertically from an upper surface of the boat 800 and/or the mounting portion 1211. For example, the angle can be less than 60 degrees, less than 45 degrees, less than 30 degrees, less than 15 degrees, etc.

In some embodiments, some, or all of the components of the rear docking assist assembly 1200 may be colored to match color of a user's boat 800. For example, a user may be able to customize the color of the rear docking assist assembly 1200 to match the color of the boat 800.

Figure 18A:
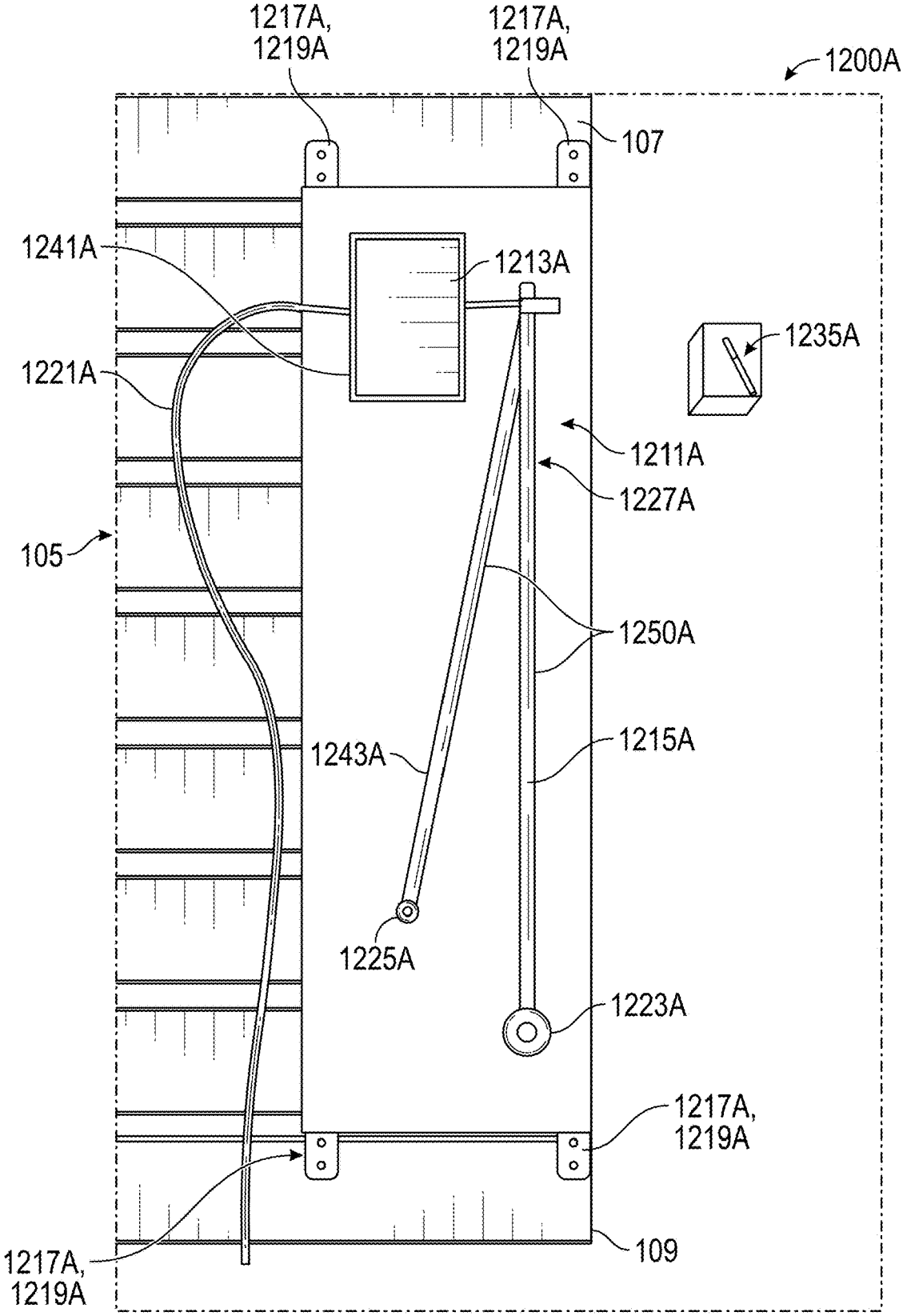
FIG. 18A is a diagram illustrating an embodiment of a rear docking assist assembly with an arm in the retracted configuration.
Figure 18B:
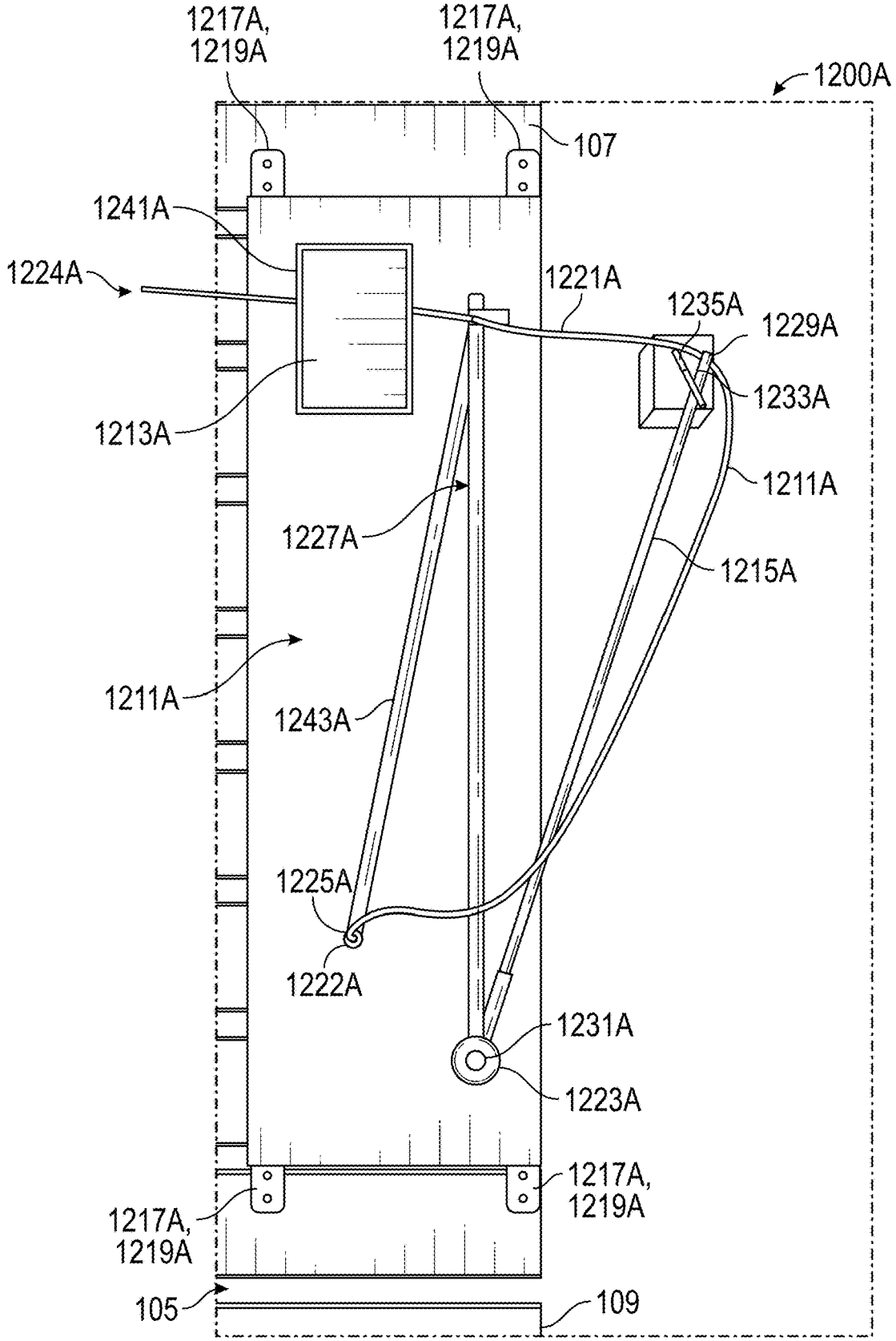
FIG. 18B is a diagram illustrating the rear docking assist assembly of FIG. 18A with the arm in the extended configuration.

FIGS. 18A and 18B illustrate an embodiment of a rear docking assist assembly 1200A. Some of the features of the rear docking assist assembly 1200A are similar to features of the rear docking assist assembly 1200 in at least FIGS. 17A-17C. Thus, reference numerals used to designate the various features or components of the rear docking assist assembly 1200 are identical to those used for identifying the corresponding features of components of the rear docking assist assembly 1200A in FIGS. 18A and 18B, except that an "A" has been added to the numerical identifier for the rear docking assist assembly 1200A. Therefore, the structure and description for the various features of the rear docking assist assembly 1200 and how it's operated in at least FIGS. 17A-17C are understood to also apply to the corresponding features of the rear docking assist assembly 1200A in FIGS. 18A and 18B, except as described below.

FIG. 18A shows the rear docking assist assembly 1200A with the arm 1215A in the retracted configuration. FIG. 18B shows the rear docking assist assembly 1200A with the arm 1215A in the extended configuration. In FIG. 18B, the line 1221A is engaged with a schematically illustrated engagement portion 1235A shown in isolation (e.g., not on the boat 800). The rear docking assist assembly 1200A differs from the rear docking assist assembly 1200 in that the mount holes 1217A of the dock mounting portion 1211A are configured as brackets. The rear docking assist assembly 1200A can include a seal 1241A positioned around the line brake 1213A. The seal 1241A may be configured to prevent debris from entering the line brake 1213A. The rear docking assist assembly 1200A can include a line holder 1243A. The line holder 1243A may be shaped and function in a similar manner as the arm holder 1227A. The line holder 1243A is configured to secure the line 1221A when the arm 1215A is in the retracted configuration. The line holder 1243A can include a seal 1250A. One or both of the seal 1241A and the line holder seal 1250A can be brush seals, such as the brush seal 1250 of FIG. 20. It is recognized that the rear docking assist assembly 1200 can include the additional features described with reference to FIGS. 18A and 18B.

Figure 19A:
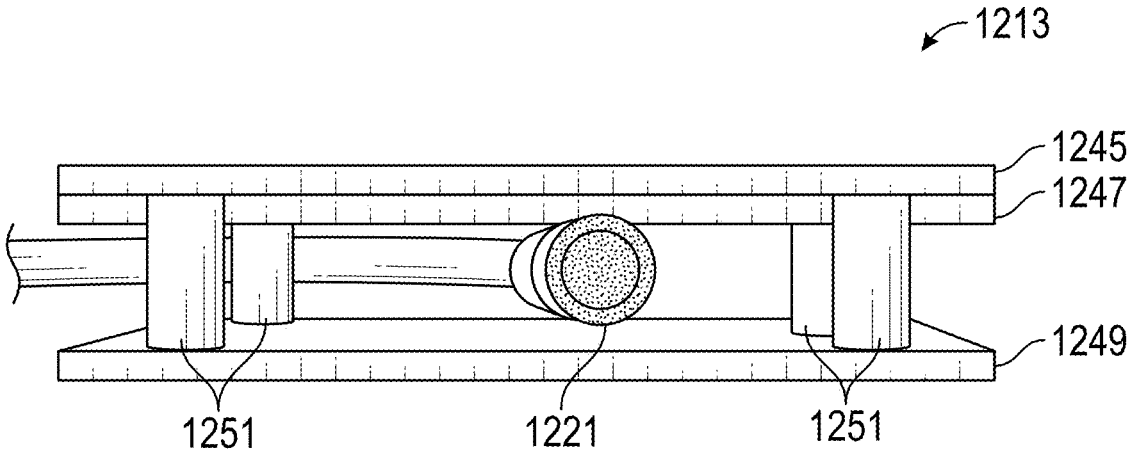
FIG. 19A is a diagram illustrating an embodiment of a line brake in a disengaged configuration.
Figure 19B:
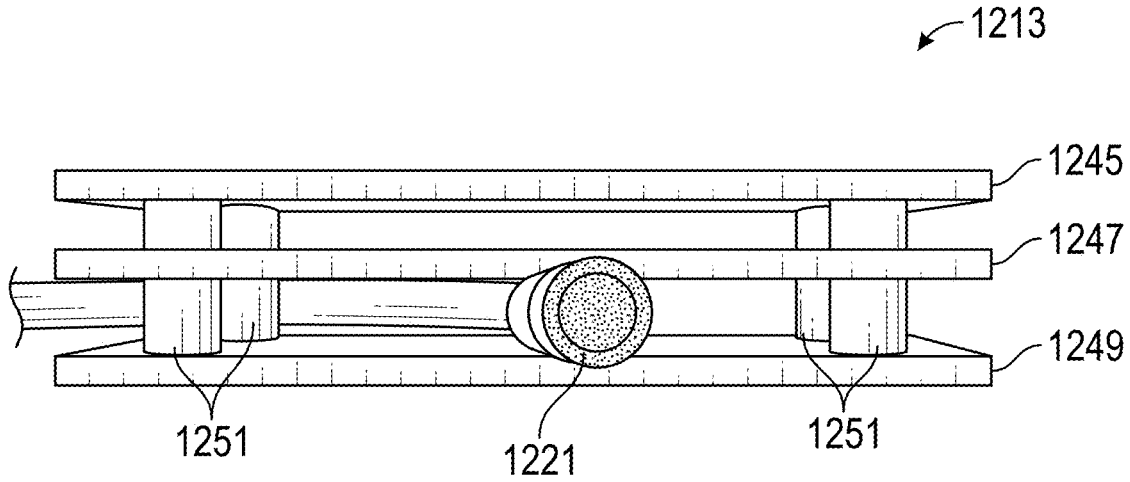
FIG. 19B is a diagram illustrating the line brake of FIG. 19A in the engaged configuration.

FIG. 19A shows an embodiment of the line brake 1213 in a disengaged configuration and FIG. 19B shows the line brake 1213 is an engaged configuration. The line brake 1213 can include an actuator plate 1245, a guide plate 1247, a base plate 1249, and a plurality of guide members 1251. The actuator plate 1245 is positioned furthest away from the dock mounting portion 1211 and the base plate 1249 is positioned in a cavity of the dock mounting portion 1211 with the guide plate 1247 therebetween. The actuator plate 1245 can be coupled to the base plate 1249 via the plurality of guide members 1251. The guide plate 1247 can include holes (not shown), that allow the plurality of guide members 1251 to pass through the guide plate 1247. The line 1221 can be threaded between the guide plate 1247 and the base plate 1249. The guide plate 1247 can be fixed relative to the dock mounting portion 1211. Movement of the actuator plate 1245 and the base plate 1249 can cause the guide plate 1247 to be engaged and disengaged with the line 1221. The actuator plate 1245 can be configured to be engaged by a user (e.g., a user's foot). Engagement of the actuator plate 1245 causes the base plate 1249 to move further into the cavity of the dock mounting portion 1211 such that the guide plate 1247 disengages the line 1221 and the line 1221 can move freely relative to the line brake 1213. The dock mounting portion 1211 can include a spring mechanism (not shown) positioned between the cavity of the dock mounting portion 1211 and the bottom side of the base plate 1249. When the user engages the actuator plate 1245, the spring mechanism becomes compressed. When the user disengaged the actuator plate 1245, the spring mechanism elongates, pushing the actuator plate 1245 and the base plate 1249 away from the dock mounting portion 1211.

Figure 21A:
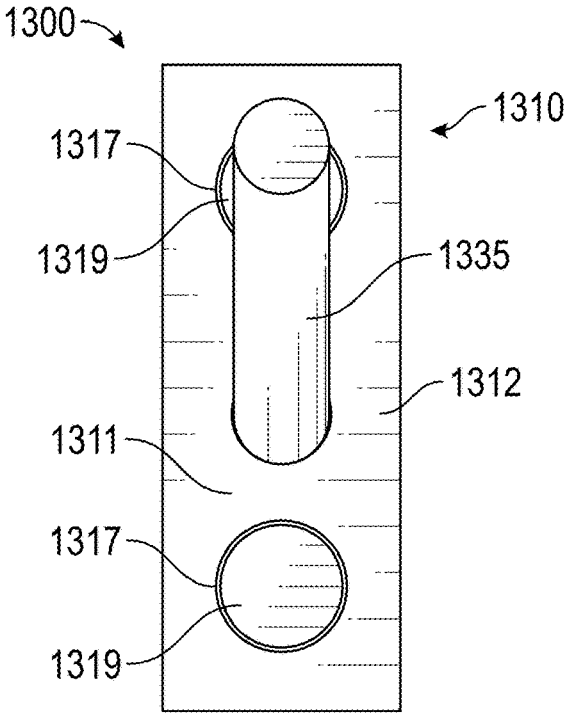
FIG. 21A is a diagram illustrating an embodiment of a dock portion of a rear docking assist assembly.
Figure 21B:
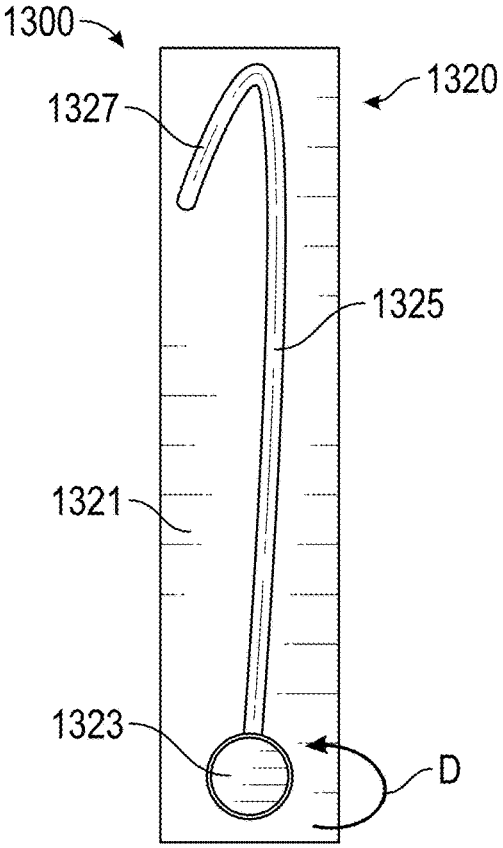
FIG. 21B is a diagram illustrating an embodiment of a boat portion of the rear docking assist assembly of FIG. 21A.
Figure 22A:
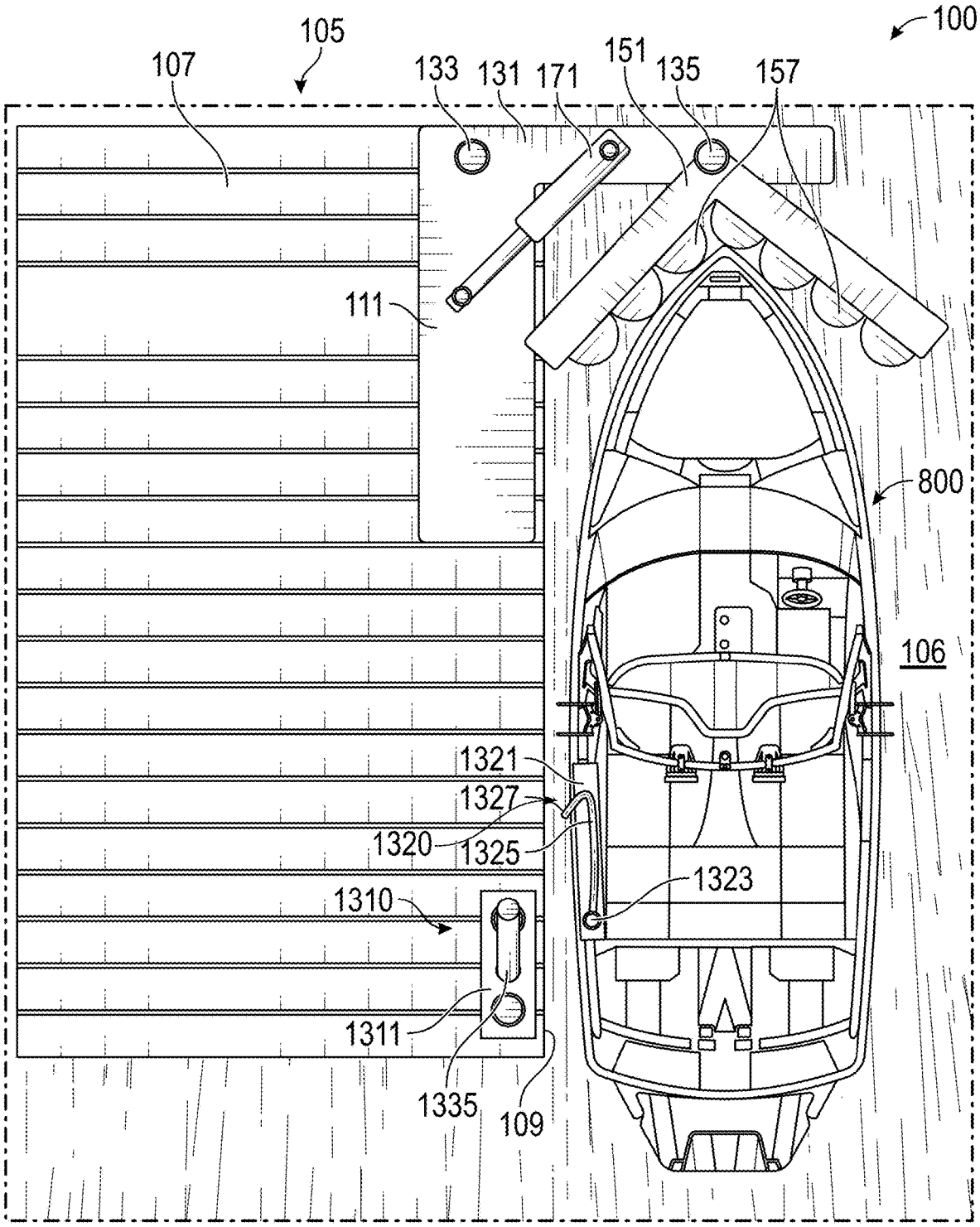
FIG. 22A is a diagram illustrating a boat engaged with the front docking assist assembly of FIG. 1A and the rear docking assist assembly of FIGS. 21A and 21B with an arm in a retracted configuration.
Figure 22B:
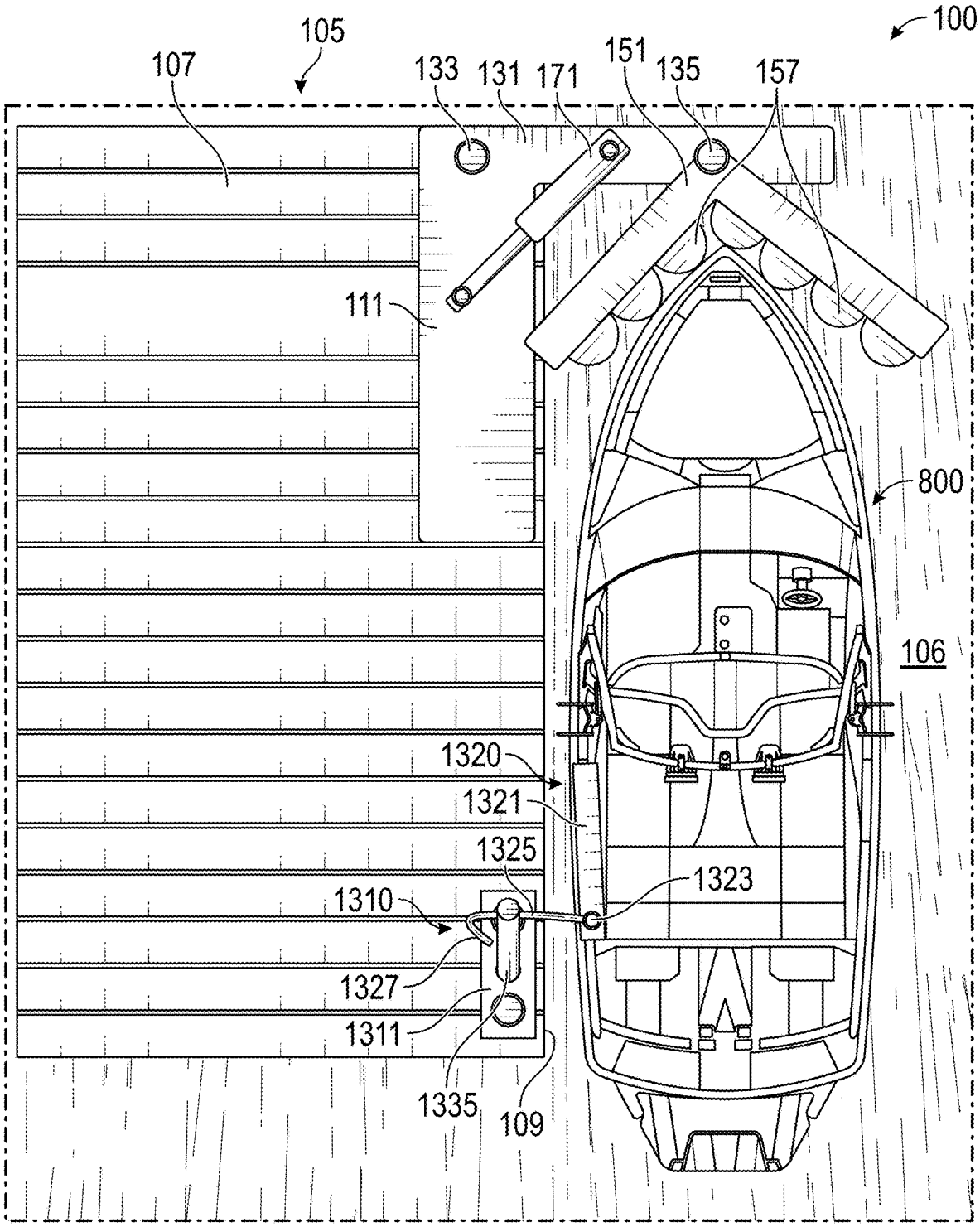
FIG. 22B is a diagram illustrating a boat engaged with the front docking assist assembly of FIG. 1A and the rear docking assist assembly of FIGS. 21A and 21B with the arm in an extended configuration.

FIGS. 21A and 21B illustrate an embodiment of a rear docking assist assembly 1300. The rear docking assist assembly can include a dock portion 1310 and a boat portion 1320. In some implementations, the rear docking assist assembly 1300 may only include the boat portion 1320. As shown in FIGS. 22A and 22B, the rear docking assist assembly 1300 can be used to secure the rear portion of a boat 800 to the dock 105. In some embodiments, the rear docking assist assembly 1300 can be used with any embodiment of a front docking assist assembly described with reference to FIGS. 1A-16B. For example, as shown in FIGS. 22A and 22B, the front docking assist assembly 100 can be used to receive a front portion of the boat 800 and the rear docking assist assembly 1300 can be used to secure the rear portion of the boat 800 to the dock 105. In other implementations, the rear docking assist assembly 1300 can be used independently of any front docking assist assemblies.

Referring to FIG. 21A, the dock portion 1310 can include a dock mounting portion 1311 and a post 1335. The dock mounting portion 1311 may be an elongate rectangular plate defining a plane with an upper side 1312 and a bottom side (not shown), such as a planar surface which is positioned against the upper surface 107 of the dock 105. The dock mounting portion 1311 may include mount holes 1317 extending through the dock mounting portion 1311 and one or more dock fasteners 1319 extending through the dock mounting portion 1311 and into the dock 105 to secure the dock mounting portion 1311 in place. The post 1335 can extend vertically from the dock mounting portion 1311 and can be configured to engage a portion of the boat portion 1320 to secure the boat 800 to the dock 105. As shown in FIGS. 22A and 22B, when used with the docking assist assembly 100, the dock portion 1310 can be fixed to the dock 105 and positioned away from the docking assist assembly 100 such that the dock portion 1310 aligns with the boat portion 1320 when the boat 800 is engaged with the docking assist assembly 100.

Turning to FIG. 21B, the boat portion 1320 of the rear docking assist assembly 1300 can include a boat mounting portion 1321, arm pivot assembly 1323, and an arm 1325. The boat mounting portion 1321 can be used to fix the boat portion 1320 to a rear side of the boat 800. The boat mounting portion 1321 can be fixed to the side of the boat 800 that is closest to the dock 105 when docked (e.g., the port side of the boat 800 in FIGS. 22A and 22B). The arm 1325 can be coupled to the boat mounting portion 1321 via the arm pivot assembly 1323 (e.g., a mechanical joint). The arm pivot assembly 1323 can be fixed to the boat mounting portion 1321. The arm 1325 is rotationally moveable relative to the dock mounting portion 1311. For example, the arm 1325 can rotate about an axis of rotation D. The arm 1325 can include a hook 1327 for engaging the post 1335. In one aspect, the arm pivot assembly 1323 may be a pivot assembly including a shaft and a bearing assembly. The arm pivot assembly 1323 can allow the arm 1325 to rotate relative to the boat mounting portion 1321 in use in at least a first degree of motion (e.g., along the plane defined by the upper surface 107 of the dock 105). For example, the arm pivot assembly 1323 may allow the arm 1325 to pivot away from the boat 800 and towards the dock 105 in use. As shown in FIGS. 22A and 22B, rotation of the arm pivot assembly 1323 can allow the arm 1325 to move between an extended configuration and a retracted configuration. The retracted configuration is shown in FIG. 22A, where the arm 1325 is positioned over the boat 800. The extended configuration is shown in FIG. 22B, where the hook 1327 of the arm 1325 is extended over the dock 105. In this configuration, the hook 1327 can engage the post 1335.

In one aspect, the arm 1325 may be coupled to the arm pivot assembly 1323 with the hook 1327 at a fixed height relative to the upper surface 107 of the dock 105. The height may be determined by the height of the stern of the boat 800. In some aspects, the height can be between 0 and 5 feet (e.g., less than 5 feet, less than 4 feet, less than 3 feet, less than 2 feet, and/or less than one foot).

Referring to FIG. 22A, in use, the dock mounting portion 1311 of the rear docking assist assembly 1300 may be fixed to the dock 105, which is adjacent to the body of water 106 such that the docking portion 1311 is near an elongate dock edge 109 that is adjacent to a pre-determined boat parking area of the body of water. The dock mounting portion 1311 may run parallel to the edge 109 of the dock 105. The rear docking assist assembly 1300 is configured to engage with and secure a rear portion or the stern of a boat, such as the boat 800. The boat portion 1320 of the rear docking assist assembly 1300 can engage the dock portion 1310 of the rear docking assist assembly 1300. The boat portion 1320 can be mounted to the boat 800 via the boat mounting portion 1321 near the stern. The boat mounting portion 1321 is mounted on the side of the boat 800 closest to the dock 105 when the boat 800 is parked.

When a boat operator approaches the dock 105 to park the boat 800, the boat operator may drive the boat 800 at a low speed or coast towards the dock 105. When the rear docking assist assembly 1300 is used with a front docking assist assembly (e.g., docking assist assembly 100), the boat operator may first engage the boat's bow with the bow retaining portion to absorb some of the incoming force of the boat. However, the rear docking assist assembly 1300 can be used without any other docking assemblies. As the boat 800 coasts along the elongate dock edge 109 of the dock 105, the arm 1325 may be in the retracted configuration, so as to prevent contact between the arm 1325 and the post 1335. The boat 800 can travel along the dock edge 109 until arm pivot assembly 1323 is past the post 1335. To secure the boat 800 to the dock 105, the arm 1325 can be rotated via the arm pivot assembly 1323 such that arm 1325 moves into the extended configuration and the hook 1327 engages the post 1335. With the stern of the boat 800 secured via the rear docking assist assembly 1300, the user can tie off the boat, such as tying the bow of the boat 800 to the dock 105. However, if the rear docking assist assembly 1300 was used with a front docking assist assembly, the bow of the boat 800 may already be secured to the dock 105. When the arm 1325 is in the extended configuration, the boat 800 is restricted from reversing away from the dock 105 because of the contact between the arm 1325 and the post 1335. To disembark from the dock, the arm 1325 can be rotated back to the retracted configuration.

In one aspect, the dock portion 1310 of the rear docking assist assembly 1300 may be removable from the dock 105 once fixed, which may have the advantage of allowing the dock portion 1310 to be stored when not in use, such as, during the winter months in colder climates. To facilitate such removal, the dock portion 1310 may desirably weigh less than 100 pounds, 50 pounds, 25 pounds, or 10 pounds.

In one aspect, the mounting portion 1311 may be a metal plate. In some aspects, the mounting portion 1311 may be made of a galvanized, anodized, and/or the like material to prevent water damage. In some aspects, the dock fasteners 1319 may be, for example, screws, bolts, and/or the like such that the dock portion 1310 may be removed and reinstalled to the dock 105 repeatedly.

In one aspect, the boat portion 1320 of the rear docking assist assembly 1300 can be motorized, such that the arm 1325 can move between the retracted configuration and the extended configuration without the user physically moving the arm 1325. For example, the arm 1325 can be coupled to the arm pivot assembly 1323 via a motorized assembly such that the motorized arm pivot assembly 1323 can controllably move the hook 1327 away from and towards the boat 800. For example, the arm pivot assembly 1323 can be motorized to move the arm 1325 about the axis of rotation D.

In some aspects, the rear docking assist assembly 1300 can include one or more sensors that are configured to detect when either the boat 800 or the boat portion 1320 is in close proximity to the dock portion 1310. The sensors can control the motorized arm pivot assembly 1323 such that the arm 1325 is moved into the extended configuration after the boat 800 passes the post 1335. A motorized arm pivot assembly 1323 can provide a benefit of allowing the boat operator to park the boat 800 and used the rear docking assist assembly 1300 without manually adjusting the position of the arm 1325.

In one aspect, the arm pivot assembly 1323 can include a spring mechanism configured to move the arm 1325 into the extended configuration. For example, the spring mechanism may bias the arm 1325 towards the extended configuration when the arm 1235 is not secured within an arm holder (not shown) of the boat portion 1320.

In some embodiments, some, or all of the components of the rear docking assist assembly 1300 may be colored to match color of a user's boat 800. For example, a user may be able to customize the color of the rear docking assist assembly 1300 to match the color of the boat 800.

Additional Embodiments

While certain embodiments of the inventions have been described, these embodiments have been presented by way of example only and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Example Clauses

Examples of implementations of the present disclosure can be described in view of the following example clauses. The features recited in the below example implementations can be combined with additional features disclosed herein. Furthermore, additional inventive combinations of features are disclosed herein, which are not specifically recited in the below example implementations, and which do not include the same features as the specific implementations below. For sake of brevity, the below example implementations do not identify every inventive aspect of this disclosure. The below example implementations are not intended to identify key features or essential features of any subject matter described herein. Any of the example clauses below, or any features of the example clauses, can be combined with any one or more other example clauses, or features of the example clauses or other features of the present disclosure.

Clause 1. A docking assist assembly, comprising: a mounting portion configured to be supported by an upper surface of a dock; an arm portion extending transverse to the mounting portion; and a bow retaining portion including a first side and a second side, the first side defining a first surface facing at least partially toward the second side and a second side defining a second surface at least partially facing toward the first side, said first side and said second side configured to receive a bow of a boat at least partially between the first side and the second side; wherein at least one of the arm portion and the bow retaining portion is movable relative to the mounting portion so as to at least partially absorb a docking impact force of a boat.

Clause 2. The docking assist assembly of clause 1, wherein the first side and the second side of the bow retaining portion are no longer than 8 feet long.

Clause 3. The docking assist assembly of clause 1, wherein the first side and the second side of the bow retaining portion are no longer than 6 feet long.

Clause 4. The docking assist assembly of clause 1, wherein said first side and said second side of the bow retaining portion are resilient and are movable at least one inch in response to an impact force of 100 pounds.

Clause 5. The docking assist assembly of clause 1, wherein said first side and said second side of the bow retaining portion are movable with respect to one another to facilitate receiving different shape bows there between.

Clause 6. The docking assist assembly of clause 1, wherein neither the arm portion, nor the bow retaining portion projects more than ten feet beyond a side of mounting portion configured to be supported by an upper surface of a dock.

Clause 7. The docking assist assembly of clause 1, wherein the docking assist assembly weighs no more than 500 pounds.

Clause 8. The docking assist assembly of clause 1, wherein the arm portion comprises a first arm portion and a second arm portion, wherein the second arm portion is rotatable relative to the first arm portion and a maximum amount of rotation of the second arm portion from a relaxed position is 45 degrees in a first direction.

Clause 9. The docking assist assembly of clause 8, wherein the second arm portion is rotatable relative to the first arm portion and the maximum amount of rotation of the second arm portion from a relaxed position is 90 degrees in a second direction.

Clause 10. The docking assist assembly of clause 1, wherein the first side of the bow retaining portion and the second side of the bow retaining portion are comprised of a single integral piece.

Clause 11. The docking assist assembly of clause 1 further comprising one or more of: lights coupled to the bow retaining portion, a slip resistant platform configured to couple with the upper surface of the dock, and a resilient dock bumper portion configured to couple to a water facing side of the dock.

Clause 12. A docking assist assembly mountable to a dock having a support area and an elongate edge along which a boat is to be docked, the docking assist assembly comprising: a mounting portion defining a support base; an arm portion configured to extend transverse to the edge of a dock along which a length of a boat is intended to dock, at least a portion of the arm portion movable with respect to the support base; and a bow retaining portion including a first side and a second side, the first side defining a first surface facing at least partially toward the second side and a second side defining a second surface at least partially facing toward the first side, said first side and said second side configured to receive a bow of a boat at least partially between the first side and the second side; wherein movement of the arm portion relative the support base at least partially absorbs a force of a boat docking; wherein when the support base is facing downward both the arm portion and the bow retaining portion either (1) do not extend below the support base or (2) extend less than two feet below the support base; wherein said first side and said second side at least partially include resilient areas configured to cushion the bow of a boat impacting the resilient areas.

Clause 13. A docking assist assembly, comprising: a mounting portion configured to be supported by an upper surface of a dock; an arm portion extending transverse to the mounting portion; a bow retaining portion defining an opening for receiving at least a portion of a bow of a boat; wherein at least one of the arm portion and the bow retaining portion is movable relative to the mounting portion so as to at least partially absorb a docking impact force of a boat.

Clause 14. The docking assist assembly of clause 13, wherein the bow retaining portion is rotatable with respect to the arm portion.

Clause 15. The docking assist assembly of clause 13, wherein the bow retaining portion is resilient and is movable at least one inch in response to an impact force of 100 pounds.

Clause 16. The docking assist assembly of clause 13, wherein the bow retaining portion comprises a first side and a second side, wherein said first side and said second side are movable with respect to one another to facilitate receiving different shape bows there between.

Clause 17. The docking assist assembly of clause 13, wherein the docking assist assembly weighs no more than 500 pounds.

Clause 18. The docking assist assembly of clause 13, wherein the arm portion comprises a first arm portion and a second arm portion, wherein the second arm portion is rotatable relative to the mounting portion and a maximum amount of rotation of the second arm portion from a relaxed position is 45 degrees.

Clause 19. The docking assist assembly of clause 18, wherein the second arm portion is rotatable relative to the first arm portion and the maximum amount of rotation of the second arm portion from a relaxed position is 90 degrees in a second direction.

Clause 20. The docking assist assembly of clause 13, wherein the bow retaining portion is comprised of a single integral piece.

Clause 21. A rear docking assist assembly, comprising: a mounting portion configured to be supported by an upper surface of a dock; a line comprising a first line end and a second line end, the first line end coupled to the mounting portion; and an arm comprising a first arm end and a second arm end, the first arm end rotationally coupled to the mounting portion, the second arm end configured to support the line; wherein the arm is configured to move between a retracted configuration where the second arm end is positioned over the mounting portion and an extended configuration where the second arm end and a portion of the line are positioned over water adjacent to the dock.

Clause 22. The rear docking assist assembly of clause 21, further comprising a line brake coupled to at least one of the mounting portion or the dock, the line brake moveable between an engaged configuration and a disengaged configuration, wherein the second line end passes through the line brake, wherein the line is fixed to the line brake when in the engaged configuration and movable relative to the line brake when in the disengaged configuration.

Clause 23. The rear docking assist assembly of clause 22, wherein the line brake comprises a foot release, wherein engagement of the foot release moves the line brake from the engaged configuration to the disengaged configuration.

Clause 24. The rear docking assist assembly of any of clauses 21 to 23, further comprising a pivot assembly, the pivot assembly coupled to the mounting portion and the first arm end, the pivot assembly configured to allow the arm to rotate relative to the mounting portion.

Clause 25. The rear docking assist assembly of any of clauses 21 to 24, wherein the rear docking assist assembly is configured to engage with an engagement portion coupled to a boat, wherein the line can extend around the engagement portion to secure the boat to the dock.

Clause 26. The rear docking assist assembly of clause 25, wherein the engagement portion extends at an angle relative to the mounting portion.

Clause 27. The rear docking assist assembly of any of clauses 24 to 26, wherein the pivot assembly includes a motor, the motor configured to move the arm between the retracted configuration and the extended configuration.

Clause 28. The rear docking assist assembly of clause 27, further comprising a sensor system, the sensor system configured to move the arm from the retracted configuration to the extended configuration when the boat is in close proximity to the rear docking assist assembly.

Clause 29. The rear docking assist assembly of any of clauses 21 to 28, wherein the second arm end comprises a line clip, the line clip configured to engage the line between the first line end and the second line end, the line moveable relative to the line clip.

Clause 30. A docking system comprising: the rear docking assist assembly of any of clauses 21 to 29; and a front docking assist assembly comprising: a second mounting portion configured to be supported by the upper surface of the dock; an arm portion extending transverse to the second mounting portion; a bow retaining portion including a first side and a second side, the first side defining a first surface facing at least partially toward the second side and a second side defining a second surface at least partially facing toward the first side, said first side and said second side configured to releasably engage and receive a bow of the boat at least partially between the first side and the second side during docking; a shock absorption assembly comprising a shock absorber or a spring; and a second pivot assembly connecting the second mounting portion and the arm portion; wherein at least one of the arm portion and the bow retaining portion is movable relative to the second mounting portion about the second pivot assembly, the front docking assist assembly having a relaxed position, the shock absorption assembly resisting movement of the at least one of the arm portion and the bow retaining portion relative to the second mounting portion about the second pivot assembly so as to at least partially absorb a docking impact force of the boat and applying force to move the at least one of the arm portion and the bow retaining portion towards the relaxed position about the second pivot assembly after at least partially absorbing the docking impact force of the boat.

Clause 31. The docking system of clause 30, wherein the first side and the second side of the bow retaining portion are resilient and moveable at least one inch in response to an impact force of 100 pounds.

Clause 32. A rear docking assist assembly, comprising: a dock portion comprising: a first mounting portion configured to be supported by an upper surface of a dock; and a post coupled to the first mounting portion and extending away from the upper surface of the dock; and a boat portion comprising: a second mounting portion configured to be supported by an upper surface of a boat; and an arm comprising a first arm end and a second arm end, the first arm end rotationally coupled to the second mounting portion, the second arm end comprising a hook; wherein the arm is configured to move between a retracted configuration where the second arm end is positioned over the second mounting portion and an extended configuration where the second arm end extends substantially perpendicularly to the second mounting portion.

Clause 33. The rear docking assist assembly of clause 32, further comprising a pivot assembly, the pivot assembly coupled to the second mounting portion and the first arm end, the pivot assembly configured to allow the arm to rotate relative to the second mounting portion.

Clause 34. The rear docking assist assembly of clause 32 or clause 33, wherein the hook is configured to engage the post to secure a rear end of the boat to the dock.

Clause 35. The rear docking assist assembly of clause 33 or clause 34, wherein the pivot assembly includes a motor, the motor configured to move the arm between the retracted configuration and the extended configuration.

Clause 36. The rear docking assist assembly of any of clauses 32 to 35, where in the boat portion further comprising a sensor system, the sensor system configured to move the arm from the retracted configuration to the extended configuration when the boat is in close proximity to the dock portion.

Clause 37. A docking system comprising: the rear docking assist assembly of any of clauses 32 to 36; and a front docking assist assembly comprising: a third mounting portion configured to be supported by the upper surface of the dock; an arm portion extending transverse to the second mounting portion; a bow retaining portion including a first side and a second side, the first side defining a first surface facing at least partially toward the second side and a second side defining a second surface at least partially facing toward the first side, said first side and said second side configured to releasably engage and receive a bow of the boat at least partially between the first side and the second side during docking; a shock absorption assembly comprising a shock absorber or a spring; and a second pivot assembly connecting the third mounting portion and the arm portion; wherein at least one of the arm portion and the bow retaining portion is movable relative to the second mounting portion about the second pivot assembly, the front docking assist assembly having a relaxed position, the shock absorption assembly resisting movement of the at least one of the arm portion and the bow retaining portion relative to the second mounting portion about the second pivot assembly so as to at least partially absorb a docking impact force of the boat and applying force to move the at least one of the arm portion and the bow retaining portion towards the relaxed position about the second pivot assembly after at least partially absorbing the docking impact force of the boat.

Clause 38. The docking system of clause 37, wherein the first side and the second side of the bow retaining portion are resilient and moveable at least one inch in response to an impact force of 100 pounds.

Clause 39. The docking system of clause 37 or clause 38, wherein the front docking assist assembly further comprises a connection system, the connection system extending from the bow retaining portion between the first side and the second side, the connection system comprising one or more connectors, each of the one or more connectors configured to releasably couple to boat anchor brackets of the boat.

Clause 40. The docking system of clause 39, wherein the one or more connectors comprise clips configured to move between an open configuration and a closed configuration, wherein the boat is secured to the front docking assist assembly when the boat anchor brackets are engaged with the one or more connectors in the closed configuration.

Clause 41. The docking system of clause 40, further comprising a control system, the control system configured to move the one or more connectors between the open configuration and the closed configuration.

Clause 42. The docking system of clause 40 or clause 41, where in the front docking assist assembly further comprises a sensor system, the sensor system configured to move the one or more connectors from the open configuration to the closed configuration when the boat anchor brackets engage the one or more connectors.

Clause 43. A docking system, comprising: a front assembly configured to engage a bow of a boat and at least partially absorb a docking impact force of the boat, the front assembly comprising: a first mounting portion configured to be supported by an upper surface of a dock; a first arm supported by the first mounting portion, the first arm extending transverse to the first mounting portion; and a bow retaining portion supported by the first arm; and a rear assembly configured to engage the boat, the rear assembly comprising: a second mounting portion configured to be supported by the upper surface of the dock; a line coupled to the second mounting portion; and a second arm configured to position the line over the boat such that the line engages a portion of the boat.

Clause 44. The docking system of clause 43, wherein the bow retaining portion comprises a first side and a second side, the first side defining a first surface facing at least partially toward the second side and the second side defining a second surface at least partially facing toward the first side, the bow retaining portion configured to releasably engage and receive the bow of the boat at least partially between the first side and the second side during docking.

Clause 45. The docking system of clause 43 or clause 44, wherein the front assembly further comprises a pivot assembly connecting the first mounting portion and the first arm, the first arm moveable relative to the first mounting portion above the pivot assembly.

Clause 46. The docking system of clause 45, wherein the front assembly further comprises a shock absorption assembly, the shock absorption assembly resisting movement of the first arm relative to the first mounting portion about the pivot assembly so as to at least partially absorb the docking impact force of the boat.

Clause 47. The docking system of any of clauses 44 to 46, wherein the front assembly further comprises a connection system, the connection system extending from the bow retaining portion between the first side and the second side, the connection system comprising one or more connectors, each of the one or more connectors configured to releasably couple to boat anchor brackets of the boat.

Clause 48. The docking system of clause 47, wherein the one or more connectors comprise clips configured to move between an open configuration and a closed configuration, wherein the boat is secured to the front assembly when the boat anchor brackets are engaged with the one or more connectors in the closed configuration.

Clause 49. The docking system of clause 48, further comprising a control system, the control system configured to move the one or more connectors between the open configuration and the closed configuration.

Clause 50. The docking system of clause 48 or clause 49, further comprises a sensor system, the sensor system configured to move the one or more connectors from the open configuration to the closed configuration when the boat anchor brackets engage the one or more connectors.

Clause 51. The docking system of any of clauses 43 to 46, wherein the second arm is rotationally coupled to the second mounting portion via a first end, the second arm configured to move between a retracted configuration and an extended configuration, wherein in the extended configuration, a second end of the second arm is positioned over the second mounting portion, and in the retracted configuration, the second end of the second arm is positioned over water adjacent to the dock.

Clause 52. The docking system of any of clauses 43 to 51, wherein the rear assembly further comprises a line brake coupled to at least one of the second mounting portion or the dock, the line brake moveable between an engaged configuration and a disengaged configuration, wherein the line passes through the line brake, wherein the line is fixed to the line brake when in the engaged configuration and movable relative to the line brake when in the disengaged configuration.

Clause 53. The docking system of clause 52, wherein the line brake comprises a release, wherein engagement of the release moves the line brake from the engaged configuration to the disengaged configuration.

Clause 54. The docking system of any of clauses 43 to 53, wherein the rear assembly further comprises a second pivot assembly, the second pivot assembly coupled to the second mounting portion and the second arm, the second pivot assembly configured to allow the second arm to rotate relative to the second mounting portion.

Clause 55. The docking system of any of clauses 43 to 54, wherein the rear assembly is configured to engage with an engagement portion coupled to the boat, wherein the line can extend around the engagement portion to secure the boat to the dock.

Clause 56. The docking system of clause 55, wherein the engagement portion extends at an angle relative to the second mounting portion.

Clause 57. The docking system of any of clauses 54 to 56, wherein the second pivot assembly includes a motor, the motor configured to move the second arm between the retracted configuration and the extended configuration.

Clause 58. The docking system of clause 57, further comprising a sensor system, the sensor system configured to move the second arm from the retracted configuration to the extended configuration when the boat is in close proximity to the docking system.

Clause 59. A docking system, comprising: a front assembly configured to engage a bow of a boat and at least partially absorb a docking impact force of the boat, the front assembly comprising: a first mounting portion configured to be supported by an upper surface of a dock; a first arm supported by the first mounting portion, the first arm extending transverse to the first mounting portion; and a bow retaining portion supported by the first arm; and a post coupled to at least one of the first mounting portion, a second mounting portion, or the dock, the post extending away from the upper surface of the dock.

Clause 60. The docking system of clause 59, wherein the bow retaining portion comprises a first side and a second side, the first side defining a first surface facing at least partially toward the second side and the second side defining a second surface at least partially facing toward the first side, the bow retaining portion configured to releasably engage and receive the bow of the boat at least partially between the first side and the second side during docking.

Clause 61. The docking system of clause 59 or clause 60, wherein the front assembly further comprises a pivot assembly connecting the first mounting portion and the first arm, the first arm moveable relative to the first mounting portion above the pivot assembly.

Clause 62. The docking system of clause 61, wherein the front assembly further comprises a shock absorption assembly, the shock absorption assembly resisting movement of the first arm relative to the first mounting portion about the pivot assembly so as to at least partially absorb the docking impact force of the boat.

Clause 63. The docking system of any of clauses 60 to 62, wherein the front assembly further comprises a connection system, the connection system extending from the bow retaining portion between the first side and the second side, the connection system comprising one or more connectors, each of the one or more connectors configured to releasably couple to boat anchor brackets of the boat.

Clause 64. The docking system of clause 63, wherein the one or more connectors comprise clips configured to move between an open configuration and a closed configuration, wherein the boat is secured to the front assembly when the boat anchor brackets are engaged with the one or more connectors in the closed configuration.

Clause 65. The docking system of clause 64, further comprising a control system, the control system configured to move the one or more connectors between the open configuration and the closed configuration.

Clause 66. The docking system of clause 64 or clause 65, further comprises a sensor system, the sensor system configured to move the one or more connectors from the open configuration to the closed configuration when the boat anchor brackets engage the one or more connectors.

Clause 67. The docking system of any of clauses 59 to 66, further comprising: a boat assembly comprising: a third mounting portion configured to be supported by an upper surface of the boat; and a second arm rotationally coupled to the third mounting portion via a first end, the second arm comprising a hook at a second end of the second arm, the second arm configured to move between a retracted configuration where the hook is positioned over the third mounting portion and an extended configuration where the hook extends substantially perpendicularly to the third mounting portion.

Clause 68. The docking system of clause 67, wherein the boat assembly further comprises a second pivot assembly, the second pivot assembly coupled to the third mounting portion and the second arm, the second pivot assembly configured to allow the second arm to rotate relative to the third mounting portion.

Clause 69. The docking system of clause 68, wherein the second pivot assembly includes a motor, the motor configured to move the second arm between the retracted configuration and the extended configuration.

Clause 70. The docking system of any of clauses 67 to 69, wherein the hook is configured to engage the post to secure a rear end of the boat to the dock.

Clause 71. The docking system of any of clauses 67 to 70, further comprising a sensor system, the sensor system configured to move the second arm from the retracted configuration to the extended configuration when the boat is in close proximity or engages the front assembly.

What is claimed is:

1. A docking system, comprising:

a dock portion comprising:

a first mounting portion configured to be supported by an upper surface of a dock;

a post coupled to the first mounting portion and extending away from the upper surface of the dock;

an arm portion extending transverse to the first mounting portion or a second mounting portion;

a bow retaining portion including a first side and a second side, the first side defining a first surface facing at least partially toward the second side and a second side defining a second surface at least partially facing toward the first side, said first side and said second side configured to releasably engage and receive a bow of a boat at least partially between the first side and the second side during docking;

a shock absorption assembly comprising a shock absorber or a spring; and a first pivot assembly connecting the first mounting portion or the second mounting portion and the arm portion;

wherein at least one of the arm portion or the bow retaining portion is movable relative to the first mounting portion or the second mounting portion about the first pivot assembly, the shock absorption assembly configured to resist movement of the at least one of the arm portion or the bow retaining portion about the first pivot assembly so as to at least partially absorb a docking impact force of the boat and configured to apply force to move the at least one of the arm portion or the bow retaining portion towards a relaxed position about the first pivot assembly after at least partially absorbing the docking impact force of the boat; and a boat portion comprising:

a third mounting portion configured to be supported by an upper surface of a boat; and an arm comprising a first arm end and a second arm end, the first arm end rotationally coupled to the third mounting portion, the second arm end comprising a hook;

wherein the arm is configured to move between a retracted configuration where the second arm end is positioned over the third mounting portion and an extended configuration where the second arm end extends substantially perpendicularly to the third mounting portion.

2. The docking system of claim 1, wherein the boat portion further comprises a second pivot assembly, the second pivot assembly coupled to the third mounting portion and the first arm end, the second pivot assembly configured to allow the arm to rotate relative to the third mounting portion.

3. The docking system of claim 2, wherein the second pivot assembly includes a motor, the motor configured to move the arm between the retracted configuration and the extended configuration.

4. The docking system of claim 1, wherein the hook is configured to engage the post to secure a rear end of the boat to the dock.

5. The docking system of claim 1, wherein the boat portion further comprising a control system, the control system configured to move the arm from the retracted configuration to the extended configuration when the boat is in close proximity to the dock portion.

6. The docking system of claim 1, wherein the dock portion further comprises a connection system, the connection system extending from the bow retaining portion between the first side and the second side, the connection system comprising one or more connectors, each of the one or more connectors configured to releasably couple to boat anchor brackets of the boat.

7. The docking system of claim 6, wherein the one or more connectors comprise clips configured to move between an open configuration and a closed configuration, wherein the boat is secured to the dock portion when the boat anchor brackets are engaged with the one or more connectors in the closed configuration.

8. The docking system of claim 7, where in the dock portion further comprises a sensor system, the sensor system configured to move the one or more connectors from the open configuration to the closed configuration when the boat anchor brackets engage the one or more connectors.

9. A docking system, comprising:

a front assembly configured to engage a bow of a boat and at least partially absorb a docking impact force of the boat, the front assembly comprising:

a first mounting portion configured to be supported by an upper surface of a dock;

a first arm supported by the first mounting portion, the first arm extending transverse to the first mounting portion;

a bow retaining portion supported by the first arm, the bow retaining portion comprising a first side and a second side, the first side defining a first surface facing at least partially toward the second side and the second side defining a second surface at least partially facing toward the first side, the bow retaining portion configured to releasably engage and receive the bow of the boat at least partially between the first side and the second side during docking; and a connection system extending from the bow retaining portion between the first side and the second side, the connection system comprising one or more connectors, each of the one or more connectors configured to releasably couple to boat anchor brackets of the boat; and a post coupled to at least one of the first mounting portion, a second mounting portion, or the dock, the post extending away from the upper surface of the dock.

10. The docking system of claim 9, wherein the front assembly further comprises a pivot assembly connecting the first mounting portion and the first arm, the first arm moveable relative to the first mounting portion above the pivot assembly.

11. The docking system of claim 10, wherein the front assembly further comprises a shock absorption assembly, the shock absorption assembly resisting movement of the first arm relative to the first mounting portion about the pivot assembly so as to at least partially absorb the docking impact force of the boat.

12. The docking system of claim 9, wherein the one or more connectors comprise clips configured to move between an open configuration and a closed configuration, wherein the boat is secured to the front assembly when the boat anchor brackets are engaged with the one or more connectors in the closed configuration.

13. The docking system of claim 12, further comprising a control system, the control system configured to move the one or more connectors between the open configuration and the closed configuration.

14. The docking system of claim 9, further comprising:

a boat assembly comprising:

a third mounting portion configured to be supported by an upper surface of the boat; and a second arm rotationally coupled to the third mounting portion via a first end, the second arm comprising a hook at a second end of the second arm, the second arm configured to move between a retracted configuration where the hook is positioned over the third mounting portion and an extended configuration where the hook extends substantially perpendicularly to the third mounting portion, the hook configured to engage the post to secure a rear end of the boat to the dock.

15. The docking system of claim 14, wherein the boat assembly further comprises a second pivot assembly, the second pivot assembly coupled to the third mounting portion and the second arm, the second pivot assembly configured to allow the second arm to rotate relative to the third mounting portion.

16. The docking system of claim 15, wherein the second pivot assembly includes a motor, the motor configured to move the second arm between the retracted configuration and the extended configuration.

17. The docking system of claim 14, wherein the boat assembly further comprises a second control system, the second control system configured to move the second arm from the retracted configuration to the extended configuration.

18. A docking system, comprising:

a front assembly configured to engage a bow of a boat and at least partially absorb a docking impact force of the boat, the front assembly comprising:

a first mounting portion configured to be supported by an upper surface of a dock;

a first arm supported by the first mounting portion, the first arm extending transverse to the first mounting portion;

a bow retaining portion supported by the first arm, the bow retaining portion comprising a first side and a second side, the first side defining a first surface facing at least partially toward the second side and the second side defining a second surface at least partially facing toward the first side, the bow retaining portion configured to releasably engage and receive the bow of the boat at least partially between the first side and the second side during docking; and a connection system extending from the bow retaining portion between the first side and the second side, the connection system comprising one or more connectors, each of the one or more connectors configured to releasably couple to boat anchor brackets of the boat.

19. The docking system of claim 18, wherein the front assembly further comprises a pivot assembly connecting the first mounting portion and the first arm, the first arm moveable relative to the first mounting portion above the pivot assembly.

20. The docking system of claim 19, wherein the front assembly further comprises a shock absorption assembly, the shock absorption assembly resisting movement of the first arm relative to the first mounting portion about the pivot assembly so as to at least partially absorb the docking impact force of the boat.

* * * * *